US012674638B2

(12) United States Patent
Underwood et al.

(10) Patent No.: US 12,674,638 B2
(45) Date of Patent: Jul. 7, 2026

(54) MOUNT ASSEMBLY FOR FIREARM

(71) Applicant: AXTS INC, Redmond, OR (US)

(72) Inventors: Joshua A Underwood, Redmond, OR (US); Anibal Salinas, Redmond, OR (US); Seth K. Peterson, Redmond, OR (US)

(73) Assignee: AXTS INC, Redmond, OR (US)

( * ) Notice: Subject to any disclaimer, the term of this patent is extended or adjusted under 35 U.S.C. 154(b) by 0 days.

(21) Appl. No.: 18/927,633

(22) Filed: Oct. 25, 2024

(65) Prior Publication Data

US 2025/0085075 A1 Mar. 13, 2025

Related U.S. Application Data

(60) Division of application No. 17/993,808, filed on Nov. 23, 2022, now Pat. No. 12,510,321, which is a continuation-in-part of application No. 17/156,503, filed on Jan. 22, 2021, now Pat. No. 11,920,898.

(60) Provisional application No. 63/285,968, filed on Dec. 3, 2021, provisional application No. 62/965,711, filed on Jan. 24, 2020, provisional application No. 63/111,025, filed on Nov. 7, 2020.

(51) Int. Cl.
*F41A 21/36* (2006.01)

(52) U.S. Cl.
CPC ..... *F41A 21/36* (2013.01)

(58) Field of Classification Search
CPC ..... F41A 21/36; F41A 21/30; F41A 21/32; F41A 21/34; F41A 21/38
See application file for complete search history.

(56) References Cited

U.S. PATENT DOCUMENTS

| | | | |
|---|---|---|---|
| 198,670 | A | 12/1877 | Nichols |
| 534,691 | A | 2/1895 | Hepburn |
| 2,859,444 | A | 11/1958 | Michel |
| 2,866,288 | A | 12/1958 | Herter |
| 3,187,632 | A | 6/1965 | Harvey |
| 3,455,586 | A | 7/1969 | Kurtzmann |
| 3,777,381 | A | 12/1973 | Moller |
| 3,978,762 | A | 9/1976 | Khaidurov |
| 4,429,614 | A | 2/1984 | Tocco |

(Continued)

FOREIGN PATENT DOCUMENTS

| | | | |
|---|---|---|---|
| DE | 202008003636 | U1 | 8/2008 |
| DE | 202009010664 | U1 | 12/2009 |

(Continued)

OTHER PUBLICATIONS

JP Enterprises, "JPA-TANSN—Joint mount with integral guard wings, for Trijicon TA01-NSN ACOG scope", Jan. 12, 2018 web archive of https://jprifles.com/buy.php?item=JPA-TANSN, 1 page.

(Continued)

*Primary Examiner* — Jonathan C Weber
(74) *Attorney, Agent, or Firm* — Schwabe Williamson & Wyatt

(57) ABSTRACT

A firearm or firearm retrofit assembly may include a compensation assembly to receive gas expelled from a muzzle of a barrel or an egress in a length of the barrel. The compensation assembly may include one or more gas flow-directing sections to tune the flow of gas through the compensation assembly, which may reduce recoil. Other embodiments may be disclosed and/or claimed.

56 Claims, 77 Drawing Sheets

(56) References Cited

U.S. PATENT DOCUMENTS

| | | | | |
|---|---|---|---|---|
| 4,562,767 | A | 1/1986 | Janssen | |
| 4,570,529 | A | 2/1986 | A'Costa | |
| 4,691,614 | A | 9/1987 | Leffel | |
| 4,827,652 | A | 5/1989 | Martin | |
| 4,893,426 | A | 1/1990 | Bixler | |
| 4,930,397 | A | 6/1990 | Seidler | |
| 5,076,137 | A | 12/1991 | Paredes | |
| 5,325,617 | A | 7/1994 | Vojta | |
| 5,549,030 | A | 8/1996 | Lespron | |
| 5,559,302 | A | 9/1996 | Latka | |
| 5,815,936 | A | 10/1998 | Sieczka | |
| 6,327,806 | B1 | 12/2001 | Paige | |
| 6,516,551 | B2 | 2/2003 | Gaber | |
| 7,143,680 | B2 | 12/2006 | Bender | |
| 7,328,645 | B1 | 2/2008 | Curry | |
| 7,647,721 | B1 | 1/2010 | Gaber | |
| 7,854,085 | B1 | 12/2010 | Hodgkins | |
| 8,024,885 | B1 | 9/2011 | Newhall | |
| 8,082,688 | B2 | 12/2011 | Elpedes et al. | |
| 8,186,093 | B1 | 5/2012 | Chung | |
| 8,468,734 | B2 | 6/2013 | Meller | |
| 8,499,676 | B1 | 8/2013 | Moore | |
| 9,372,049 | B2 | 6/2016 | Cheng et al. | |
| 9,423,212 | B2 | 8/2016 | Campean | |
| 9,464,865 | B2 | 10/2016 | Shea | |
| 9,574,853 | B2 | 2/2017 | Crispin | |
| 9,696,114 | B1 | 7/2017 | Cabrera | |
| 9,995,550 | B2 | 6/2018 | Shelton | |
| 10,139,197 | B1 | 11/2018 | Horton | |
| 10,156,412 | B1 | 12/2018 | Price | |
| 10,234,237 | B1 | 3/2019 | Jager | |
| 10,247,515 | B2 | 4/2019 | Collin | |
| 10,337,820 | B2 | 7/2019 | Jager | |
| 10,767,952 | B1 | 9/2020 | Till | |
| 11,002,517 | B1 | 5/2021 | Holly | |
| 11,150,051 | B2 | 10/2021 | Connolly | |
| 11,300,382 | B2 | 4/2022 | Holly | |
| 11,692,793 | B2 | 7/2023 | Nackel | |
| 11,788,818 | B2 | 10/2023 | Roth | |
| 11,841,210 | B2 | 12/2023 | Sun | |
| 11,852,427 | B2 | 12/2023 | Bachstein | |
| 12,253,322 | B1 | 3/2025 | Vining | |
| 2004/0244571 | A1 | 12/2004 | Bender | |
| 2006/0191525 | A1* | 8/2006 | Dai | F42B 5/145 89/14.6 |
| 2006/0283318 | A1 | 12/2006 | Beaty | |
| 2008/0134561 | A1 | 6/2008 | Clouser | |
| 2010/0154278 | A1 | 6/2010 | Curry | |
| 2011/0154711 | A1 | 6/2011 | Dickerson | |
| 2013/0263491 | A1 | 10/2013 | Jung | |
| 2013/0283660 | A1 | 10/2013 | Matthews et al. | |
| 2014/0230305 | A1 | 8/2014 | Zimmer | |
| 2014/0305022 | A1 | 10/2014 | Chung | |
| 2016/0209154 | A1 | 7/2016 | Wilson | |
| 2017/0023326 | A1 | 1/2017 | Wilson | |
| 2017/0030679 | A1 | 2/2017 | Campbell | |
| 2017/0191780 | A1 | 7/2017 | Barett | |
| 2017/0205178 | A1 | 7/2017 | Niswander et al. | |
| 2018/0017356 | A1 | 1/2018 | Cabrera | |
| 2018/0195835 | A1 | 7/2018 | Crispin | |
| 2019/0011209 | A1* | 1/2019 | Chavez | F41A 21/36 |
| 2019/0033030 | A1 | 1/2019 | Belykov | |
| 2019/0101350 | A1 | 4/2019 | Hall | |
| 2019/0257620 | A1 | 8/2019 | Zimmer | |
| 2019/0277600 | A1 | 9/2019 | Larsson | |
| 2019/0331461 | A1 | 10/2019 | Zimmer | |
| 2020/0025498 | A1 | 1/2020 | Wheeler | |
| 2020/0025520 | A1 | 1/2020 | Niswander | |
| 2020/0224989 | A1* | 7/2020 | Bundy | F41A 21/325 |
| 2020/0232759 | A1 | 7/2020 | York | |
| 2020/0292269 | A1 | 9/2020 | Guillen | |
| 2021/0025673 | A1 | 1/2021 | Niswander et al. | |
| 2021/0088301 | A1 | 3/2021 | Warburton | |
| 2021/0156646 | A1 | 5/2021 | Schulte | |
| 2021/0222970 | A1 | 7/2021 | Ribic | |
| 2021/0231399 | A1 | 7/2021 | Salinas et al. | |
| 2021/0231400 | A1 | 7/2021 | Salinas et al. | |
| 2021/0231407 | A1 | 7/2021 | Salinas | |
| 2022/0244020 | A1 | 8/2022 | Morell | |
| 2023/0033894 | A1 | 2/2023 | Salinas et al. | |
| 2023/0090595 | A1 | 3/2023 | Underwood | |
| 2023/0304764 | A1 | 9/2023 | Holly | |
| 2023/0358510 | A1 | 11/2023 | Salinas | |
| 2024/0401912 | A1 | 12/2024 | Salinas et al. | |
| 2025/0052532 | A1 | 2/2025 | Underwood et al. | |

FOREIGN PATENT DOCUMENTS

| | | | | |
|---|---|---|---|---|
| WO | WO-2018044522 | A1 * | 3/2018 | F41A 21/28 |
| WO | 2020/244218 | A1 | 12/2020 | |

OTHER PUBLICATIONS

Redwolf Airsoft, "G&P OP Type Red Dot w/ Adjustable Guard Mount", Accessed Jan. 24, 2020 from http://www.redwolfairsoft.com/redwolf/airsoft/Accessories_Scopes_and_Sights_AEG_G_P_OP_Type_Red_Dot_w_Adjustable_Guard_Mount_Sand.htm, 3 pages.

Reptilia, "RMR Backup Mounting Options for 30MM Optics", Posted Jul. 17, 2019 on the Firearm Blog at https://www.thefirearmblog.com/blog/2019/07/17/reptilia-rmr/, 23 pages.

Sig Sauer, Romeo1 Shroud Kit Fits Romeo1 Only, Oct. 15, 2018, retrieved from URL: https://www.opticsplanet.com/sig-sauer-romeo1-shroud-kit-fits romeo1-only.html, 3 pages.

Dcprecisionllc; DC Port Tracker; Instagram; Mar. 2, 2021; 5 pages; https://www.instagram.com/p/CL7n-agreW6/?utm_source=ig_web_button_share_sheet.

JP Enterprises, JPOINT4-WPG-ROS, May 20, 2018 web archive, URL: https://web.archive.org/web/20180520062944/https://www.jprifles.com/buy.;hp?item=JPINT4-WPG-ROS.

Imminent Threat Solutions, "DIY AR-15 Build: Front Sight Base Installation", https://www.itstactical.com/warcom/firearms/diy-ar-15-build-front-sight-base-installation/ At least prior to Jan. 24, 2020, pp. 1-17.

Weapons Armament Research; "Now Accepting Orders for the Afterburner. Please Visit our Website", Instagram, Jun. 7, 2017.

Weapons Armament Research; "Afterburner", Instagram, May 26, 2017.

Weapons Armament Research; "Afterburner", Instagram, May 28, 2017.

Weapons Armament Research; "Afterburner", Instagram, Jun. 2, 2017.

Weapons Armament Research; "Afterburner", Instagram, Jun. 7, 2017.

USPTO; Non-Final Office Action; U.S. Appl. No. 17/156,503; Jul. 13. 2023, pp. 1-31.

AN R Design LLC, "WAR M&P 2.0 AFTERBURNER 5"—By Weapons Armament Research", Aug. 13, 2017, YouTube, Entire Video, <https://www.youtube.com/watch?v=ppb-8smNCfE>. (Year: 2017).

Salinas, Anibal, Cross Section View—unpublished M&P Slice cut diagrams that describe features present within an end product* of an M&P 2.0 slide porting service offered for sale at least as early as Jun. 7, 2017 (*the end product is the same end product featured in the NPL Video reference titled ""WAR M&P Afterburner 5"" relied upon in the 35 USC 102 rejection asserted in a Jul. 13, 2023 Office Action in U.S. Appl. No. 17/156,503).

thefirearmsblog.com, "Mayhem Syndicate CALI Compensator System", On-line Blog, May 23, 2018, pp. 1-18, https://www.thefirearmblog.com/blog/2018/05/23/mayhem-syndicate-cali-compensator-system/.

Salinas, Anibal, Isometric Section View - unpublished M&p. Slice cut diagrams that describe features present within an end product* of an M&p. 2.0 slide porting service offered for sale at least as early as Jun. 7, 2017 (*the end product is the same end product featured in the NPL Video reference titled "WAR M&p. Afterburner 5" relied upon in the 35 USC 102 rejection asserted in a Jul. 13, 2023 Office Action in U.S. Appl. No. 17/156,503).

(56) References Cited

OTHER PUBLICATIONS

Salinas, Anibal, Instagram, Weapons Armament Research, at least as early as Dec. 10, 2016; https://www.instagram.com/p/BN3Fw4PgQLL/?utm_source=ig_web_copy_link&igsh=MzRIODBiNWFIZA==.
Tactical Toolbox, Video "If You Own a Glock . . . You Need to See This Mayhem Syndicate Glock Comp", YouTube video, See: 5:40-5:45; https://www.youtube.com/watch?v=kaXV6sfmMNk&ab_channel=TacticalToolbox; Jun. 28, 2017.
Weapons Armament Research; "Compensator", Instagram, Date: Oct. 29, 2018. https://www.instagram.com/reel/Bph-15zBh69/.
Mac Defense Industries, "Quick Rundown of the Install and Removal of the Stubby and Half-Chub Comp." Facebook Video. Nov. 6, 2020. https://www.facebook.com/macdefense/videos/quick-rundown-of-the-install-and-removal-of-the-stubby-and-half-chub-comp/1642922935887934/.
ar15.com; "Buyer Beware: TROS Three Lug", Forum Thread, Nov. 12, 2019. https://www.ar15.com/forums/Armory/Buyer-Beware-TROS-three-lug/20-504765/.
HB Industries, "CZ Scorpion 5.3" Micro K. Barrel", At least prior to Jan. 24, 2020. https://hbindustries.net/store/shop/cz-scorpion-micro-k-barrel/#reviews.
Griffin Armament; Instragram, Aug. 2, 2020. https://www.instagram.com/p/CDalOnjh41q/?utm_source=ig_web_copy_link&igsh=MzRIODBiNWFIZA%3D%3D.
Floyds Custom Shop; Instragram Video, "New Porting Option", Jun. 5, 2018. https://www.instagram.com/p/BjqeP-8nSVd/?utm_source=ig_web_copy_link&igsh=MzRIODBiNWFIZA%3D%3D.
Monsoon Tactical; Instragram Video, "Dopest C2 on the Gram", Oct. 6, 2020. https://www.instagram.com/p/CGBNx6spcED/?utm_source=ig_web_copy_link&igsh=MzRIODBINWFIZA%3D%3D.
Glock19c, Photograph, At least prior to Jan. 24, 2020.
Weapons Armament Research; "Afterburner", Instagram, Nov. 11, 2018. https://www.instagram.com/p/BqDiWQBARHN/.
Tyrant CNC; "Glock Campatible T-Comp", Feb. 14, 2019; https://www.tyrantcnc.com/glock-compensator.html.
Wing Tactical; "Glock Compensators—What to Know", Nov. 17, 2020; https://www.wingtactical.com/blog/glock-compensators-what-to-know/.
FN Firearms, "The Edge of Performance is Here—Introducing the FN 509 LS Edge"; Jan. 11, 2021, Press Resease; https://fnamerica.com/press-releases/the-edge-of-performance-is-here-introducing-the-fn-509-Is-edge/.
Google Search, "Hellcat RDS Release Date" Feb. 23, 2021; https://www.google.com/search?q=hellcat+rdp+release+date&rlz=1C1GCEA_enUS1052US1052&oq=hellcat+rdp+release+date&gs_lcrp=EgZjaHJvbWUyBggAEEUYOdIBCTU2MjVqMWoxNagCCLACAQ&sourceid=chrome&ie=UTF-8.
On Target Magazine; "Springfield Armory Hellcat RDP" May 2021; https://www.ontargetmagazine.com/2021/05/springfield-armory-hellcat-rdp/.
Guns & Ammo; "Springfield Armory Hellcat RDP & Hellcat Pro 9 mm Pistorls: Full Review" Jan. 4, 2023; https://www.gunsandammo.com/editorial/springfield-armory-hellcat-rdp-hellcat-pro-9mm-pistols-full-review/467714.
Firearms News; "FN 509 CC Edge 9mm Compact Compensated Pistol First Look"; Sep. 9, 2022; https://www.firearmsnews.com/editorial/fn-509-cc-edge-compact-compensated-pistol/464534.
Weapons Man, Carry handle My Wayward Son, Apr. 13, 2019, p. 1.
Wilson, Jim, "Get a Handle on Your Concealed Carry Gun", Shooting Illustrated, Feb. 14, 2017, p. 1.
American Rifleman, "Dope Bag®, Sigarms P229 Sport", Apr. 1998, pp. 42-48.

* cited by examiner (Background)

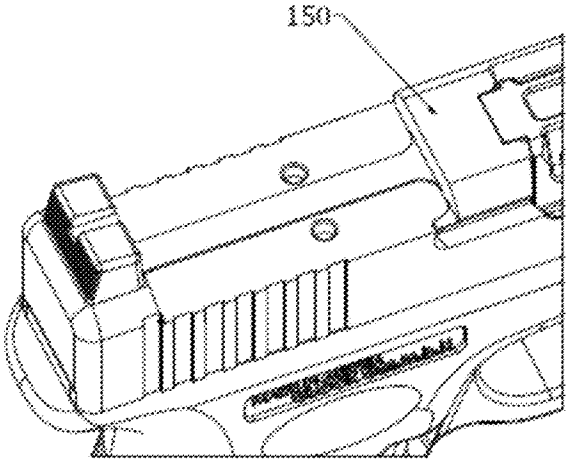
FIG. 1B (Background)
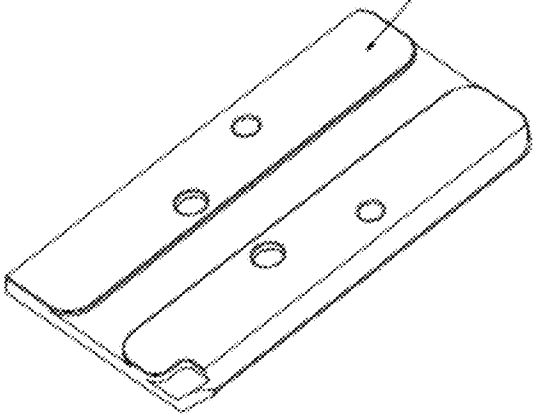
FIG. 1C (Background)
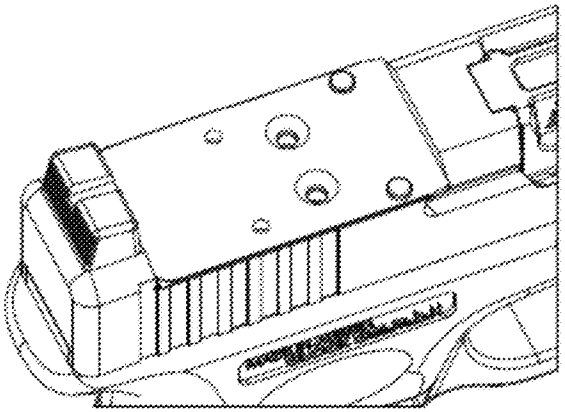
FIG. 1D (Background)
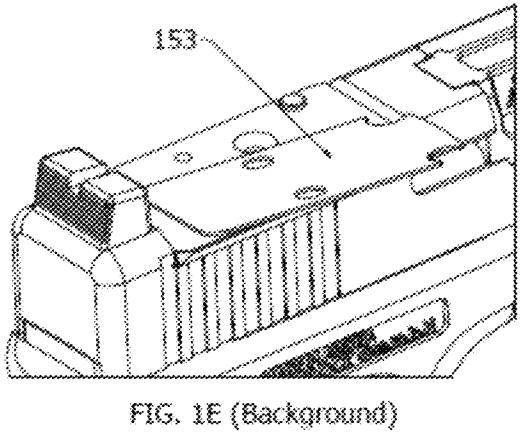
FIG. 1E (Background)
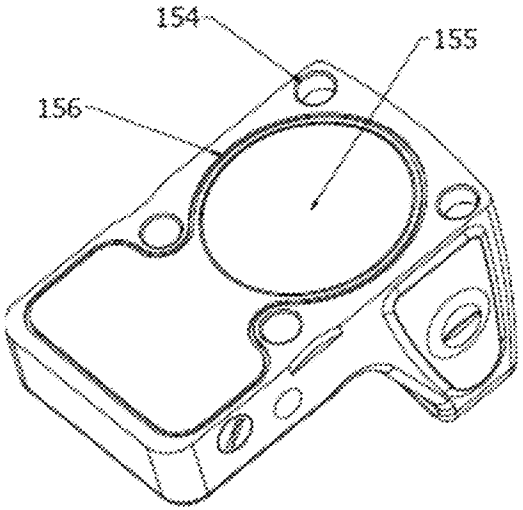
FIG. 1F (Background)
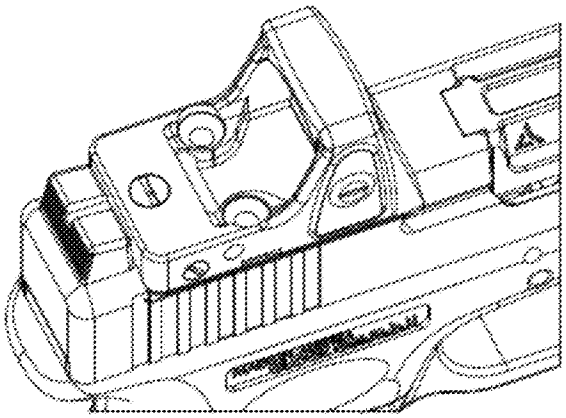
FIG. 1G (Background)

DETAIL K
ROUND TAPER PROFILE

MOUNT ASSEMBLY FOR FIREARM

RELATED APPLICATIONS

This application is a divisional of U.S. patent application Ser. No. 17/993,808, filed on Nov. 23, 2022, which claims priority to U.S. Provisional Application No. 63/285,968, filed on Dec. 3, 2021 and is a continuation-in-part of U.S. patent application Ser. No. 17/156,503, filed on Jan. 22, 2021, now U.S. Pat. No. 11,920,898, issued Mar. 5, 2024, which claims priority to U.S. Provisional Application No. 62/965,711 filed on Jan. 24, 2020, and U.S. Provisional Application No. 63/111,025 filed on Nov. 7, 2020, each of which are incorporated by reference herein.

BACKGROUND

Typical firearms propel a bullet or other type of projectile through the expansion of gas within a firearm barrel. The majority of the gas may be expelled out of the front of the firearm barrel together with the bullet. However, some firearms may exploit a portion of the gas to reduce recoil.

An accessory called a compensator can be used to retrofit a firearm with recoil reduction. These accessories are attached to the muzzle end of the barrel. However, this increases the total length of the firearm.

BRIEF DESCRIPTION OF THE DRAWINGS

FIG. 1B illustrates a partial top view of a slide with an MOS (modular optic system) cover plate removed.

FIG. 1C illustrates a bottom view of an MOS adapter plate.

FIG. 1D illustrates a slide assembly in which the MOS adapter plate of FIG. 1C is installed on the slide of FIG. 1B.

FIG. 1E illustrates installation of a sealing plate on the slide assembly of FIG. 1D.

FIG. 1F illustrates a bottom view of an RMR (rugged miniature reflex) optic.

FIG. 1G illustrates the RMR optic of FIG. 1F and the sealing plate of FIG. 1E installed on the slide assembly of FIG. 1D.

DETAILED DESCRIPTION

Slide Assembly to Provide Gas Compensation to Reduce Recoil

Services have been offered to bore openings in a slide assembly to guide gas propelled from a chamber of a firearm in a direction to provide recoil reduction. The service provider obtains a slide assembly from the customer, removes material from various components of the slide assembly, and then returns the slide assembly to the customer.

In some services, the service provider removes material from a top half of the barrel to form a gas port. The service provider may also remove material from the top and/or sides of the slide around the gas port in the barrel in an attempt to vent some of the gas exiting the gas port out top and/or sides the slide. However, if these slide vents are not effective at venting the gas exiting the gas port, then the unvented gas may distribute carbon particles throughout the firearm, which may eventually degrade operation of the firearm.

Also, removing the material from the gas port in the barrel may leave burs that may contact a bullet passing by the gas port (on its way to the muzzle)-changing its trajectory. These burs may also strip material from the passing bullet. This stripped material, like the carbon particles, may be distributed through the firearm, which may eventually degrade operation of the firearm (also the stripped material is a safety concern for the shooter and/or bystanders).

Figure 1A:
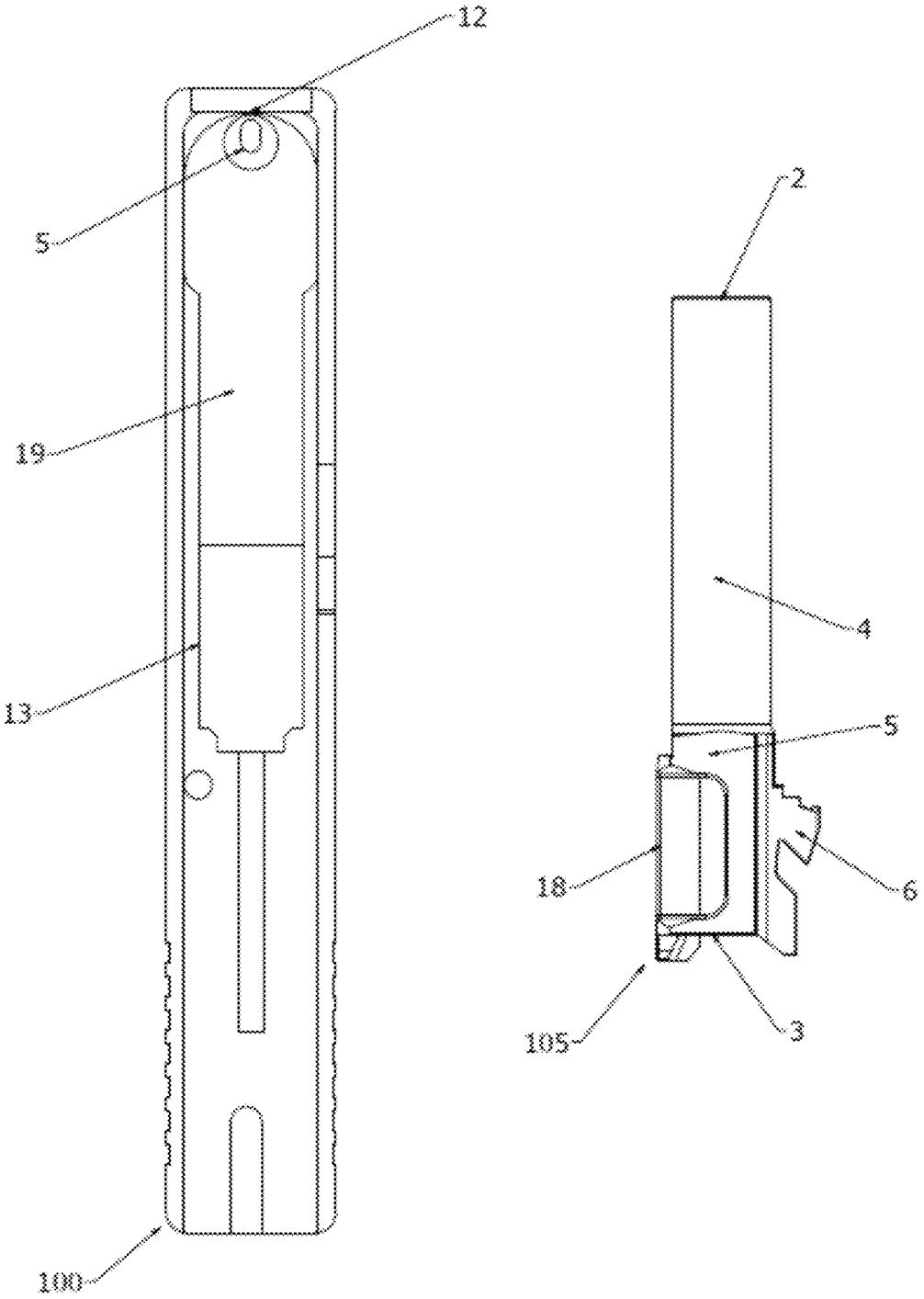
FIG. 1A illustrates a slide assembly including a bottom view of a slide and a side view of a barrel.

FIG. 1A illustrates a slide assembly including a bottom view of a slide 100 and a side view of a barrel 105. In this example, the slide 100 and barrel 105 are Glock-compatible. A Glock-compatible firearm component is compatible with the Glock design (but may be produced by a third party).

The barrel 105 includes a breech 3, a muzzle 2, and a length including a cylindrical bore length segment 4 (which includes the bore of the barrel 105) and a non-cylindrical barrel hood segment 5 (which includes the chamber of the barrel 105).

When the barrel 105 is locked into the slide 100, a tip of the muzzle end of the barrel 105 protrudes from the front of the slide 100. There are gaps between the rest of the bore length segment and the interior of the top and the sides of the slide 100. In particular, the width (w1) of the interior of the slide 100 corresponds to the width of the barrel hood, which accommodates rearward movement of the slide 100 relative to the barrel 105 following firing of the firearm. A wear marking 19 can be seen on the underside of the top of the slide 100 where the top of the barrel hood 18 (e.g., the side opposite the lugs 6) slides against the underside of the top of the slide 100 during this movement (the length of this wear marking 19 corresponds to the length of stroke of the firearm). In this slide assembly, these gaps are continuous from the opening 13 (which receives the top 18 of the barrel hood) past the sight mount 5 to the front interior 12 of the slide.

Figure 2A:
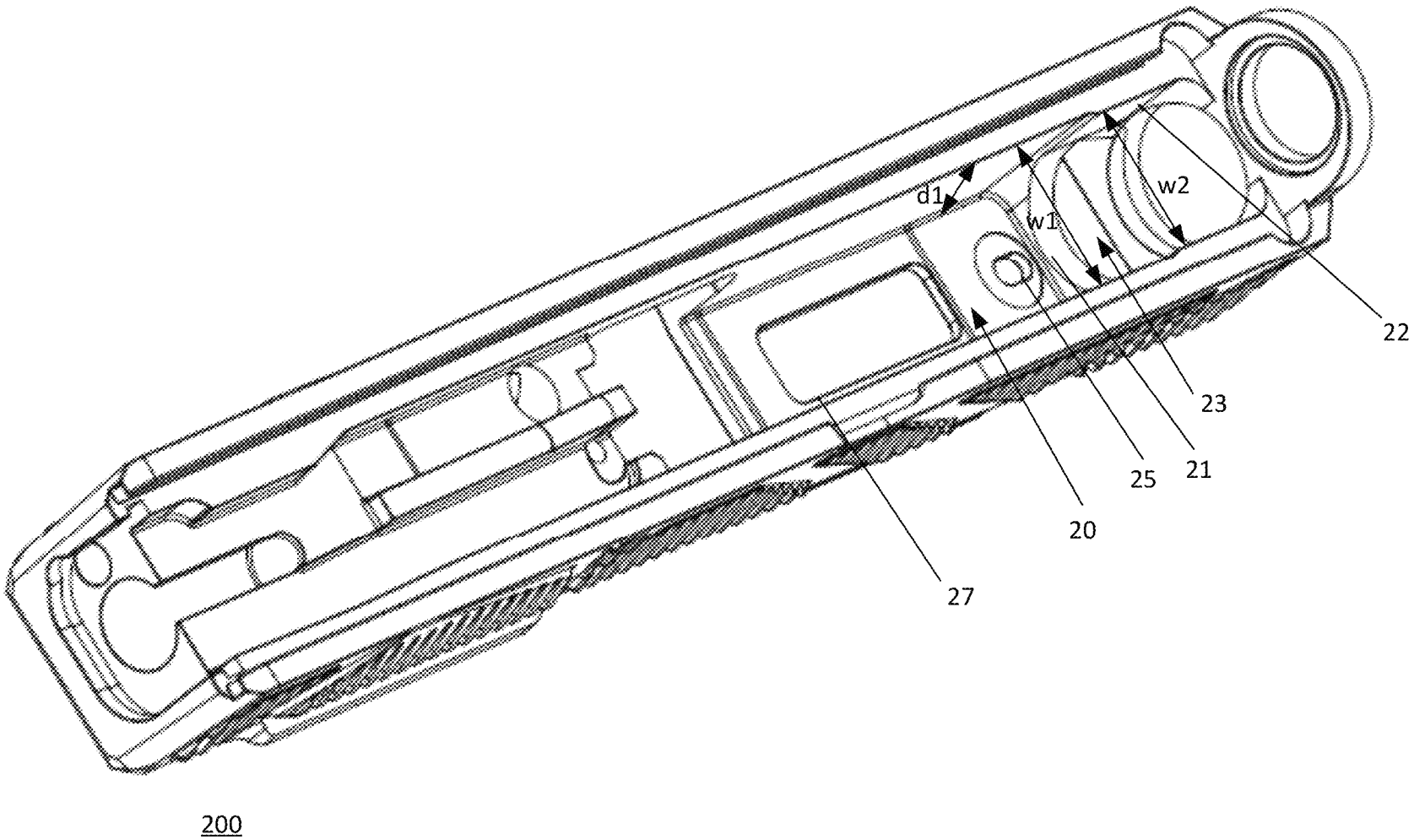
FIG. 2A illustrates a bottom view of a slide for a slide assembly to provide a firearm with gas compensation to reduce recoil.
Figure 2B:
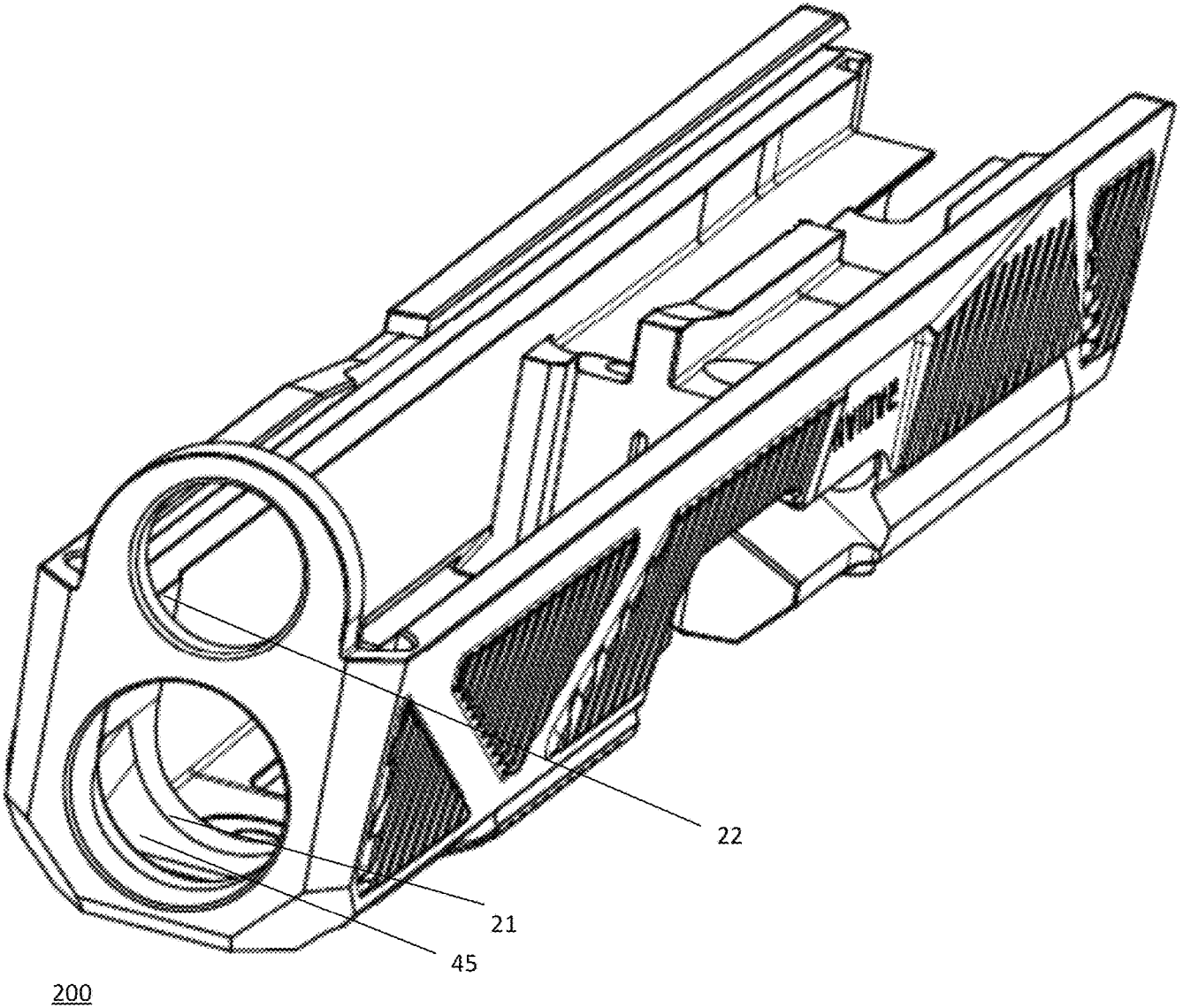
FIG. 2B illustrates a front view of the slide of FIG. 2A.

FIG. 2A illustrates a bottom view of a slide 200 for a slide assembly to provide a firearm with gas compensation to reduce recoil. FIG. 2B illustrates a front view of the slide 200.

The slide 200 may have the same compatibility as the slide 100 of FIG. 1. For instance, the slide 200 may be a retrofit for a firearm manufactured with the slide 100 of FIG. 1, in some examples (the slide 200 of course may also be an original part of a firearm, in other examples).

The interior of the top and sides of the slide 200 define an arch 21. A width (w2) of an interior of the arch 21 may be less than the width (w1). The same reference number w1 is used to indicate that the width behind the arch 21 may be the same as the width between the interior sides of the slide 100 of FIG. 1A. The width (w2) may correspond to a width of the bore length segment 4 (FIG. 1A).

Behind the arch 21 is a barrel hood channel 20 with the width (w1) and a depth (d1) corresponding to a height of the barrel hood 5 (FIG. 1A). The barrel hood channel 20 may receive the barrel hood through a range of motion of the slide 200 relative to the barrel responsive to a firing of the firearm. When the barrel is locked into the slide 200, a gap between the bore length segment of the barrel and the interior top and sides of the slide 200 in the barrel hood channel 20 may be the same as the gap with the bore length segment 4 and interior of the sides of the slide 100 (FIG. 1). In contrast, in a slide assembly using the slide 200, the gap between the bore length segment and the protrusions that define the interior sides and underside of the arch 21 may be less. In some embodiments, an underside of the arch 21 may be arranged to slidingly engage the upper region of the bore length segment in part of the range of motion (although this is not required). In some embodiments, the width (w2) may be at least the width of the bore length segment.

Figure 3:
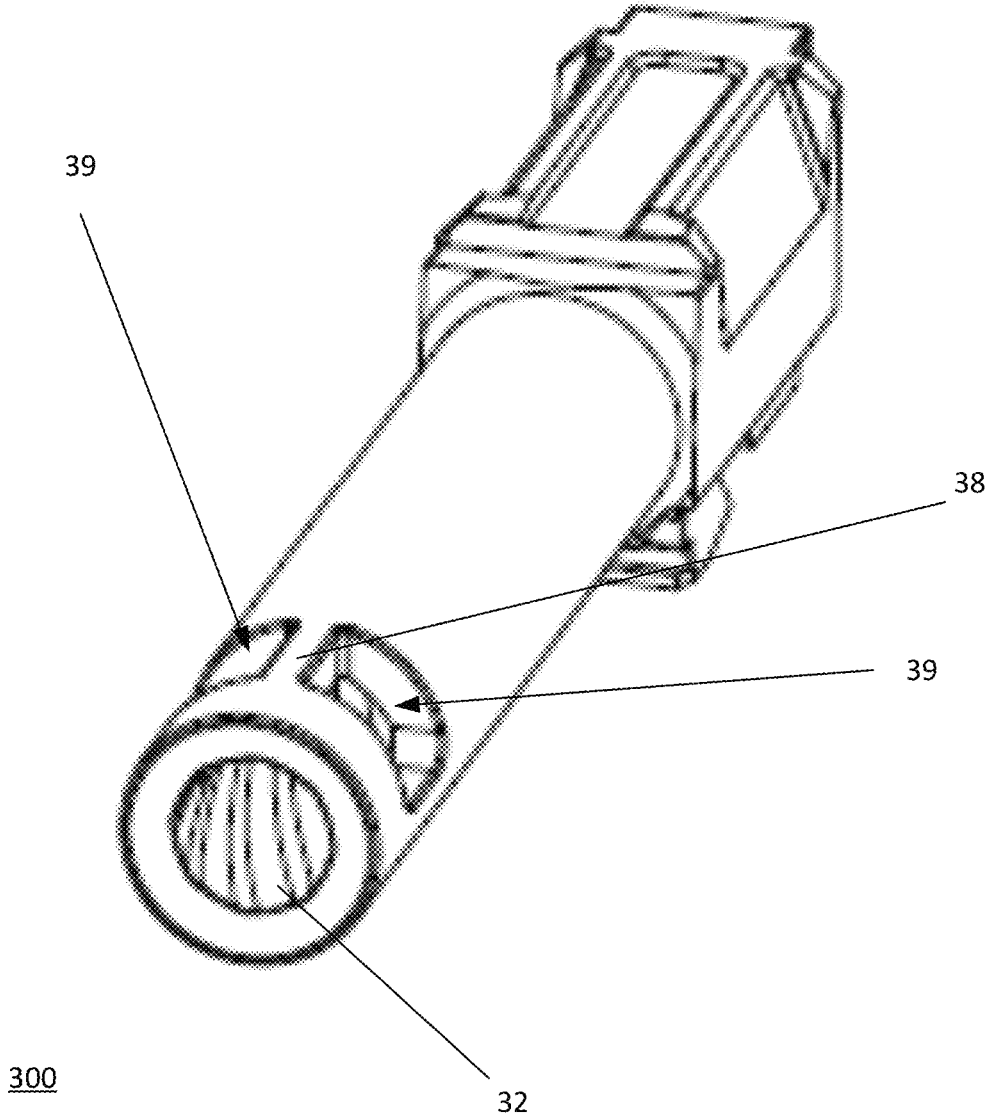
FIG. 3 illustrates a front view of a barrel operable with the slide of FIGS. 2A-B.

FIG. 3 illustrates a front view of a barrel 300 operable with the slide 200 of FIGS. 2A-B. An upper section of the barrel 300 (proximate to the muzzle 32) defines an egress 39 for gas propelled from the chamber of the firearm. In this example, a rib 38 is located between the openings. The egress 39 may be formed by removing material from a barrel similar to the barrel 105 (FIG. 1A).

Referring again to FIGS. 2A-B, the slide 200 may define an opening 23 in front of the arch 21 to expose the egress 39 (FIG. 3). In this embodiment, the opening 23 is a single contiguous opening; however, this is not required. Also, in this embodiment, the opening 23 is defined by protrusions on both the top and sides of the slide 200; however, this is not required. In other embodiments, the opening 23 may be defined by protrusions on the top and/or sides of the slide 200.

In this embodiment, protrusions 22 defined by the interior of the sides of the slide 200 may be located in front of the arch 21. The distance between surfaces of the protrusions 22 may be the same as the distance w2.

The slide 200 may include a sight mount opening 25 behind the arch 21. In this embodiment, the slide 200 also includes a window 27 located behind the arch 21 (the window 27 may facilitate cooling of the barrel 300; however, other embodiments may omit the window 27).

Referring again to FIG. 3, removing material from the egress 39 may be selective to form a rib 38 between separate bore openings of the egress 39. The exterior of the rib 38 is arranged to engage the underside of the arch 21 (FIG. 2A) following firing. This engagement prevents the underside of the arch 21 from catching on the egress 39. By selectively removing material from the egress 39 to leave the rib 38, the size of the egress 39 may be optimized to extend across substantially all of an upper half of a front section of the bore length segment of the barrel 300.

Figure 4A:
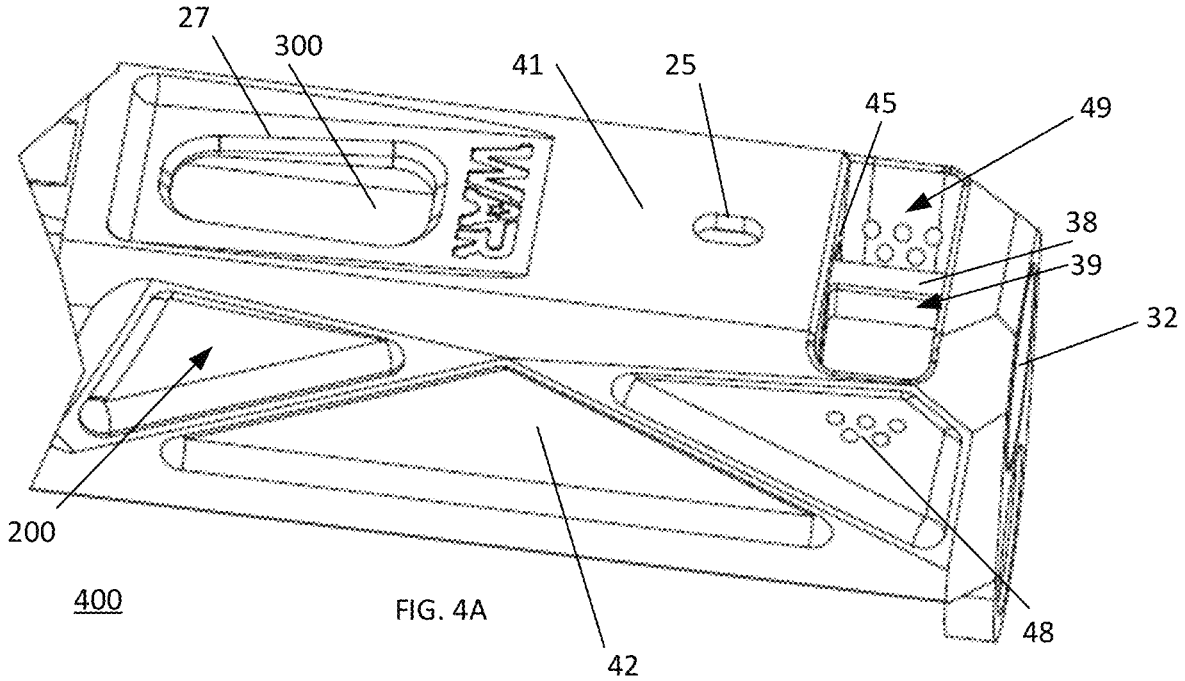
FIG. 4A illustrates a partial side view of firearm having slide assembly including the slide illustrated in FIGS. 2A-B and the barrel illustrated in FIG. 3.
Figure 4B:
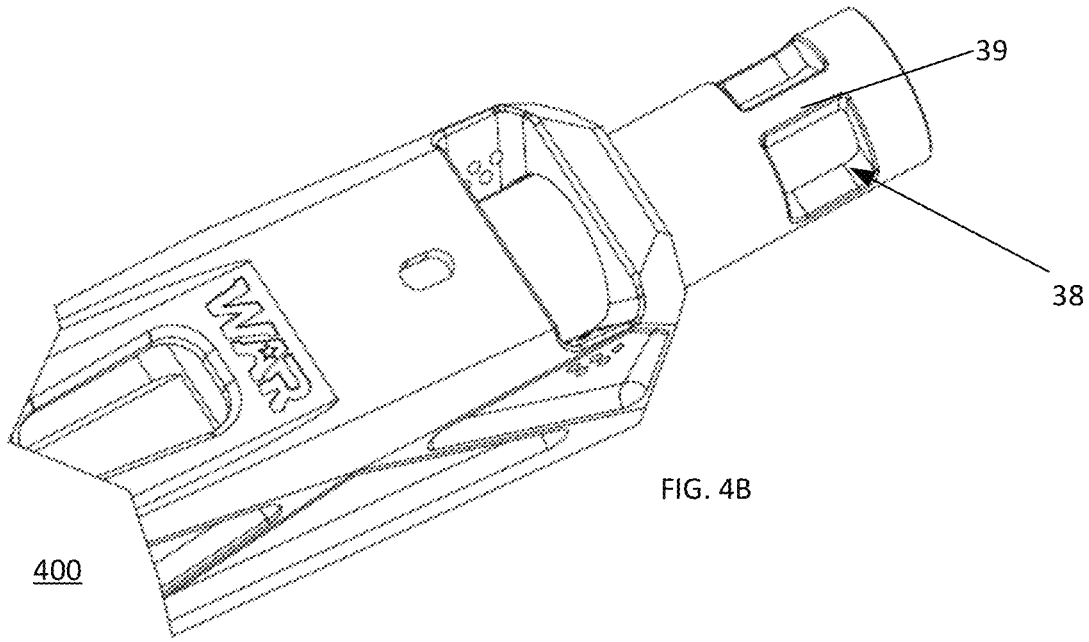
FIG. 4B illustrates a partial side view of firearm of FIG. 4A in which the slide is retracted.

FIG. 4A illustrates a partial side view of firearm having slide assembly 400 including the slide 200 illustrated in FIGS. 2A-B and the barrel 300 illustrated in FIG. 3. FIG. 4B illustrates a partial side view of firearm of FIG. 4A in which the slide 200 is retracted.

This embodiment includes a gas port 49 formed by the egress 39 of the barrel 300, a front surface 45 of the arch 21 (FIGS. 2A-B), the protrusions 22 (FIGS. 2A-B), an interior of a front of the slide 200, and the opening 23 (FIGS. 2A-B).

In particular, sides of the gas port 49 may include a surface of sides of the egress 39, the front surface 45 of the arch 21, a surface of the protrusions 22, a surface of the interior of the front of the slide 200, and a surface of sides of the opening 23. In other embodiments, a barrel gas port may be located a distance from one or more of the front surface 45 (the arch 21 may be located a distance behind the barrel gas port), a distance from surfaces of the interior of the sides of the slide (these surfaces may or may not include the protrusion 22), a distance from a surface of the interior of the front of the slide, and/or a distance from a surface of sides of opening(s) in the slide.

In this embodiment, a group 48 of holes is located on the sides 42 of the slide (only one of the sides 42 is shown in this view). Each hole may include a first end on the exterior surface of the sides 42 and a second end on a side of the gas port 49. The group 48 of holes may be omitted in other embodiments.

A transition edge between the top 41 and sides 42 of the slide 200 may be sloped (e.g., a beveled edge). A portion of a perimeter of the opening 23 (FIGS. 2A-B) in the slide 200 may be located on this sloped edge, as in the illustrated embodiment; however, this is not required.

Figure 5A:
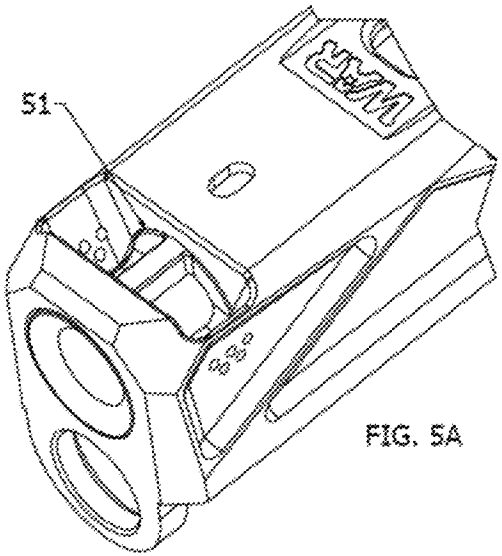
FIG. 5A illustrates a perspective view of a muzzle end of a slide assembly having a gas port formed from an egress in a barrel, a front surface of an arch on the underside of the slide, an opening in the slide, and an interior of a front end of the slide.

FIG. 5A illustrates a perspective view of a muzzle end of a slide assembly having a gas port formed from an egress in a barrel, a front surface of an arch on the interior of the slide, an opening in the slide, and an interior of a front end of the slide. In this embodiment, the back 51 of the gas port is a continuous face defined by a front surface of an arch and a back of the barrel egress (the arch may be similar in any respect to the arch 21 of FIGS. 2A-B).

Figure 5C:
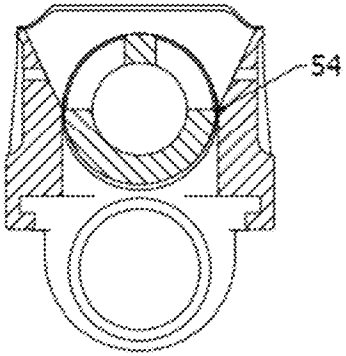
FIG. 5C illustrates a cross-sectional view of the slide of the slide assembly of FIG. 5A taken across a width of the slide assembly.
Figure 5B:
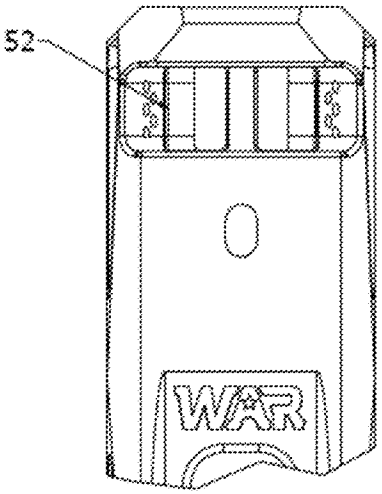
FIG. 5B illustrates a top view of the slide assembly of FIG. 5A.

FIG. 5B illustrates a top view of the slide assembly of FIG. 5A. The sides 52 of the gas port is a continuous face defined by protrusions on an interior of the slide (the protrusions may be similar in any respect to protrusions 22 of FIGS. 2A-B) and extending to meet up with the bottom edge of the barrel egress of the barrel.

FIG. 5C illustrates a cross-sectional view of the slide assembly of FIG. 5A taken across a width of the slide assembly. In this view, the alignment 54 of the barrel egress to a slide opening geometry is shown.

Figure 5D:
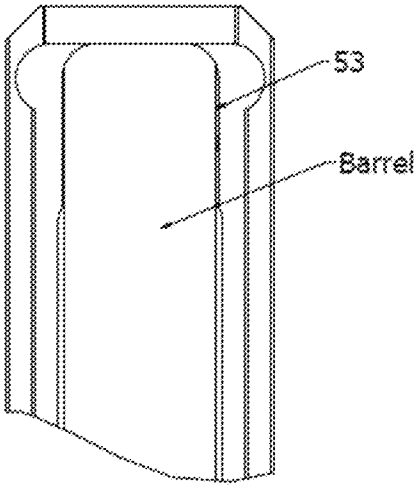
FIG. 5D illustrates a bottom view of the slide assembly.

FIG. 5D illustrates a bottom view of the slide assembly. The protrusions on the interior surface of the sides of the slide may sealingly engage 53 the barrel.

Figure 5E:
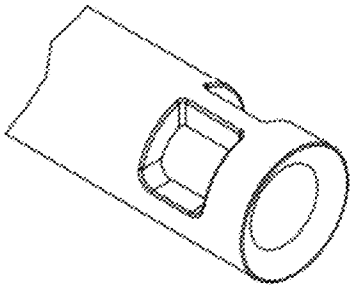
FIG. 5E illustrates a partial side view of the barrel of the slide assembly of FIG. 5A.

FIG. 5E illustrates the barrel of the slide assembly of FIG. 5A. This barrel may be similar in any respect to barrel 300 of FIG. 3. This barrel optionally includes scalloping, which may be visible through a window similar to window 27 (FIG. 2A).

Figure 6E:
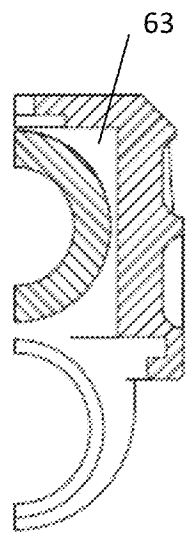
FIG. 6E illustrates a cross-sectional view taken along line AK of FIG. 5A.
Figure 6D:
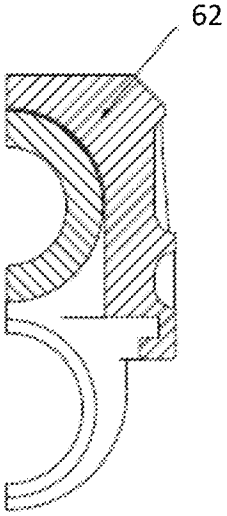
FIG. 6D illustrates a cross-sectional view taken along line AD of FIG. 5A.
Figure 6C:
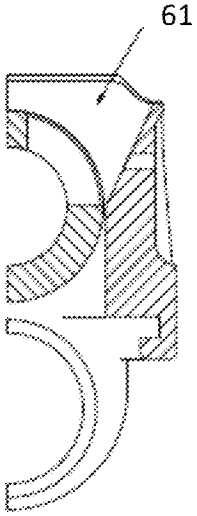
FIG. 6C illustrates a cross-sectional view taken along line AC of FIG. 5A.
Figure 6B:
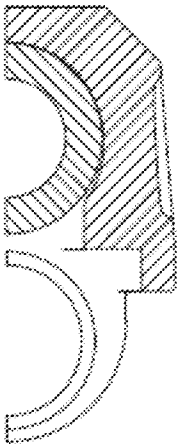
FIG. 6B illustrates a cross-sectional view taken along line AL of FIG. 5A.
Figure 6A:
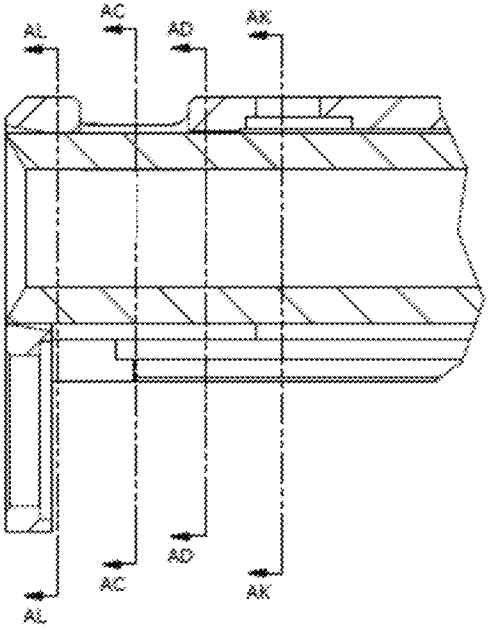
FIG. 6A illustrates a cross-sectional view of a muzzle end of the slide assembly of FIG. 5A taken across a length of the slide assembly.

FIG. 6A illustrates a cross-sectional view of a muzzle end of the slide assembly of FIG. 5A taken across a length of the slide assembly. FIG. 6B illustrates a cross-sectional view taken along line AL of FIG. 6A. FIG. 6C illustrates a cross-sectional view taken along line AC of FIG. 6A. A gas port 61 formed by an egress in a barrel and an opening in a slide is shown (this gas port may be similar in any respect to any gas port described herein).

FIG. 6D illustrates a cross-sectional view taken along line AD of FIG. 6A. Behind the gas port 61 (FIG. 6C), material 62 of protrusions on an interior of the top and sides of the slide extend toward the barrel. This material 62 may be material of an arch similar to arch 21 of FIG. 2A. FIG. 6E illustrates a cross-sectional view taken along line AK of FIG. 6A. A barrel hood channel 63 is shown in this view.

Figure 16A:
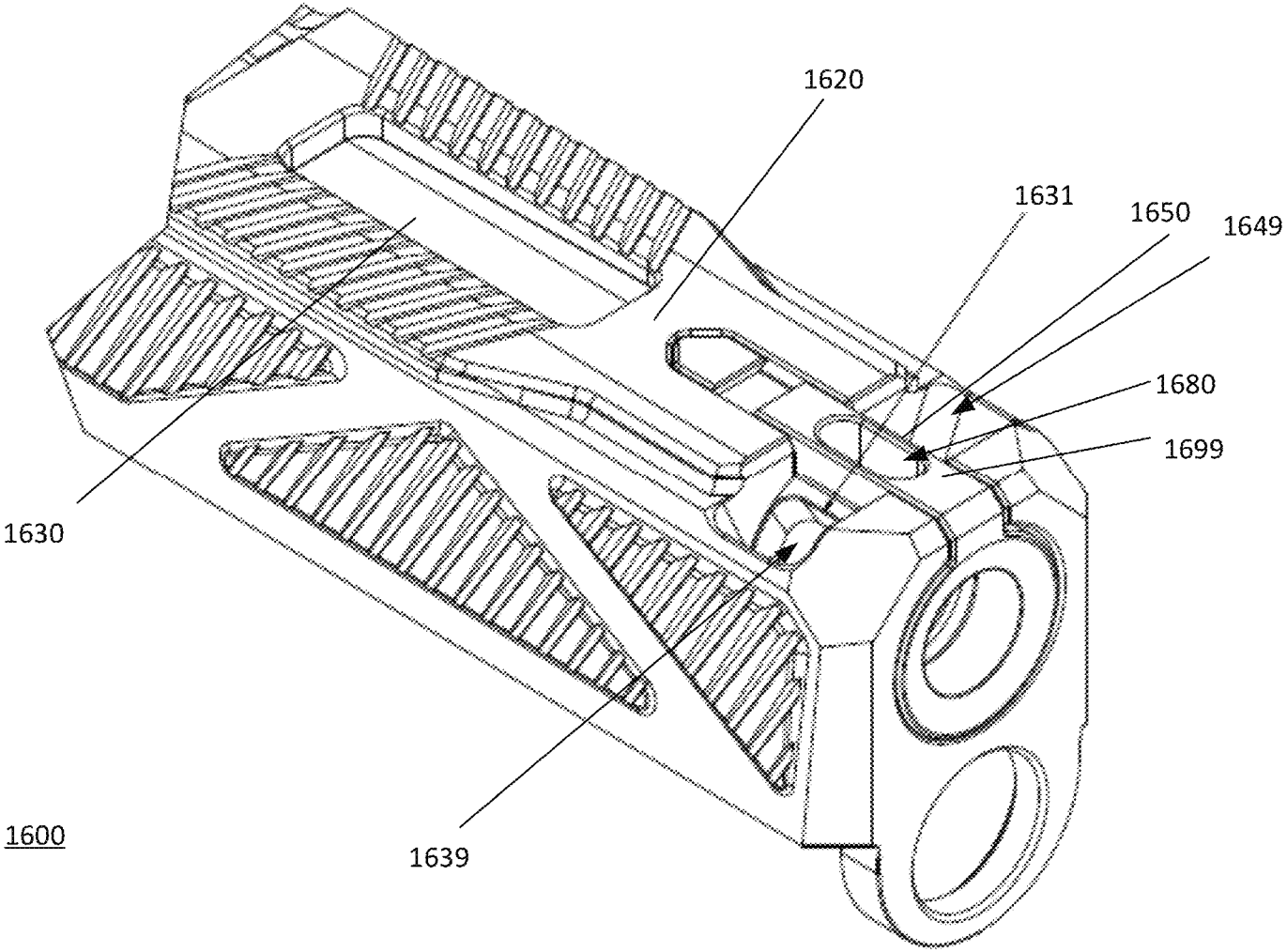
FIGS. 16A-B illustrate partial side views of another embodiment of a slide assembly to provide a firearm with gas compensation to reduce recoil in which the barrel includes a sight tracker.
Figure 16B:
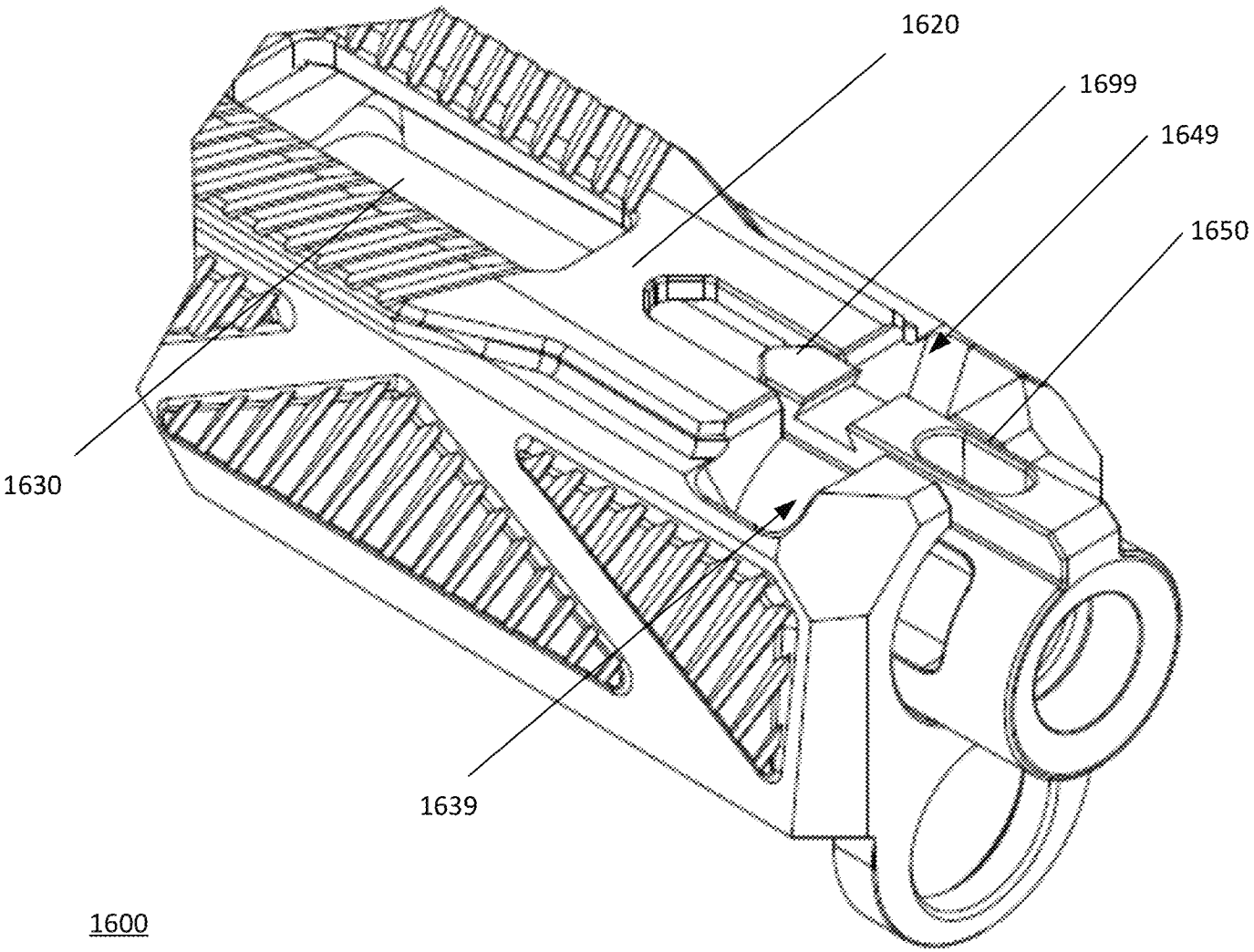

FIGS. 16A-B illustrate a partial side view of another embodiment of a slide assembly 1600 to provide a firearm with gas compensation to reduce recoil in which the barrel 1630 includes a sight tracker 1699. The barrel 1630 is locked with the slide 1620 in the partial side view of FIG. 16A. The partial side view of FIG. 16B shows a state following firing once the slide 1620 has moved relative to the barrel 1630.

Referring again to FIG. 16A, the slide 1620 may be similar to slide 200 (FIG. 2A) in any respect. The barrel 1630 may be similar to barrel 300 (FIG. 3) in any respect. The gas port 1649 may be similar to gas port 49 (FIG. 4A) in any respect. The sight tracker 1699 includes a rib section 1650. In this embodiment of the sight tracker 1699, the sight tracker 1699 defines an additional gas port 1680 (cut through a center of the rib section 1650 and exposing an egress at an uppermost part of the barrel).

As shown in FIG. 16B, a top surface of sight tracker 1699 may protrude from the slide 1620 at least following a firing of the firearm (when the front of the barrel 1630 may rise with respect to the slide 1620). Using the sight tracker 1699, and due to the recoil reduction provided by the gas port 1649, a user may continue tracking a target more easily from one round to the next than in the same firearm without the firearm assembly 1600.

Figure 16C:
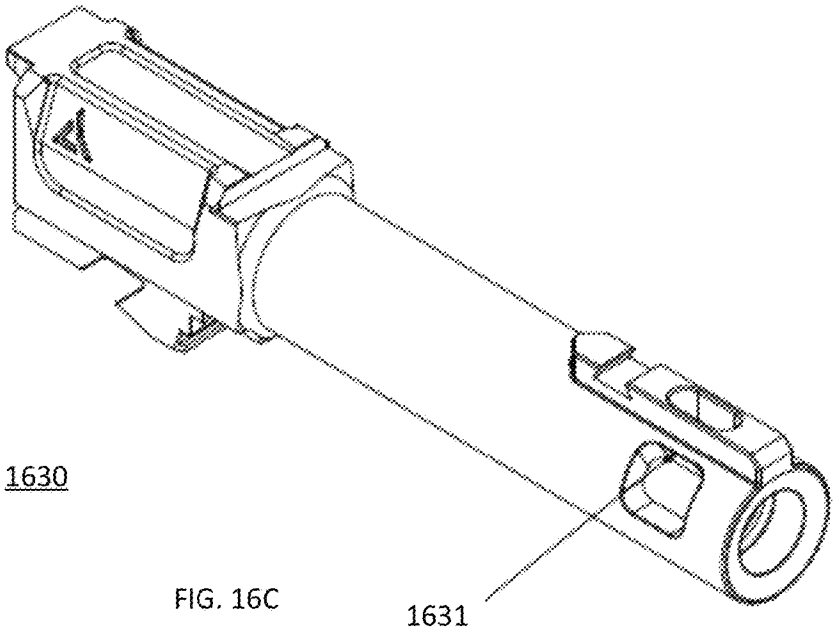
FIGS. 16C-D illustrate perspective and side views (respectively) of the barrel of the slide assembly of FIGS. 16A-B.
Figure 16D:
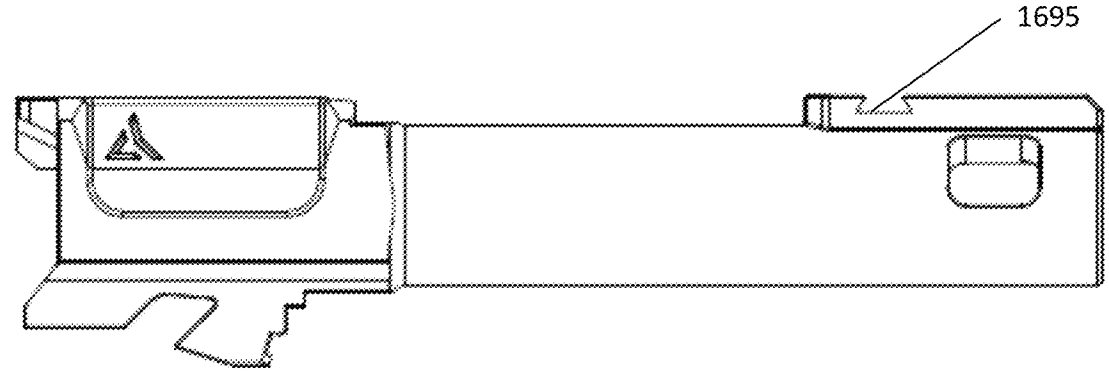

In this embodiment, an arc segment 1631 (FIG. 16A) of the barrel is located between an edge of the egress 1639 and the sight tracker 1699. FIGS. 16C-D illustrate perspective and side views (respectively) of the barrel 1630. The arc segment 1631 is shown in detail in FIG. 16C. In contrast to the sight opening 5 (FIG. 1A) which is in the slide 100, this front sight mount 1695 is part of the barrel. In this embodiment, the front sight mount 1695 is a dovetail groove, but other embodiments may utilize some other channel (or some other structure to mate with a bottom of a front sight). In other embodiments, a front sight and the barrel may be a unitary structure.

Barrel Interior

An egress on a barrel may be deburred to clear a path for the bullet. Also, to prevent stripping material from the bullet, some of the rifling inside the barrel near the muzzle may be removed (which may reduce stripping of the bullet as it passes the egress). Essentially, the muzzle end of the bore may be bored out by a tool inserted into the muzzle end of the barrel to remove rifling of the muzzle end of the bore to reduce or prevent bullet stripping. In one embodiment, the barrel is bored from the muzzle end of the barrel to behind the rear-most edge of the egress 39, e.g., about half a millimeter behind the rear-most edge, to prevent bullet striping. However, this is not required—in other embodiments rifling may be removed from the muzzle end of the barrel to a location corresponding with a front-most edge of the egress 39. However, other approaches are described below, and these approaches may eliminate bullet stripping without requiring removal of the rifling between the muzzle end of the barrel and the location corresponding with either edge of the egress 39.

Figure 7A:
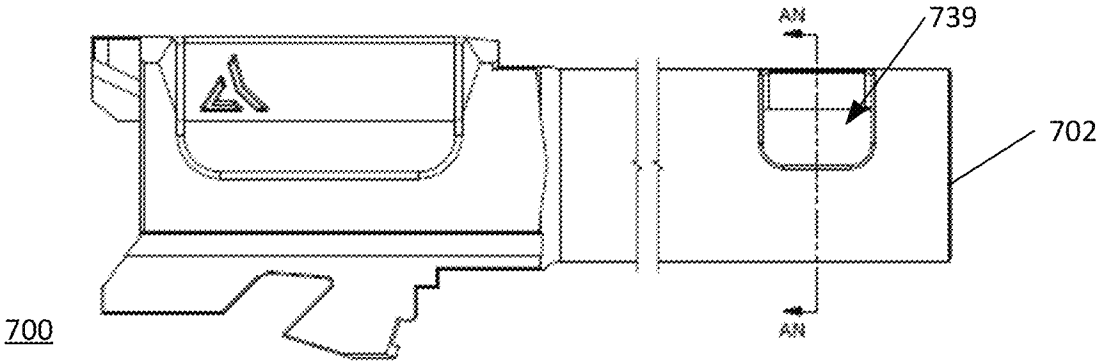
FIG. 7A illustrates a side view of a barrel in which rifling may be preserved between the muzzle end of the barrel and a location coinciding with a front-most edge of the egress.

FIG. 7A illustrates a side view of a barrel 700 in which rifling may be preserved between the muzzle end 702 of the barrel and a location coinciding with a front-most edge of the egress 739. The barrel 700 may be similar in any respect to the barrel described with reference to FIG. 3, or any other barrel described herein.

Figure 7C:
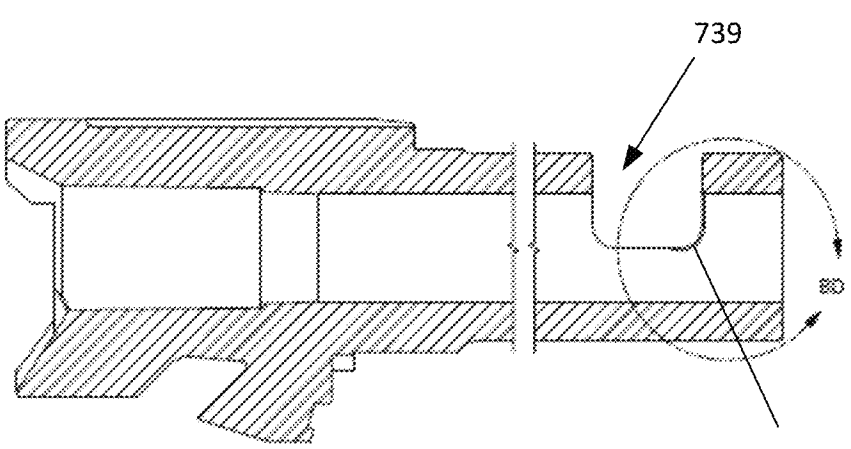
FIG. 7C illustrates a cross-sectional view taken along line BA of FIG. 7B.
Figure 7D:
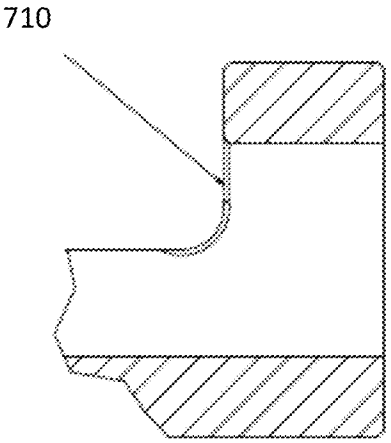
FIG. 7D illustrates a detailed view of the chamfer on a front-most bore edge of the egress.
Figure 7B:
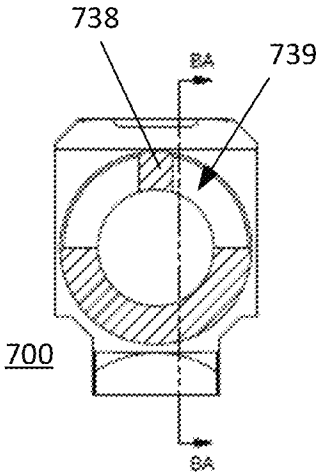
FIG. 7B illustrates a cross-sectional view taken across a width of the barrel of FIG. 7A.

FIG. 7B illustrates a cross-sectional view taken across a width of the barrel 700 of FIG. 7A. In this example, the egress 739 spans a distance from a middle of the side of the barrel to an edge of the rib 738 at the top of the barrel 700. The rifling on the inside of the rib 738 may assist in imparting rotation to the bullet.

FIG. 7C illustrates a cross-sectional view taken along line BA of FIG. 7B. In this view, the chamfer 710 on the bore-edge of the egress 739 is visible. FIG. 7D illustrates a detailed view of the chamfer 710 on a front-most bore-edge of the egress. This chamfer 710 may be provided on an entire front-most bore edge of the egress 739. Other edges may include chamfers, although chamfers are not required on the entirety of the other edges to prevent bullet stripping. The chamfer 710 may be formed by removing material from the egress 739, and then cutting the chamfer 710 on the front-most edge of the egress 739.

Figure 8A:
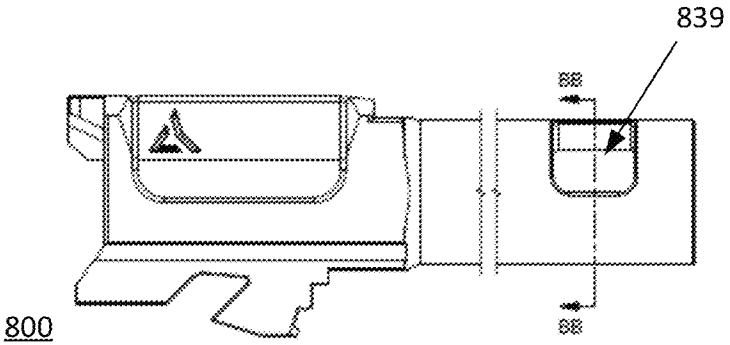
FIG. 8A illustrates a side view of another barrel in which rifling may be preserved between the muzzle end of the barrel and a location coinciding with a front-most edge of the egress.
Figure 8C:
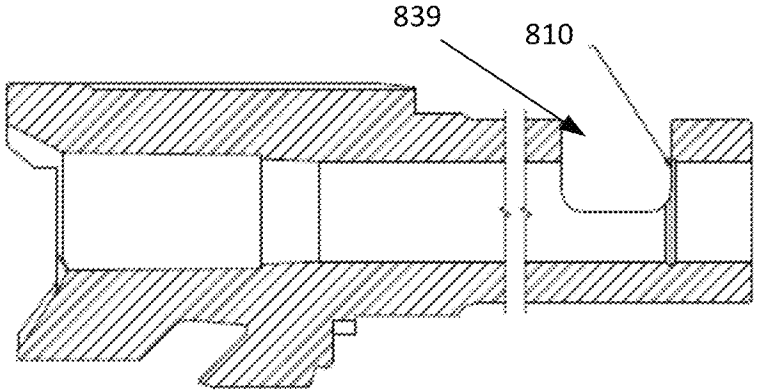
FIG. 8C illustrates a cross-sectional view taken along line BC of FIG. 8B.
Figure 8B:
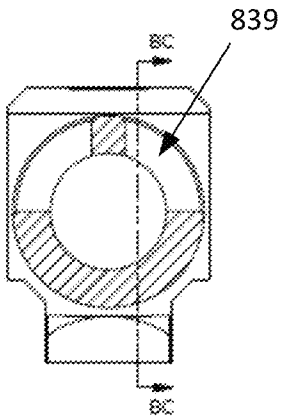
FIG. 8B illustrates a cross-sectional view taken across a width of the barrel of FIG. 8A.

FIG. 8A illustrates a side view of another barrel in which rifling may be preserved between the muzzle end of the barrel and a location coinciding with a rear-most or front-most edge of the egress. FIG. 8B illustrates a cross-sectional view taken across a width of the barrel of FIG. 8A. FIG. 8C illustrates a cross-sectional view taken along line BC of FIG. 8B. In this view, the circumferential groove 810 can be seen. The circumferential groove 810 may have sloped sides (e.g., a V-shaped groove) in which the circumferential groove 810 is centered on the front-most edge of the egress 839 (in other examples, the circumferential groove 810 may be centered on the rear-most edge of the egress 839). In some embodiments, circumferential grooves may be centered on the front-most edge of the egress 839 and the rear-most edge of the egress 839, respectively.

Figure 9A:
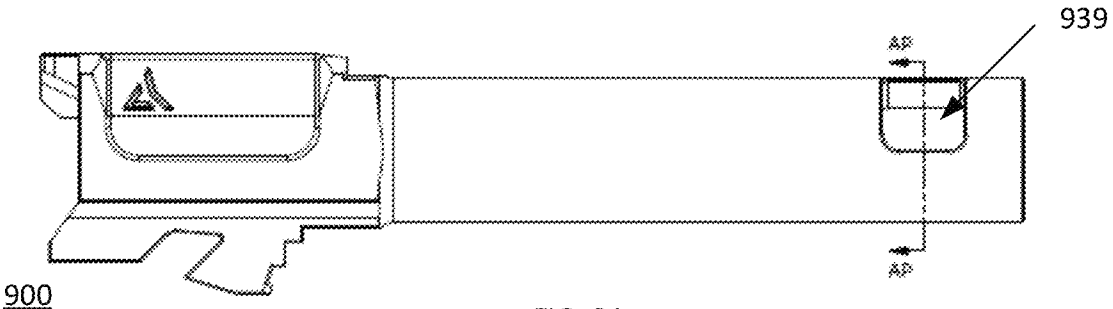
FIG. 9A illustrates a side view of yet another barrel in which rifling may be preserved between the muzzle end of the barrel and a location coinciding with a front-most edge of the egress.
Figure 9C:
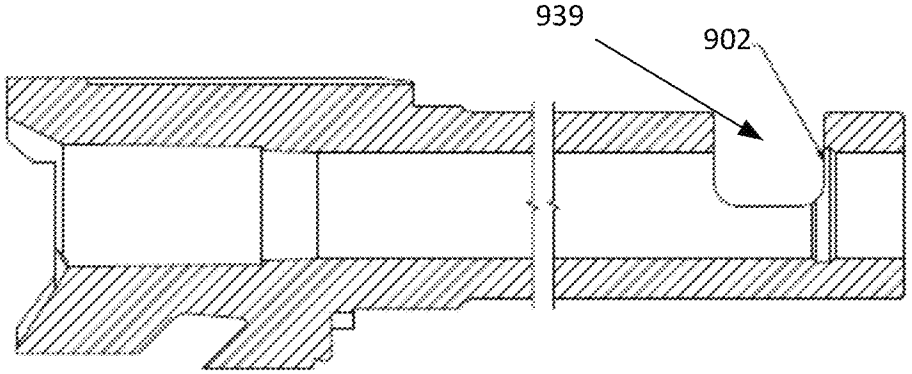
FIG. 9C illustrates a cross-sectional view taken along line AY of FIG. 9B.
Figure 9B:
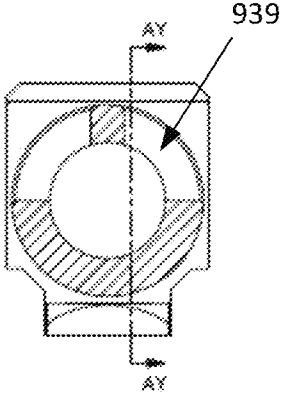
FIG. 9B illustrates a cross-sectional view taken across a width of the barrel of FIG. 9A.

FIG. 9A illustrates a side view of yet another barrel in which rifling may be preserved between the muzzle end of the barrel and a location coinciding with a rear-most or front-most edge of the egress. FIG. 9B illustrates a cross-sectional view taken across a width of the barrel of FIG. 9A. FIG. 9C illustrates a cross-sectional view taken along line AY of FIG. 9B. In this view, the circumferential groove 910 can be seen. The circumferential groove 910 may have sloped sides (e.g., sides similar to circumferential groove 810 of FIG. 8C) and additionally may have a bottom width between bottoms of the sides.

In one example, the bottom width may be a flat bottom, although this is not required. The circumferential groove 910 need not necessarily be centered on the front-most or rear-most bore-edge of the egress 939. This may improve manufacturing tolerances as compared to the chamfer 710 or the V-shaped circumferential groove. The front-most or rear-most edge of the egress may coincide with any portion of the bottom width.

Alignment System to Control Movement of a Barrel Relative to a Slide

Figure 10A:
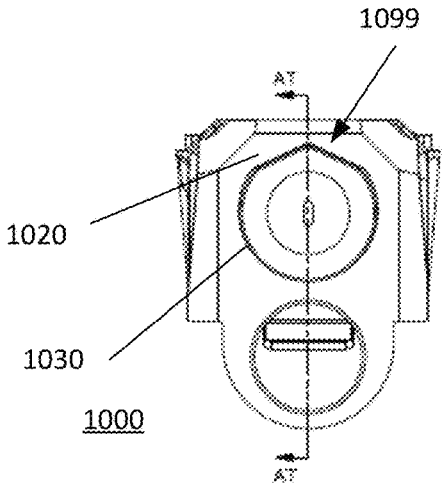
FIG. 10A illustrates a cross-sectional view taken across a width of a slide assembly with an alignment system to restrict movement of the muzzle end of the barrel within a plane perpendicular to a bore axis of the barrel and prevent rotational movement of the barrel relative to the slide.

FIG. 10A illustrates a cross-sectional view taken across a width of a slide assembly 1000 with an alignment system 1099 to restrict movement of the muzzle end of the barrel 1030 within a plane perpendicular to a bore axis of the barrel 1030 and prevent rotational movement of the barrel 1030 relative to the slide 1020. The bore axis is the center of a bore extending from a start of the bore to the muzzle end of the bore (in this view, the bore axis is at a center of the bore of the barrel 1030 going into the page, and the plane coincides with the page).

The alignment system 1099 includes a groove or protrusion located on the bore length segment of the barrel 1030. This groove or protrusion mates with a protrusion or groove defined by an interior surface of the slide. In this embodiment, the bore length segment of the barrel 1030 is non-cylindrical, and the alignment system 1099 includes a protrusion on a top of the barrel 1030 (e.g., the pointed top of the non-cylindrical bore length segment). In this embodiment, the protrusion mates with a groove defined by an underside of a top of the slide 1020. The alignment system 1099 reduces lateral movement of the muzzle end of the barrel 1030 within the plane (e.g., prevents movement of the barrel to the left or right).

Figure 10B:
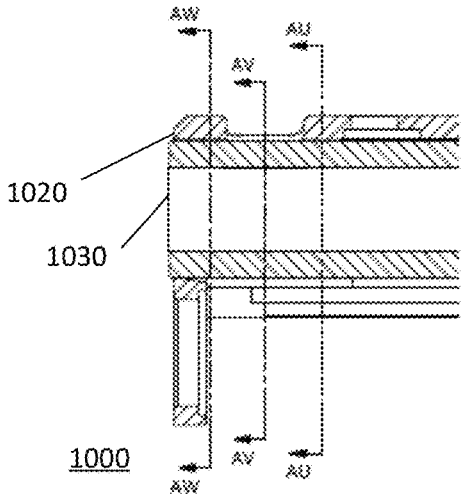
FIG. 10B illustrates a cross-sectional view taken across a width of the slide assembly of FIG. 10A.
Figure 10C:
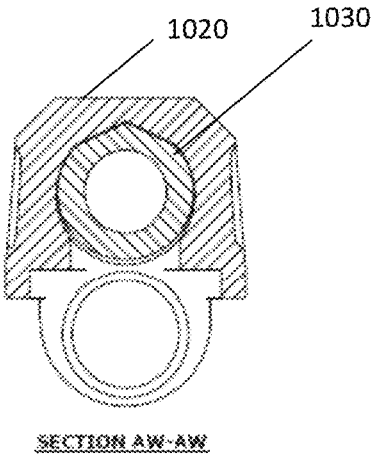
FIG. 10C illustrates a cross-sectional view taken along line AW of FIG. 10B.
Figure 10D:
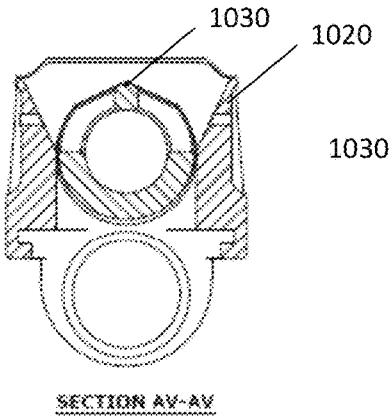
FIG. 10D illustrates a cross-sectional view taken along line AV of FIG. 10B.
Figure 10E:
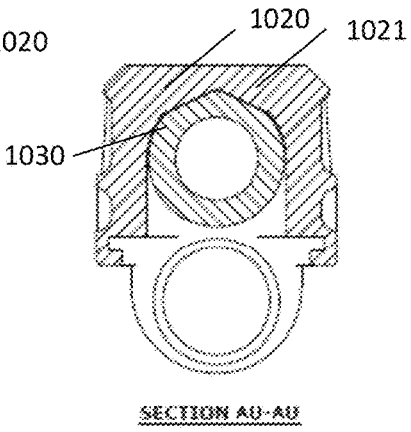
FIG. 10E illustrates a cross-sectional view taken along line AU of FIG. 10B.

FIG. 10B illustrates a cross-sectional view taken across a width of the slide assembly of FIG. 10A. FIG. 10C illustrates a cross-sectional view taken along line AW of FIG. 10B. FIG. 10D illustrates a cross-sectional view taken along line AV of FIG. 10B. FIG. 10E illustrates a cross-sectional view taken along line AU of FIG. 10B. FIGS. 10C-E illustrate that the slide assembly 1000 provides gas compensation to reduce recoil. In particular, an arch 1021 is shown in FIG. 10E, and this arch may be similar in any respect to arch 21 (FIG. 2A).

The arch 1021 includes a triangular shaped underside, in contrast to the rounded underside of the arch 21 (which does not include the alignment system 1099). Other examples including of slide assemblies to provide gas compensation to reduce recoil and with an alignment system may have differently shaped arches (for instance, it may be possible and practical to have a protrusion from an underside of the arch to mate with a groove formed on an upper section of a non-cylindrical barrel).

Also, some embodiments of a slide assembly that do not provide gas compensation to reduce recoil may utilize an alignment system similar to alignment system 1099. Such an embodiment may not include an arch similar to arch 21 (FIG. 2A) or arch 1021. However, an underside of the slide in such an embodiment may include the protrusion or groove on an underside of a front of the slide (e.g., a non-cylindrical opening in the front of the slide to receive a non-cylindrical bore length segment of a barrel). Accordingly, various embodiments of a slide assembly may include gas compensation and/or an alignment system.

Slide Assembly With Optic Mounting Platform

Pistols may be retrofitted with a red dot sight using an MOS (modular optic system) using a mount bracket located behind the ejection port. FIG. 1B illustrates a partial top view of a slide with an MOS (modular optic system) cover plate removed. The slide 150 may otherwise be similar to the slide 100 (FIG. 1A). FIG. 1C illustrates a bottom view of an MOS adapter plate 151 (the MOS adapter plate is an intermediary interface to couple to an optic adapter mounting interface—other optic adapter mounting interfaces exist). FIG. 1D illustrates a slide assembly 152 in which the MOS adapter plate 151 of FIG. 1C is installed on the slide of FIG. 1B.

FIG. 1E illustrates installation of a sealing plate 153 on the slide assembly 152 of FIG. 1D. The sealing plate 153 may be made out of thin sheet metal. The sealing plate 153 may have a width that is the same as a width of a bottom of an RMR optic 154 (FIG. 1F illustrates a bottom view of an RMR optic 154), both of which may be wider than the MOS adapter plate 151 (FIG. 1C). The sealing plate 153 forms a seal with a seal 156 to prevent moisture from reaching the battery 155. FIG. 1G illustrates the RMR optic 154 of FIG. 1F and the sealing plate 153 of FIG. 1E installed on the slide assembly of FIG. 1D.

Figure 11A:
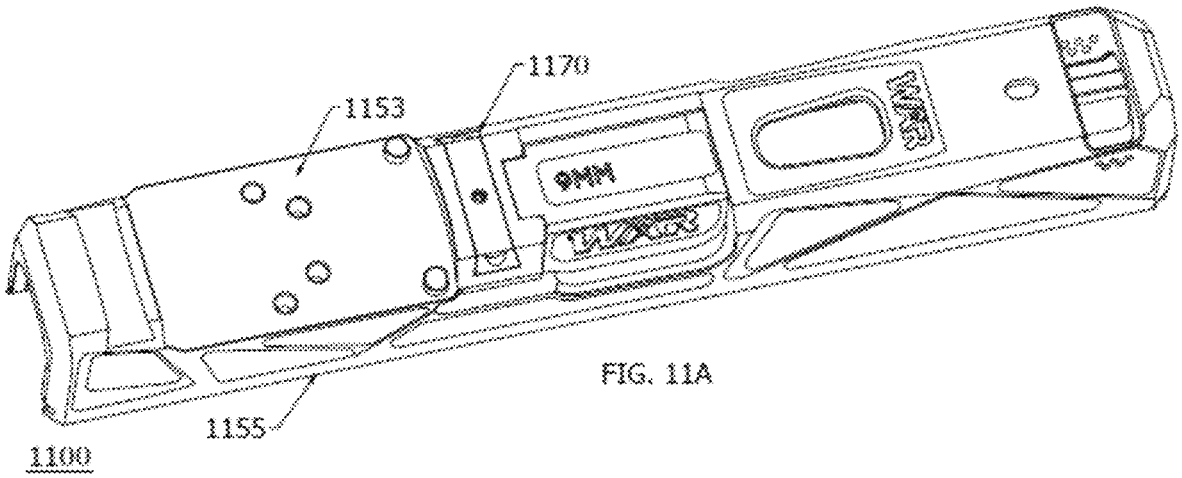
FIG. 11A illustrates a partial top view of a slide assembly including an optic mounting platform integrally formed on the top of the slide and a grip for charging the slide integrally formed from sides below the optic mounting platform.
Figure 11B:
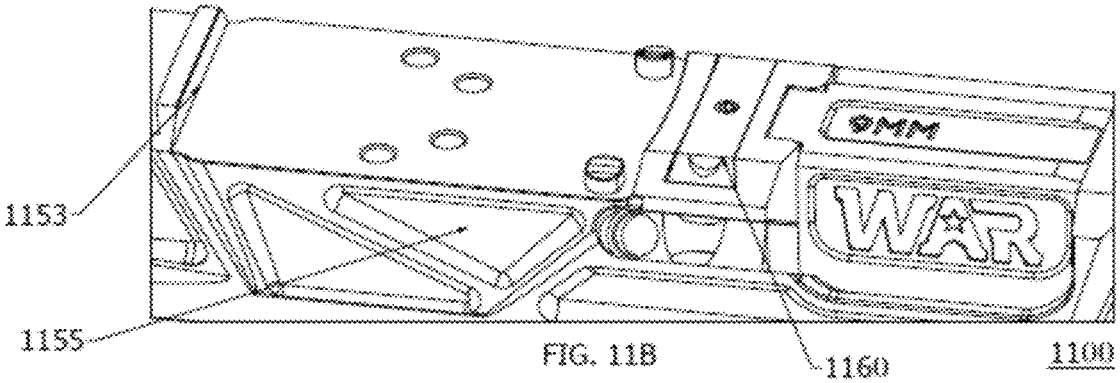
FIG. 11B illustrates a partial side view of the slide assembly of FIG. 11A.
Figure 11C:
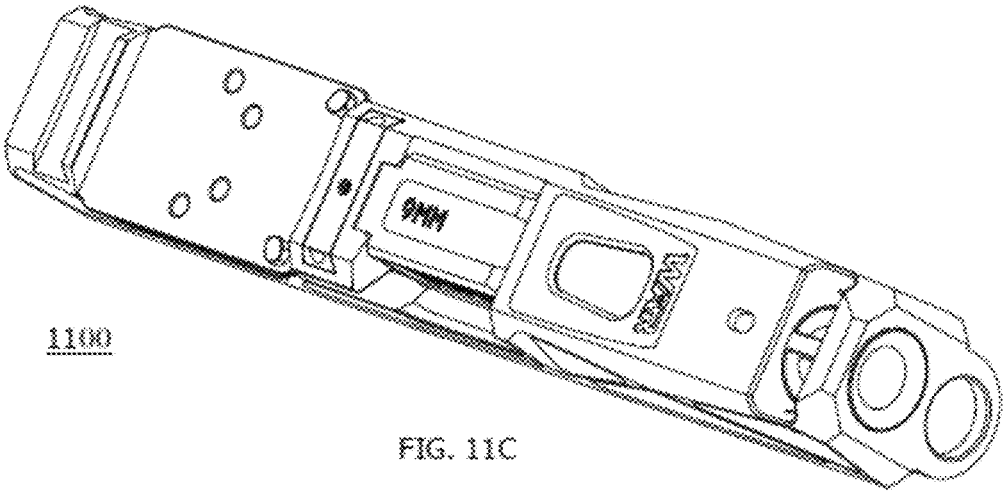
FIG. 11C illustrates the slide of FIGS. 11A-B being charged using the grip that is integrally formed from the sides below the optic mounting platform.

FIG. 11A illustrates top and side views of a slide 1100 including an optic mounting platform 1153 integrally formed on the top of the slide 1100 and a grip for charging the slide integrally formed from sides 1155 below the optic mounting platform 1153. FIG. 11B illustrates a partial side view of the slide 1100 of FIG. 11A. FIG. 11C illustrates the slide 1100 of FIGS. 11A-B being charged using the grip that is integrally formed from the sides 1155 below the optic mounting platform 1153.

Figure 13:
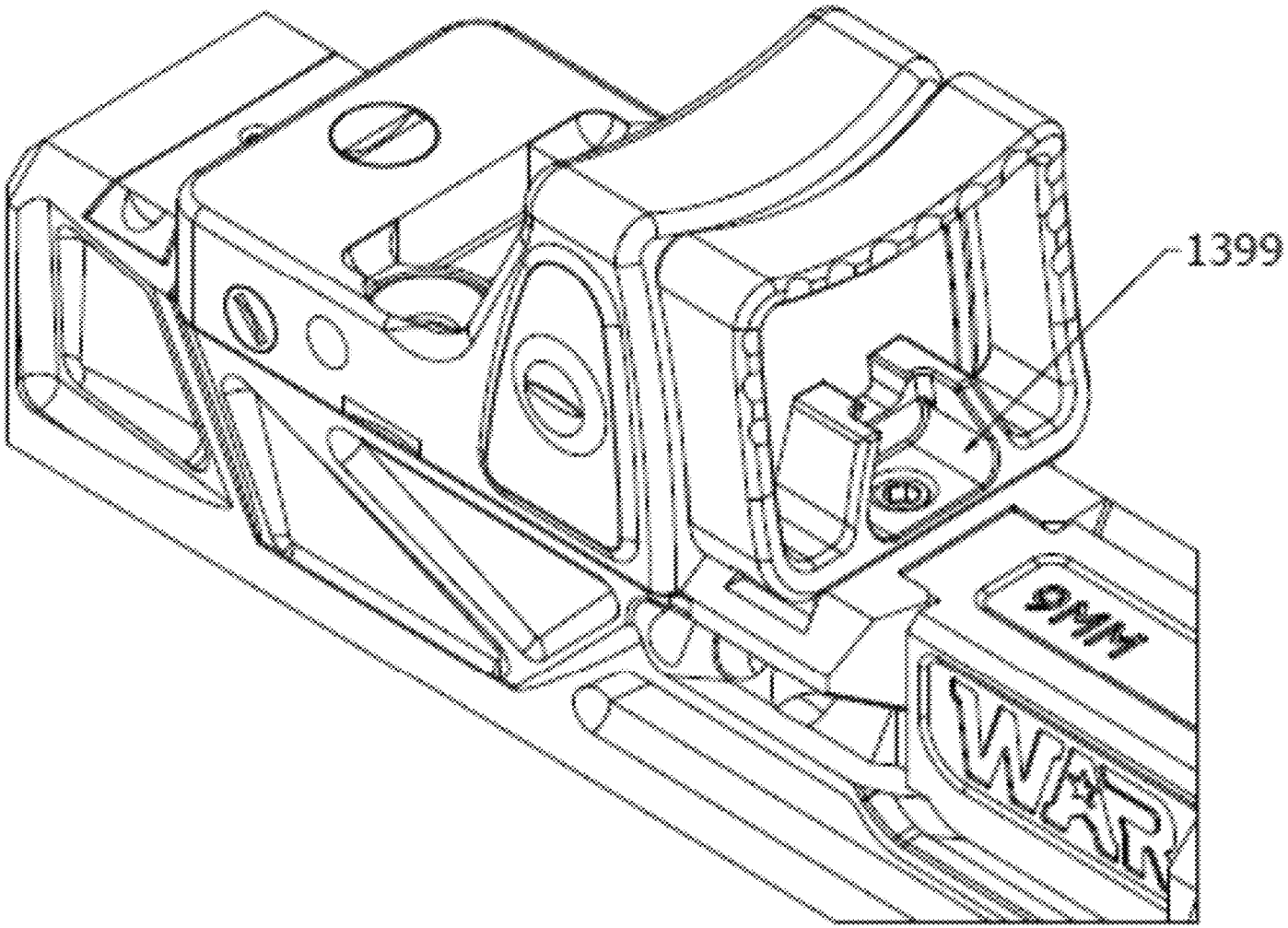
FIG. 13 illustrates a partial side view of an optic guard with an integrated rear sight.

Referring to FIG. 11A, in this embodiment, the width of the optic mounting platform 1153 corresponds to the width of the RMR optic 154 (FIG. 1F). FIG. 13 illustrates a partial side view of a slide assembly in which the RMR optic 154 illustrated in FIG. 1F is mounted directly on the slide 1100, and in which the sides of the RMR optic 154 align with sides of the optic mounting platform 1153. Other embodiments may be arranged for use with some other optic, and the sides of the optic mounting platform 1153 align with the sides of the optic.

Referring again to FIG. 11A, the RMR optic 154 may mount directly on the optic mounting platform 1153. The optic mounting platform 1153 includes a smooth surface to form a seal with the seal 156 (FIG. 11C) of the RMR optic 154 in the case of direct mounting. In some embodiments, a distance between a surface of the optic mounting platform 1153 and the top of the RMR optic 154 may be less than a distance between a top of the slide 150 (FIG. 1B) and the RMR optic 154, reducing the height of the firearm assembly.

In this embodiment, the optic mounting platform 1153 is a recess in a top of the slide 1100. In particular, material is removed from the top of the slide 1100 to form the surface of the optic mounting platform. In this embodiment, the surface of the optic mounting platform 1153 is lower than a top of the slide 1100 in front and/or behind the optic mounting platform 1153. As such, a distance between the surface of the optic mounting platform and the top of the RMR optic 154 may be less than a thickness of a stack including the MOS adapter plate 151 (FIG. 1C) and/or the sealing plate 153 (FIG. 1E). In other embodiments, the optic mounting platform 1153 may be formed using other techniques besides recessing a top of the slide. Whether or not recessing is used, in various embodiments the surface of the top of the optic mounting platform 1153 may be arranged to be no greater than surfaces of a top of the slide in front and/or behind the optic mounting platform 1153 (e.g., lower than or coplanar with the surfaces of the top of the slide in front and/or behind the optic mounting platform 1153).

The sides of the slide 150 (FIG. 1B) include scalloping to grip the vertical sides of the slide 150 to charge the slide 150. However, when the slide gets wet and/or if the user does not grip the slide optimally (say, due to an injury), the user's grip may slip before completely charging the slide.

Referring to FIG. 11A, the sides 1155 slope inward from an edge of the optic mounting platform 1153 to a lower location on the sides 1155. This provides an increasing width of the slide 1100 towards the optic mounting platform 1153). This increasing width gives the user leverage when gripping the slide 1100 to compensate for non-optimal conditions (e.g., wet equipment, or an injured hand).

In this embodiment, the inward slope is a continuous linear slope. In other embodiments, the sides 1155 may have a non-linear slope and/or may have varying slopes (for instance two or more slopes may be used to provide an angular surface). In various embodiments, the sides 1155 may have indentions (such as the scalloping of the slide 150 in FIG. 1B or some other indentation such as the triangular depression shown in FIG. 13) or bumps, as desired, to optimize the leverage associated with this grip point.

Figure 11D:
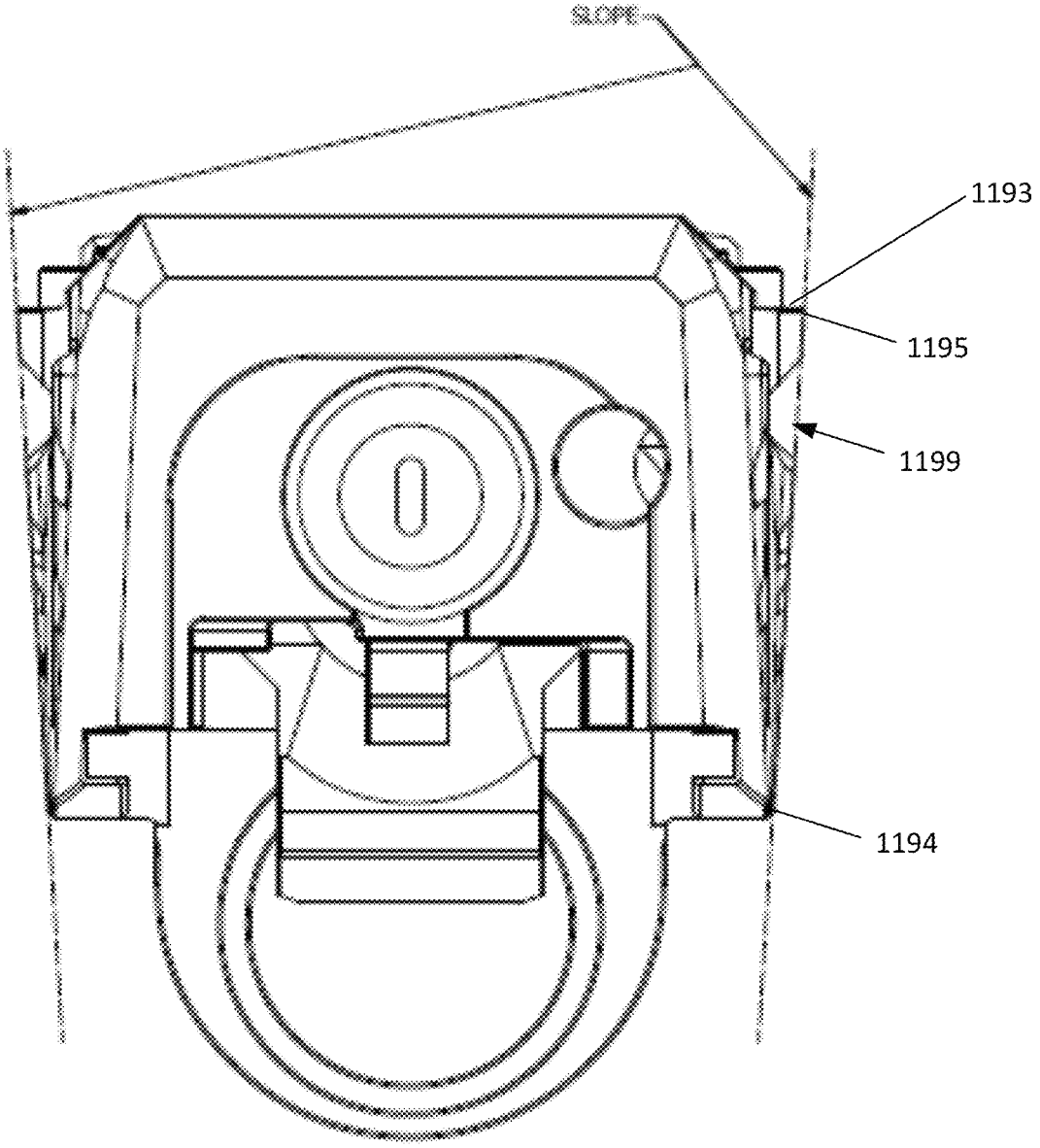
FIG. 11D illustrates a back view of a slide assembly in an embodiment in which the exterior sides of the slide are inward sloping from an upper location below the optic mounting platform to a lower location below the upper location.

FIG. 11D illustrates a back view of a slide assembly in an embodiment in which the exterior sides of the slide are inward sloping from an upper location 1195 below the optic mounting platform 1193 to a lower location below the upper location 1194. Optic mounting platform 1193 may be similar in any respect to optic mounting platform 1153 (FIG. 11A).

In this embodiment, a relief cavity 1199 is created by removing some material from a portion of the inward sloping exterior side. Other examples may not include the relief cavity 1199. Another embodiment may use a continuous non-linear slope. In yet other embodiments, the exterior sides may include varying slopes (linear slopes, non-linear slopes, or combinations thereof).

Figure 11E:
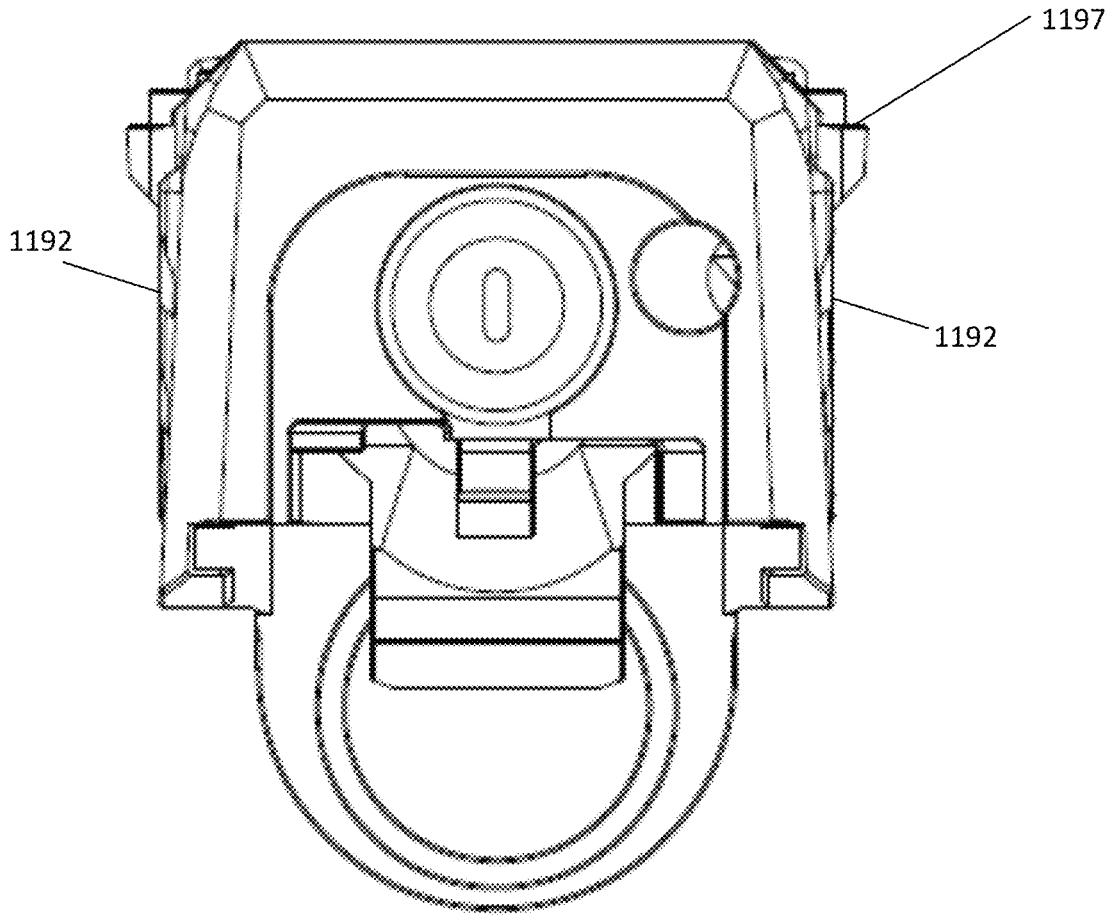
FIG. 11E illustrates a back view of a slide assembly in another embodiment including an optical mounting platform overhanging completely vertical exterior surfaces of sides of the slide.

FIG. 11E illustrates a back view of a slide assembly in another embodiment including an optical mounting platform 1197 overhanging fully vertical exterior surfaces 1192 of sides of the slide. The optical mounting platform 1197 may be similar to optical mounting platform 1193 (FIG. 11D) in any respect. In this embodiment, an upper portion of the exterior surface of the sides of the slide has two different inward slopes above the fully vertical exterior surface 1192. In other embodiments, there may be a single continuous slope above fully vertical exterior surfaces 1192 (and this single continuous slope may be linear or non-linear). In other embodiments, there may be no inward sloping (e.g., the side section above fully vertical exterior surfaces 1192 may include only one or more fully horizontal sections and one or more fully vertical sections, e.g., one or more "steps").

Optic Guard

Referring again to FIG. 11A, this embodiment of the slide 1100 includes an optic guard mount 1170 in front of the optic mounting platform 1153. In this embodiment, the optic guard platform 1153 is integrally formed with the slide 1100 (e.g., integrally formed with the top and/or sides 1155 of the slide 1100). In this embodiment, the optic guard mount 1170 is a channel (e.g., a dovetail groove). A plug 1160 is shown installed in the dovetail groove in FIG. 11B. In other embodiments, an optic guard mount similar to optic guard mount 1170 may be provided in a firearm assembly that may or may not include the optic mounting platform 1153.

Figure 12:
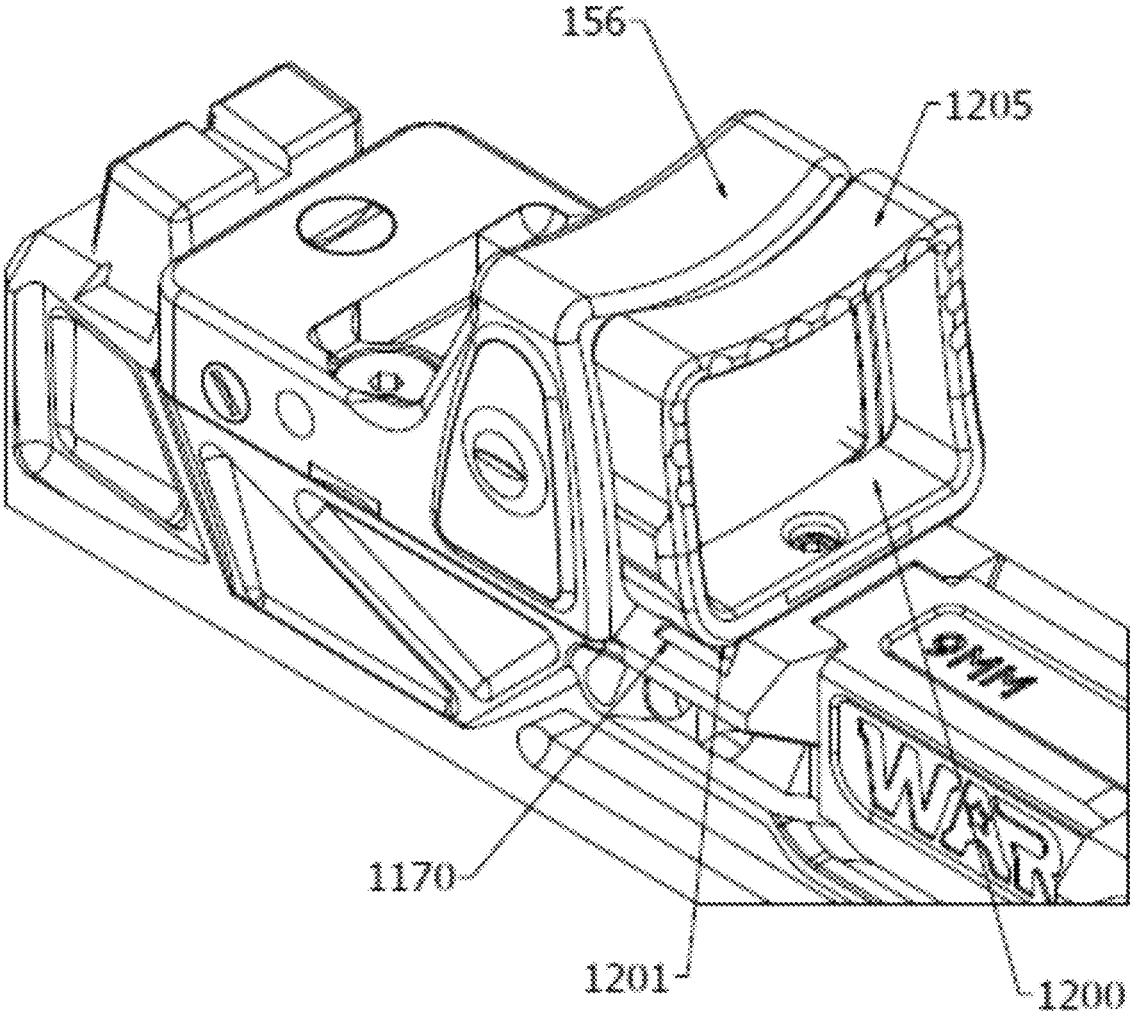
FIG. 12 illustrates a partial side view of a slide assembly in which the RMR optic illustrated in FIG. 1F is mounted directly on the slide illustrated in FIGS. 11A-C.

Referring to FIG. 12, an optic guard 1200 is shown installed in the optic guard mount 1170. The optic guard 1200 includes an integrated bracket 1201 with a first side to mate with the optic guard mount 1170. In this example, a frame 1205 is integrally formed with the bracket 1201, but in other examples the bracket 1201 may have a second opposite side to receive the frame 1205 and the frame 1205 may be attached (e.g., welded, removably attached, or the like) to the second side of the bracket 1201. In this embodiment, the frame 1205 protects a lens of the RMR optic 154, and a housing of the RMR optic 154 (e.g., the housing on the optic mounting platform 1153). The frame 1205 may protect the top and sides of the housing of the RMR optic 154.

In this embodiment, the bracket 1201 couples to a firearm assembly independently of the housing of the RMR optic 154. In the present embodiment, the bracket 1201 couples directly to a firearm. In another embodiment, the bracket 1201 (or any other optic guard bracket described herein) may couple to the firearm assembly by piggyback-mounting to an optic that is mounted on the firearm. For example, the firearm assembly may include a long range optic mounted on the firearm and a short range optic mounted on the long range optic, the bracket 1201 may couple to an optic guard mount defined by a component of the long range optic.

In this embodiment, the optic guard 1200 is arranged to couple to the firearm assembly without contacting the optic and without contacting the housing thereof (e.g., in this embodiment—without contacting any part of the RMR optic 154). A gap between a back of the frame 1205 and the housing of the RMR optic 154 is shown. The gap also prevents impact to the optic guard 1200 from transferring energy to the RMR optic 154—reducing risk of damage to the optic (and also maintaining zero of the sight alignment).

The RMR optic 154 may be sighted in at a time of installation of the optic guard 1200. The arrangement of the optic guard mount 1170 may provide for installation without any contact between the optic guard 1200 and, in this example, any part of the RMR optic 154. For instance, the dovetail groove embodiment of the optic guard mount 1170 allows the optic guard 1200 to be side-installed to maintain zero of the slight alignment of the firearm assembly (no contact with RMR optic 154 during installation).

In the illustrated embodiment, the frame 1205 is fully-enclosed—it includes a top frame segment, a bottom frame segment, and side frame segments (e.g., four sided). In other examples, a frame of on optics guard may have a fewer or greater number of sides (such as a ring shape) and/or be fully and/or substantially enclosed to protect a top and sides of a housing of an optic.

A front of at least one frame segment of the frame segments may include indentations/bumps forming another grip location for charging the slide (the indentations/bumps may also be provided on other frame members, such as on a top part of the front of the side frame segments). One embodiment of the frame 1205 is similar to the frame of the optic guard bracket shown in FIG. 15 (in which indentations are provided on the frame members of the optic guard bracket illustrated in FIG. 15). Charging using this grip location may be performed using the palm of the hand, as illustrated in FIG. 14D. Due to the gap and the depth of the frame 1205, charging using this grip location may not smudge the optic (and as already mentioned may maintain zero).

FIG. 13 illustrates a partial side view of an optic guard with an integrated rear sight 1399. This optic guard may be similar in any respect to optic guard 1200 (FIG. 12). In this embodiment, the integrated rear sight 1399 is located on a bottom member of the frame of optic guard 1200. In another embodiment, the integrated rear sight 1399 may be provided on some other part of the optic guard 1200. In some embodiments, the integrated rear sight 1399 may be releasably coupled to the optics guard 1200. The integrated rear sight 1399, and the charging grip points, are usable regardless of whether the firearm is currently provisioned with an optic or not.

Figure 14A:
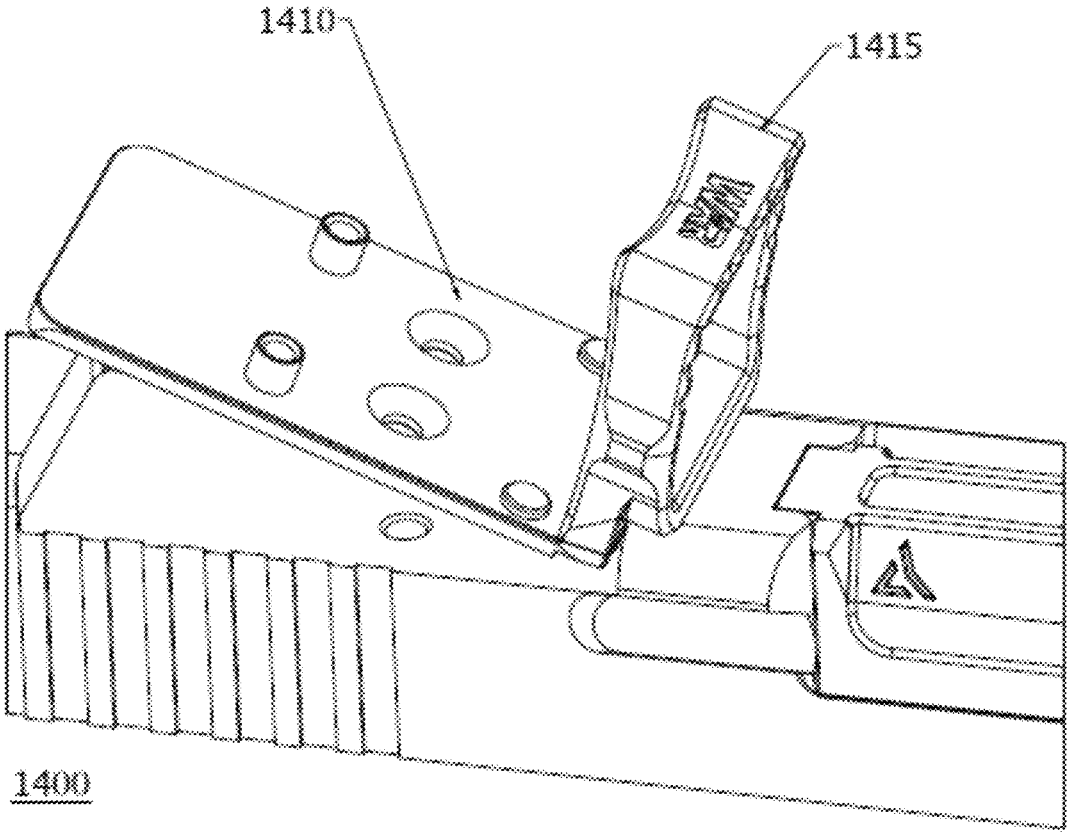
FIG. 14A illustrates a side view of an optic guard usable with the slide and the optic shown in FIG. 1F.
Figure 15:
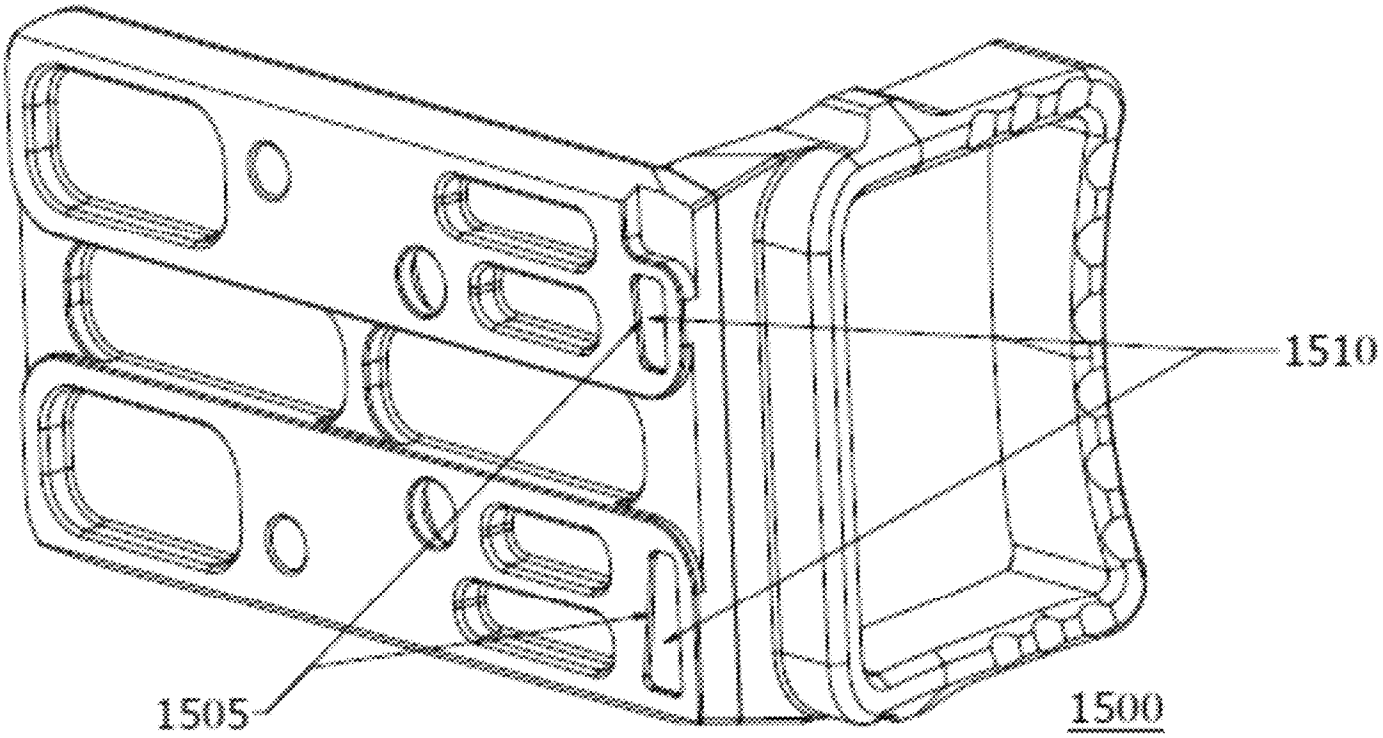
FIG. 15 illustrates an optic guard including a frame welded to a bracket.

FIG. 14A illustrates a side view of an optic guard 1400 usable with the slide 100 and the RMR optic 154 shown in FIG. 1F. This optic guard 1400 includes a frame 1415 (which may be similar in any respect to the frame 1205 of FIG. 12). The frame 1415 is fixably attached to a front of a bracket 1410. Fixable attachment may be welding one or more protrusions on the front of the bracket 1410 or the frame 1415 into mating openings formed on the other of the front of the bracket 1410 and the frame 1415 (e.g., non-releasably attached). FIG. 15 illustrates another embodiment of an optic guard 1500 usable on a legacy slide in which the optic guard 1500 has a fully-enclosed frame fixably attached to a bracket in which the front-most openings 1505 on the bottom of the front of the bracket expose protrusions 1510 extending from the bottom of the frame.

Referring again to FIG. 14A, in this embodiment the bracket 1410 is a plate. However, in other embodiments, a bracket need not be a plate (this is shown in FIG. 15, in which the bracket has a front section that is thicker than a rear section of the bracket).

Figure 14B:
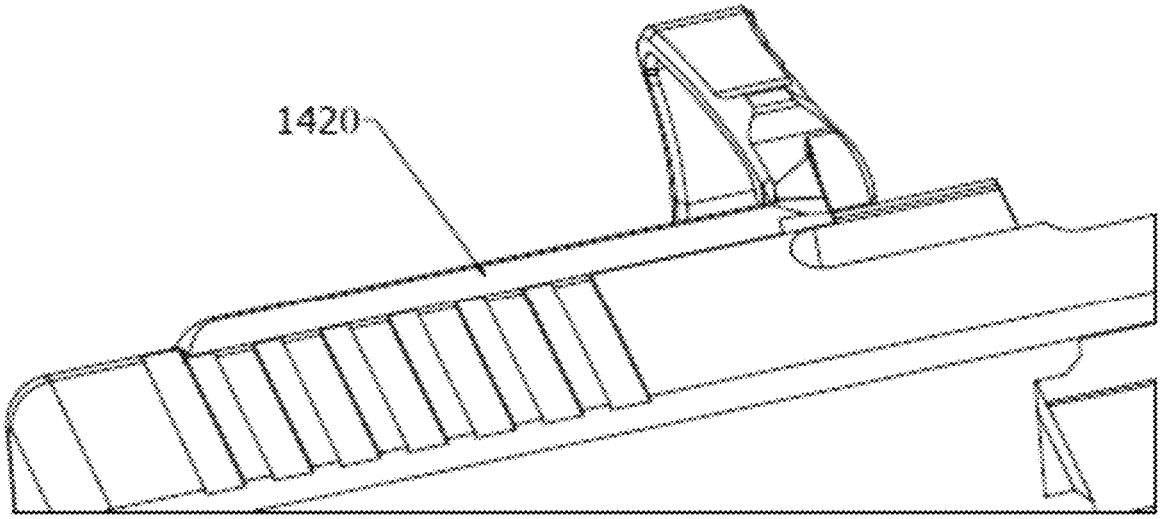
FIG. 14B illustrates a partial side view of a firearm including the optic guard of FIG. 14A installed thereon.

Referring again to FIG. 14A, a surface of the top side of the bracket 1410 may be similar in any respect to the surface of the mounting platform 1153 (FIG. 11A). The bottom side of the bracket 1410 may be smaller than the top side, and may similar to the bottom of the MOS adapter plate 151 (FIG. 1C). FIG. 14B illustrates that the sides 1420 of the bracket 1410 may be sloped, although this is not required.

Figure 14C:
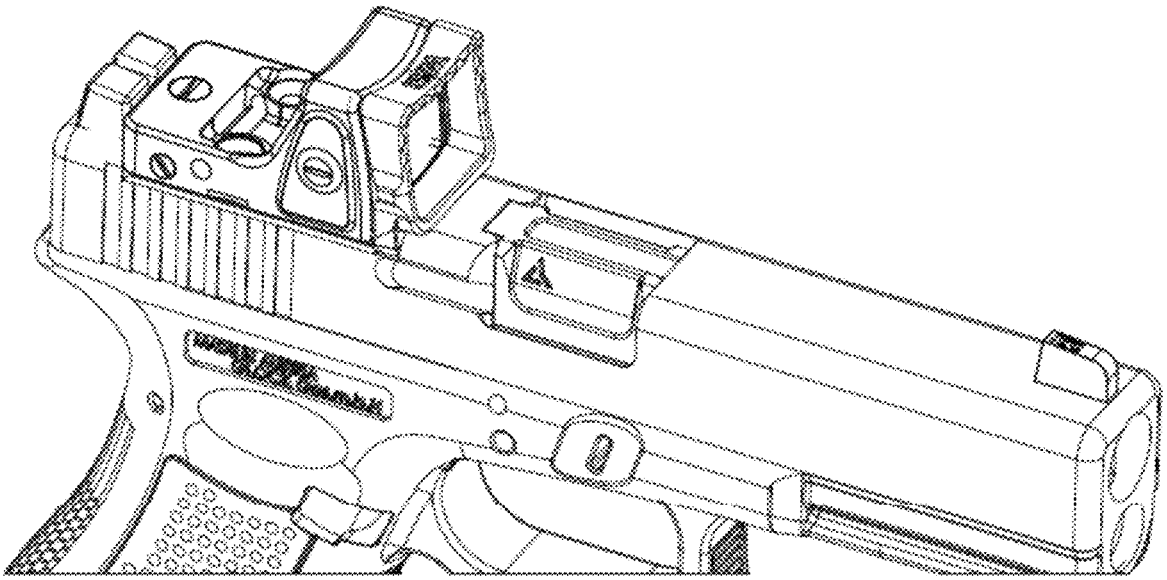
FIG. 14C illustrates a partial side view of a firearm including the optic guard of FIG. 14A with the RMR optic illustrated in FIG. 1F installed thereon.
Figure 14D:
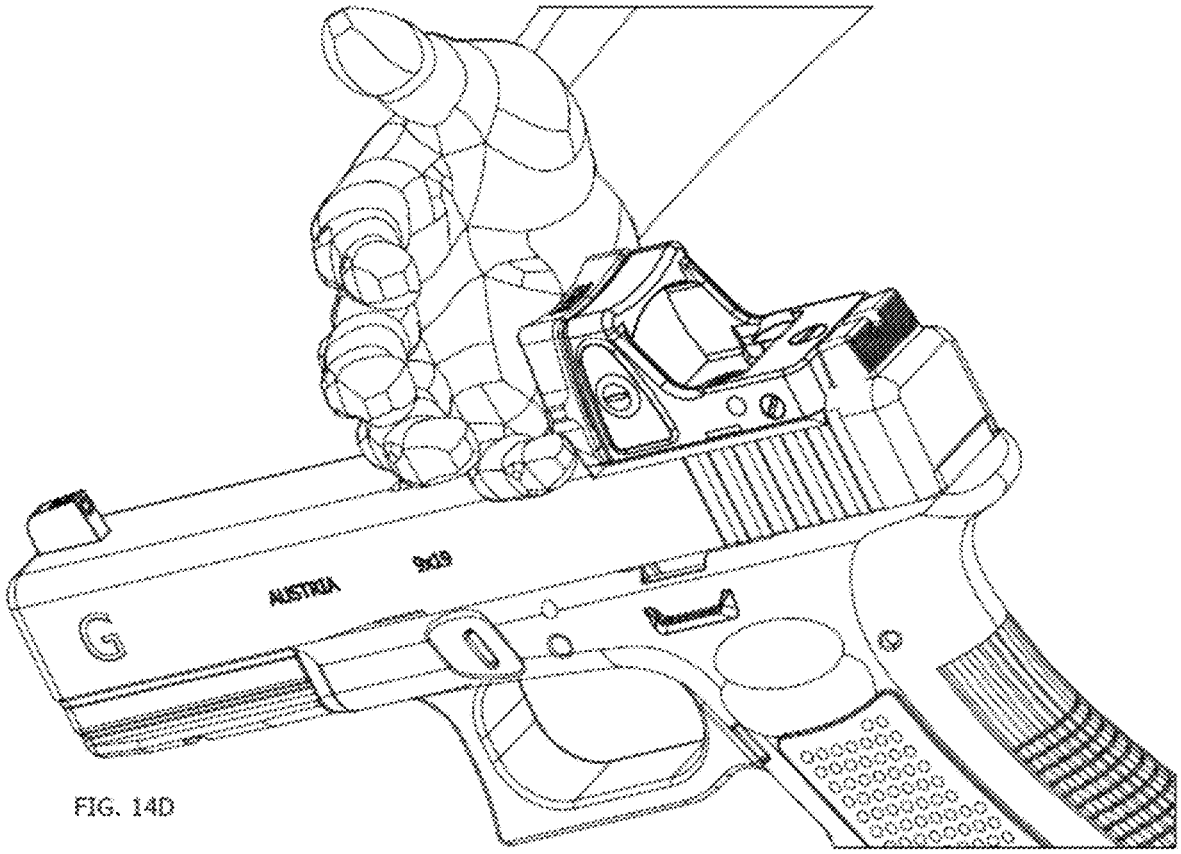
FIG. 14D illustrates charging a slide using a grip location provided on an optic guard.

FIG. 14C illustrates a partial side view of a firearm including the optic guard 1400 (FIG. 14A) with the RMR optic 154 (FIG. 1F) installed thereon. The gap between the back of the frame of the optic guard 1400 and the front of the housing of the RMR optic 154 may be the same as the gap described with respect to FIG. 12.

FIG. 14D illustrates charging a slide using a grip location provided on an optic guard. Charging may be accomplished without bumping the RMR optic 154 and without smudging the optic thereof. This charging grip point does not require the use of fingers/thumb (the scalloped grip on the side of the slide 100 of FIG. 1A is gripped using a finger and thumb). This charging grip point may be gripped using the palm instead, allowing the slide to be optimally charged (e.g., charged without smudging the optic and/or without bumping the RMR optic 154)—even in the case of an injury to the finger or thumb.

Referring again to FIG. 15, this optic guard 1500 with integrated bracket may be utilized with a different legacy slide than the legacy slide 100 of FIG. 1A. The underside of the bracket is arranged for attaching to a top exterior surface of the legacy slide. The top surface of the bracket (not shown) may be similar in any respect to the top surface of the mounting platform 1153 (FIG. 11A).

Having described and illustrated various examples herein, it should be apparent that other examples may be modified in arrangement and detail, e.g.:

- Any slide assembly described herein may be arranged to include any optic mounting platform described herein and/or arranged to include any optic guard mount described herein, according to various embodiments. Any slide assembly described herein may be arranged to include any alignment system described herein, according to various embodiments. Any slide assembly described herein may be arranged to retrofit a firearm having a slide assembly or may be part of original equipment of a firearm, according to various embodiments.
- The optic guards and the optic guard brackets described herein may be arranged to interoperate with any slide assembly described herein, or some other slide assembly currently known or later developed, according to various embodiments.

Compensator System With Mounted Gas Port Device

Known compensators may thread onto an end of a barrel. These compensators may be arranged to receive gas exiting a muzzle of a barrel, such as from the muzzle 2 of the barrel 105 of FIG. 1A. These compensators provide gas recoil by redirecting a portion of the received gas from the muzzle 2 in a particular direction.

Figure 17A:
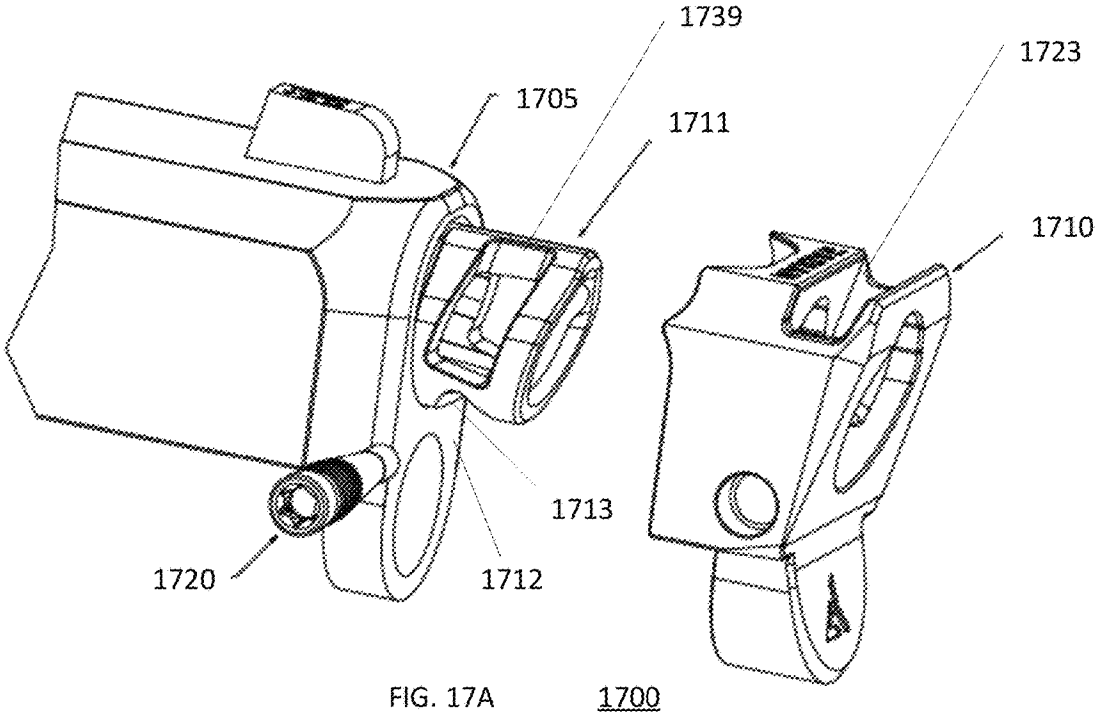
FIGS. 17A and 17B show an exploded view and an isometric view, respectively, of a compensator system.
Figure 17B:
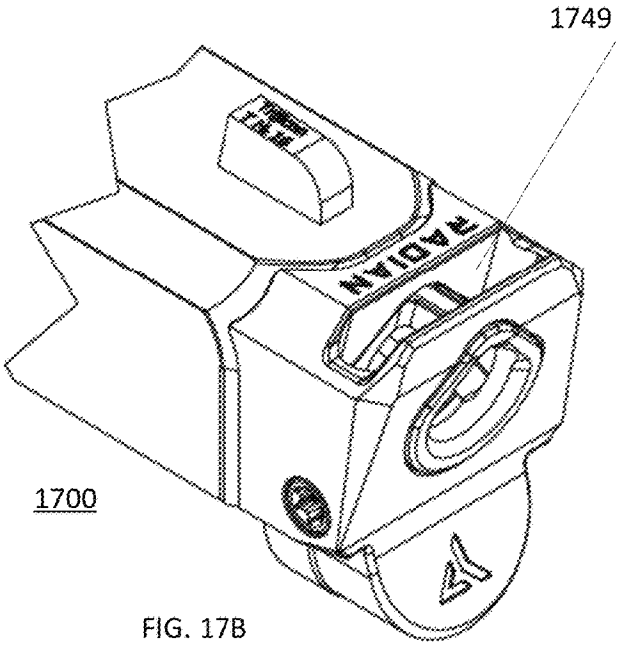

FIGS. 17A and 17B show an exploded view and an isometric view, respectively, of a compensator system 1700. In the compensator system 1700, the barrel 1711 may include an egress 1739 that may be similar to barrel egress 39 (FIG. 3) or any other barrel egress described herein. The compensator system 1700 may include a gas port device 1710 with an opening 1723 to expose the egress 1739 when the gas port device 1710 is mounted on a part of the barrel 1711 that protrudes from the slide 1705. The opening 1723 and the egress 1739 may form a gas port 1749 similar in any respect to the gas port 49 (FIG. 4A).

In contrast to compensators that receive all the gas from the muzzle of the barrel, the gas port device 1710 may receive the gas from the egress 1739 of the barrel 1711. The total length of the compensator system 1700 may be shorter than the total length of a barrel and a compensator in which the compensator threads onto the barrel and/or receives all the gas from a muzzle of a barrel.

The slide 1705 may be similar to the slide 100 in any respect. In various embodiments, the slide 1705 may have a front wall 1712 similar to the front wall illustrated in FIG. 1 (the front wall corresponding to the front interior 12 of slide 100). The egress 1739 may be located on a part of the barrel 1711 that protrudes from a bore 1713 in the front wall 1712, e.g., an interior of the gas port 1749 may be different/separate than the front wall 1712 with the bore 1713.

The gas port device 1710 may be mounted to the barrel 1711 using any fasteners or other attachment device now known or later developed. In this example, the gas port device 1710 is mounted to the barrel 1711 using a taper pin 1720, which will be described in more detail later with respect to the description of FIG. 17F.

During the firing cycle, the barrel 1711 may lock up with the slide 1705 in a similar way that barrel 105 (FIG. 1) locks up with slide 100 (FIG. 1). Specifically, the bore 1713 defined by the front wall 1712 may have standard dimensions as a bore on "stock" slide. In the case of a glock-compatible firearm (which allows the muzzle end of the barrel to move upwards with respect to the slide during the firing cycle), the bore 1713 may be an eccentric bore. Due to this, unlike some other compensator assemblies that may not operate with standard-dimensioned slide, the compensator system 1700 is operable with slide 100 or any other slide with a front wall 1712 similar to the front wall of slide 100.

In some embodiments, compensator system 1700 may provide some recoil reduction even when gas port device 1710 is not mounted to the barrel 1711. Specifically, even when the firearm is fired without the gas port device 1710 attached, the egress 1739 may provide some base amount of recoil reduction (due to the gas venting from the egress 1739 to direct the gas in a direction that reduces recoil).

Figure 17F:
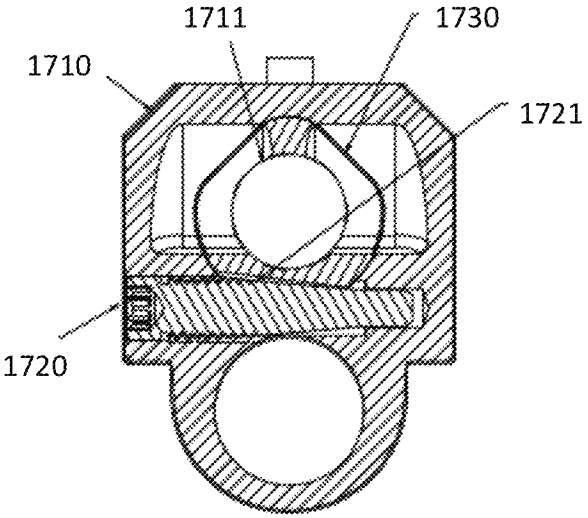
FIG. 17F illustrates a front view of a section of the compensator system taken along section line C-C of FIG. 17D.
Figure 17G:
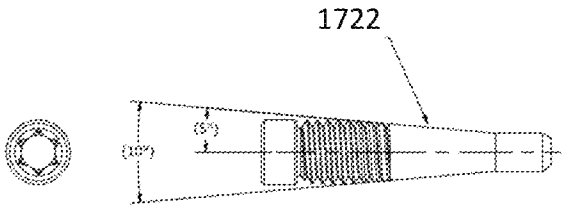
FIG. 17G illustrates the taper pin of FIG. 17F in more detail.
Figure 17E:
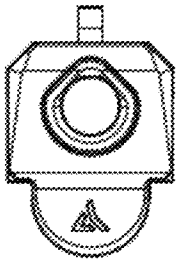
FIGS. 17C, 17D, and 17E illustrate a top view, a side view, and a front view, respectively, of the compensator system of FIGS. 17A-B.
Figure 17C:
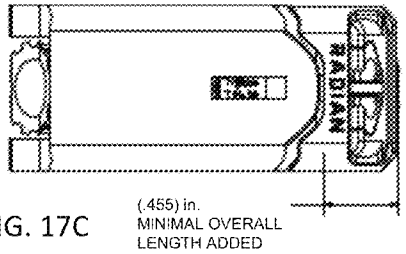
Figure 17D:
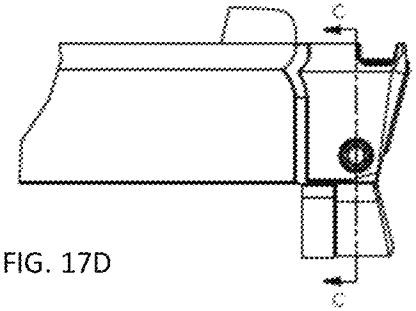

FIGS. 17C, 17D, and 17E illustrate a top view, a side view, and a front view, respectively, of the compensator system 1700. FIG. 17F illustrates a front view of a section of the compensator system 1700 taken along section line C-C. The taper pin 1720 may interface with a taper interface 1721 provided on a bottom of the barrel 1711 (FIG. 17A). FIG. 17G illustrates the taper pin 1720 in more detail. In this example, it includes a taper lock interface 1722 along part of its length (another part of the length includes threads as illustrated).

Figure 18A:
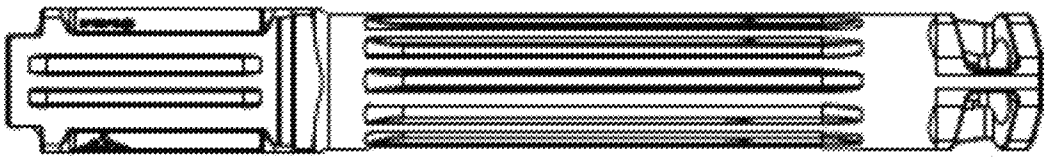
FIGS. 18A and 18B illustrate a top view and a side view of the barrel of FIG. 17A.
Figure 18B:
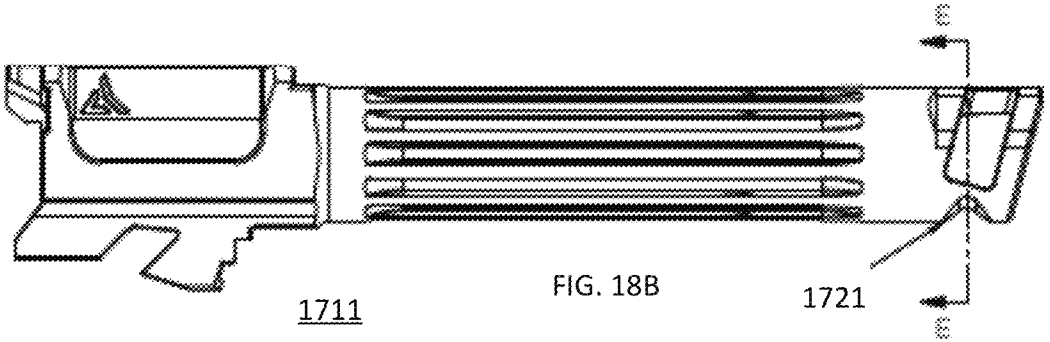
Figure 18C:
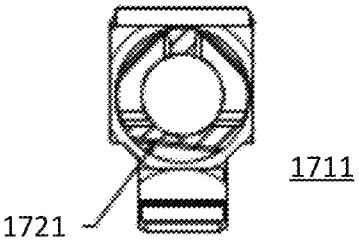
FIG. 18C illustrates a front view of a section of the barrel of FIGS. 18A-B, taken along section line E-E.

The taper interface 1721 is shown in more detail in FIGS. 18A-C. FIGS. 18A and 18B illustrate a top view and a side view, respectively, of the barrel 1711. FIG. 18C illustrates a front view of a section of the barrel 1711 (taken along section line E-E). In this example, the taper interface 1721 is a tapered "V" slot 1721. In other examples, a different slot may be provided, such as a rounded slot.

Figure 19:
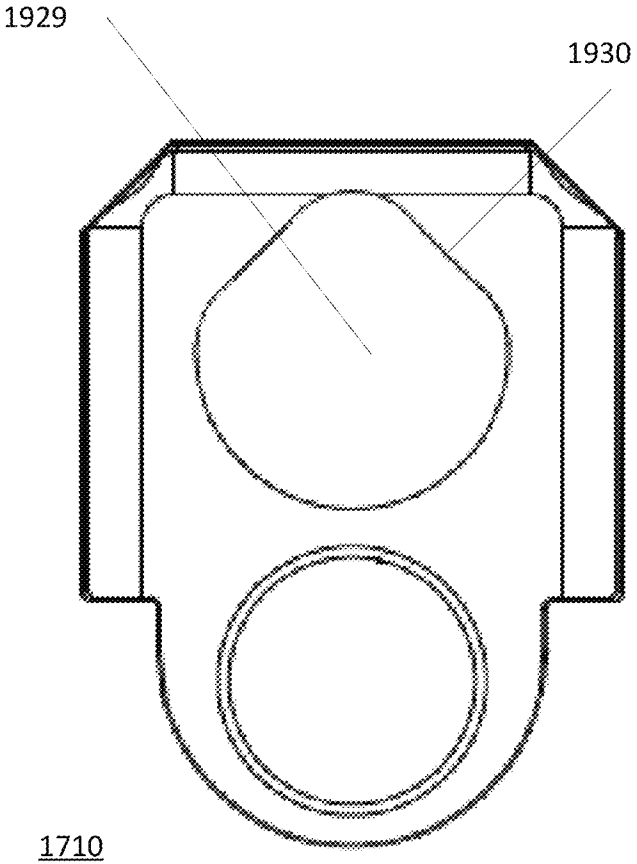
FIG. 19 illustrates a rear view of the gas port device of FIG. 17A.

Referring again to FIG. 17F, the part of the barrel 1711 on which the gas port device 1710 (FIG. 17A) is mounted may include indexing flats 1730 to mate with a corresponding indexing flats of the gas port device 1710. FIG. 19 illustrates a rear view of the gas port device 1710, which shows an opening 1929 in the gas port device 1710. The opening 1929 defines indexing flats 1930 to mate with the indexing flats 1730 (FIG. 17F). Referring again to FIG. 17F, when the taper pin 1720 is tightened (e.g., using a wrench tool in this example), the taper lock interface 1722 (FIG. 17G) contacts the corresponding taper interface 1721 of the bottom of the barrel 1711. In this example, the taper pin 1720 includes threading to interface with an internal thread in the gas port device 1710; however, this is not required. In other examples, a taper pin may not include threads—it could be driven into the hole in the gas port device 1710 to lockup with the taper lock interface 1721 provided in the bottom of the barrel 1711.

The location of the indexing flats of the barrel (and the indexing flats of the barrel) may be on any position around the barrel, such as either side the barrel, the top of the barrel, the bottom of the barrel, or any other orientation between those. In other examples, some other indexing face may be used that is different than the illustrated indexing flats (a curved profile, etc.) In this example, the timing system includes plural indexing faces, but in other examples it may possible and practical to use a single indexing face on the barrel 1711 and on the gas port device 1710.

Referring again to FIG. 17G, in this example the taper pin 1720 includes four sections: a threaded section, a tapered section, and a straight section proximate to each end. As the taper pin starts to engage the taper interface 1721 (FIG. 17F) the straight sections may prevent the taper pin 1720 from being urged away from the barrel 1711 (FIG. 17F). Specifically, the gas port device 1710 may be arranged with a hole of a corresponding diameter that the small diameter straight section fits into and a counter bore with a corresponding diameter that the large diameter straight section fits into (this can be seen in FIG. 17F). The taper pin 1720 may be held into place on both sides of the taper lock interface 1722 by these straight sections to keep either end of the taper pin 1720 from moving away from the barrel.

Figure 24B:
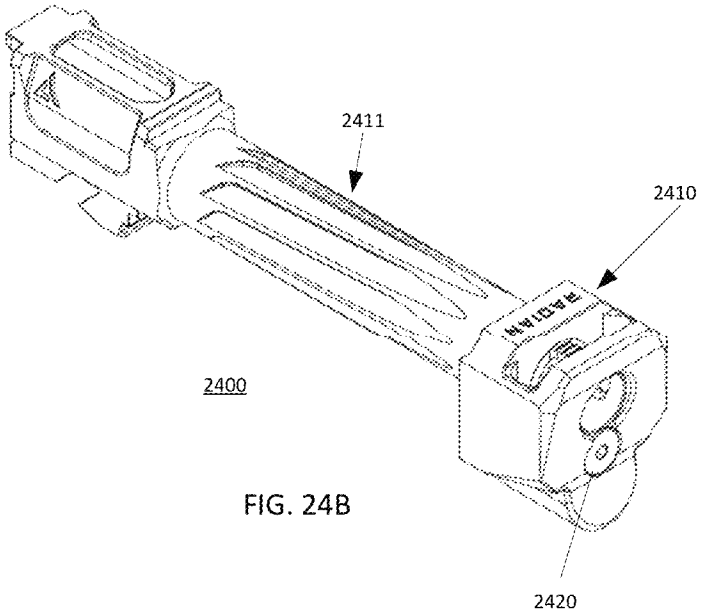
FIGS. 24A-D show an exploded view, an isometric view, a front view, and a cross-sectional side view of another compensator system with a threaded barrel.

In other embodiments, the taper pin may not require the straight sections proximate to each end. FIG. 24A-C illustrate an example without these straight sections proximate to each end of the taper pin 2420. A taper pin may include a single continuous taper with a first region having a taper lock interface to contact a taper interface of a barrel and a second region to contact the barrel-mountable accessory. In other embodiments, a taper pin may have two distinct sections-a tapered first section to contact a taper interface of a barrel and a second non-tapered (or differently tapered) section to contact the barrel-mountable accessory (this is illustrated in the embodiment of FIGS. 24A-D—in this example a tapered section is between the a threaded section and the driving end of the taper pin 2420).

Figure 20B:
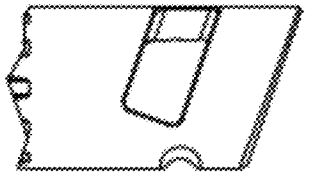
FIG. 20B is a detail K of FIG. 20A.
Figure 20A:
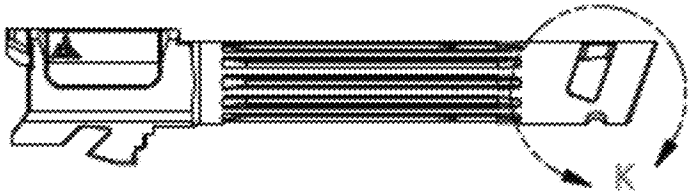
FIG. 20A illustrates a barrel that may be similar in any respect to the barrel of FIG. 17A.

FIG. 20A illustrates a barrel 2011 that may be similar in any respect to barrel 1711 (FIGS. 18A-B). FIG. 20B is a detail K showing an interface with a round taper profile (instead of a tapered "V" slot). An interface on a bottom of the barrel may have a V profile, a round profile, or any other profile, according to various embodiments. The location of the interface of the barrel (and the taper lock interface) may be on any position around the barrel, such as either side the barrel, the top of the barrel, the bottom of the barrel, or any other orientation between those.

Figure 21B:
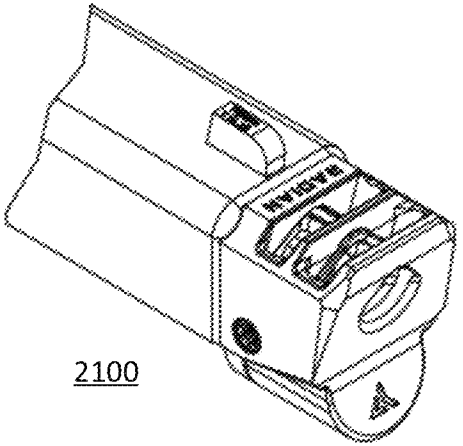
FIGS. 21A, 21B, 21C, and 21D show an exploded view, an isometric view, a top view, and a side view, respectively, of another compensator system.
Figure 21A:
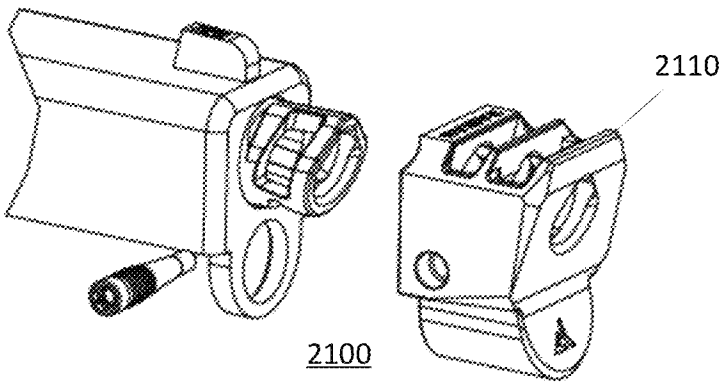
Figure 21C:
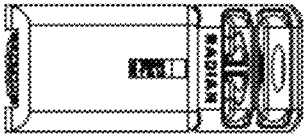
Figure 21E:
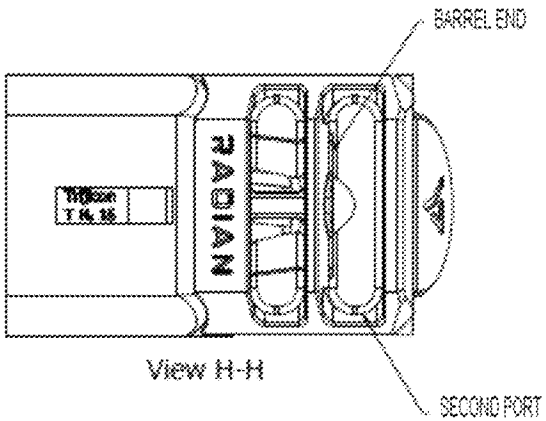
FIG. 21E shows a view taken from line H of FIG. 21D.

FIGS. 21A, 21B, 21C, and 21D show an exploded view, an isometric view, a top view, and a side view, respectively, of another compensator system 2100 utilizing a dual-ported gas port device 2110. All other components of the compensator system 2100 may be the same as the compensator system 1700 (FIG. 17A). FIG. 21E shows a view taken from the perspective of the arrows of line H of FIG. 21D.

Figure 21F:
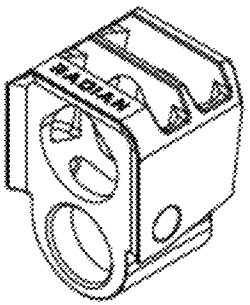
FIG. 21F shows an isometric view of the slide-facing side of the gas port device of FIG. 21A.
Figure 21D:
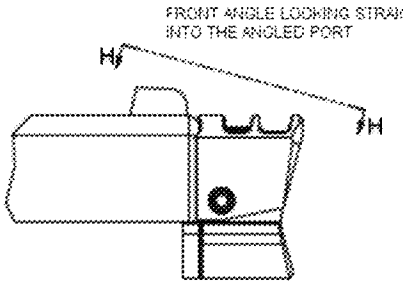

Gas port device 2110 may receive gas from a barrel egress similar to gas port device 1710 (FIG. 17A), but also may receive additional gas from the muzzle of the barrel. Accordingly, gas port device 2110 may provide additional recoil reduction. A user may interchangeably mount gas port devices 1710 and 2110 on a same barrel (or run with no gas port device attached for base recoil reduction), depending on a desired amount of recoil reduction. FIG. 21F shows an isometric view of the slide-facing side of gas port device 2110.

Figure 22B:
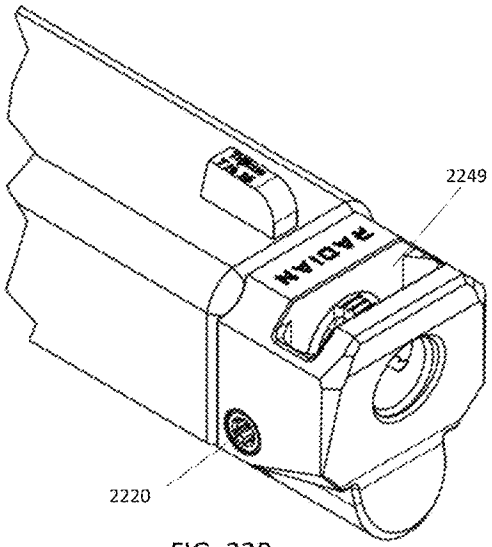
FIGS. 22A, 22B, 22C, 22D, and 22E show an exploded view, an isometric view, a top view, and a front view, and a cross-sectional side view, respectively, of another compensator system with a threaded barrel.
Figure 22E:
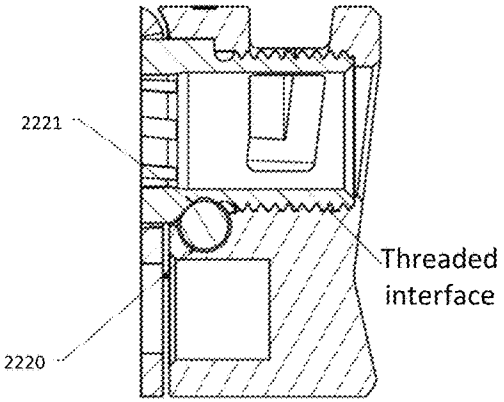

Although the various above-described embodiments of a compensator system with mounted gas port device feature a non-threaded barrel, it should be appreciated that any of the features included in those compensator systems may be utilized in a compensator system with a threaded barrel. FIGS. 22A-24E illustrate examples in which threaded barrels are used. FIGS. 22A, 22B, 22C, 22D, and 22E show an exploded view, an isometric view, a top view, and a front view, and a cross-sectional side view, respectively, of another compensator system 2200 with a threaded barrel 2211. FIG. 23 shows a side view of a threaded barrel-mounted accessory 2305 installed on the threaded barrel 2211 of the compensator system 2200 of FIGS. 22A-E. FIGS. 24A-D show an exploded view, an isometric view, a front view, and a cross-sectional side view of another compensator system 2400 with a threaded barrel 2411.

Figure 22A:
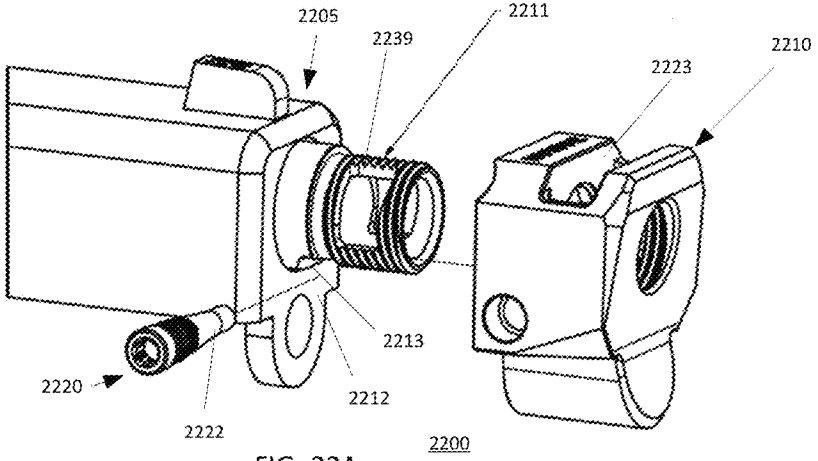
Figure 22D:
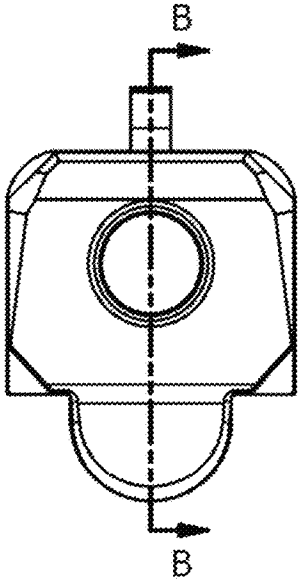
Figure 22C:
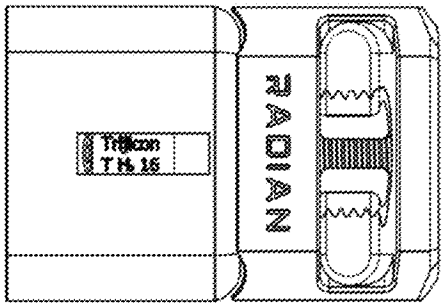
Figure 23:
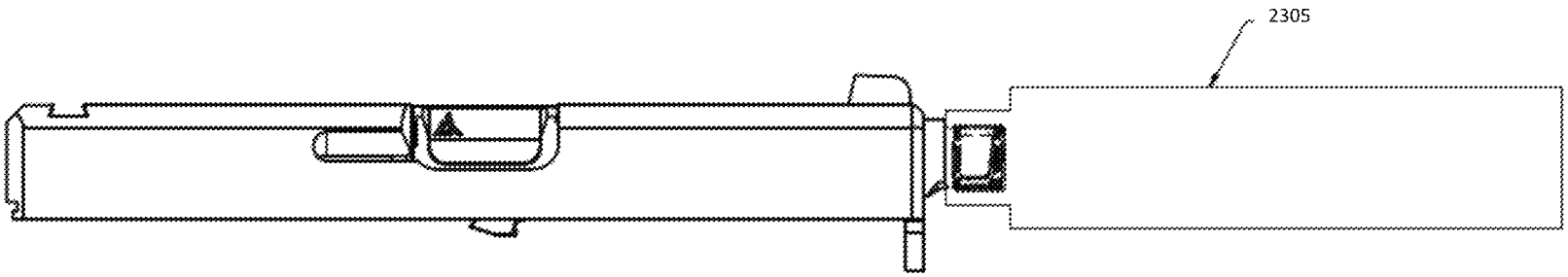
FIG. 23 shows a side view of a threaded barrel-mounted accessory installed on the threaded barrel of the compensator system of FIGS. 22A-E.

Referring to FIG. 22A, in the compensator system 2200, the barrel 2211 may include an egress 2239 that may be similar to barrel egress 39 (FIG. 3) or any other barrel egress described herein. The compensator system 2200 may include a gas port device 2210 with an opening 2223 to expose the egress 2239 when the gas port device 2210 is mounted on a part of the barrel 2211 that protrudes from the slide 2205. The opening 2223 and the egress 2239 may form a gas port 2249 similar in any respect to the gas port 49 (FIG. 4A).

In contrast to compensators that receive all the gas from the muzzle of the barrel, the gas port device 2210 may receive the gas from the egress 2239 of the barrel 2211. The total length of the compensator system 2200 may be shorter than the total length of a barrel and a compensator in which the compensator threads onto the barrel to receive all the gas from the muzzle of a barrel.

The slide 2205 may be similar to the slide 100 in any respect. In various embodiments, the slide 2205 may have a front wall 2212 similar to the front wall illustrated in FIG. 1 (the front wall corresponding to the front interior 12 of slide 100). The egress 2239 may be located on a part of the barrel 2211 that protrudes from a bore 2213 in the front wall 2212, e.g., an interior of the gas port 2249 (FIG. 22B) may be different/separate than the front wall 2212 with the bore 2213.

In this embodiment, the part of the barrel 2211 that protrudes from the bore 2213 in the front wall 2212 is threaded. The gas port device 2210 (which has corresponding threading to mate with the threading on the part of the barrel 2211) may be mounted to the barrel 2211 using this threading and the taper pin 2220, which may be similar in any respect to the taper pin 1720 described with respect to FIG. 17F.

Referring now to FIG. 22E, when the taper pin 2220 is tightened (e.g., using a wrench tool in this example), the taper locker interface 2222 (FIG. 22A) contacts the corresponding taper interface 2221 of the bottom of the barrel 2211. In this example, the taper pin 2220 includes threading to interface with an internal thread of the gas port device 2210; however, this is not required. In other examples, a taper pin may not include threads—it could be driven into the hole in the gas port device 2210 to lockup with the taper lock interface 2221 in the bottom of the barrel 2211.

Referring now to FIG. 23, a different barrel-mounted accessory may be mounted to the barrel 2211 (in place of the gas port device 2210 and the taper pin 2220). In this example, a known suppressor 2305 is shown. The threading on the barrel 2211 (FIG. 22A) may be arranged to mate with threading on the known suppressor 2305. The taper lock interface 2221 (FIG. 22E) may not contact the threading on the known suppressor 2305. In this way, the barrel 2211 (FIG. 22A) with the taper lock interface 2221 can be used with any known barrel-mounted accessories that are not arranged with taper lock interface features.

Referring again to FIG. 22E, it should be appreciated that the location of the taper interface 2221 on the barrel 2211 (FIG. 22A) may be variously located at any position on the barrel 2211. In some examples, the taper interface 2221 may be located on the side of the barrel 2211, instead on the bottom of the barrel 2211, for instance.

Additionally, although the taper pin 2220 (FIG. 22A) is side-mounted (e.g., arranged perpendicular to the barrel 2211) in this embodiment, other mountings of a taper pin are possible and practical. FIGS. 24A-D illustrated embodiment of a compensator system 2400 that may be similar in any respect to compensator system 2200 (or any other compensator system described herein) with a differently-oriented taper pin 2420 (e.g., not side-mounted and not perpendicular to the barrel 2411—this taper pin 2420 is mounted parallel to the barrel 2411 from the front end of the barrel 2411). Besides the different taper interface 2421, the barrel 2411 may otherwise be similar to the barrel 2211 (FIG. 22A) in any respect.

The taper interface 2421 in this example is a notch sloping downwardly looking from the front of the barrel (in contrast to the taper interface 2221 that is side sloping looking from the front of the barrel). The use of the notch on the taper interface 2421 (or any other taper interface described herein) is not required. In other examples, the taper interface 2421 may have a groove shape (such as a V-groove in which the V-shape can be seen looking from the front of the barrel 2211).

The gas port device 2410 may have an opening on a front end to receive the taper pin 2420 (rather than an opening on a side), but otherwise may be similar to the gas port device 2210 (FIG. 22A). FIG. 24C shows a front view in which the head of the taper pin 2420 is shown below the muzzle end of the barrel 2411.

Figure 24D:
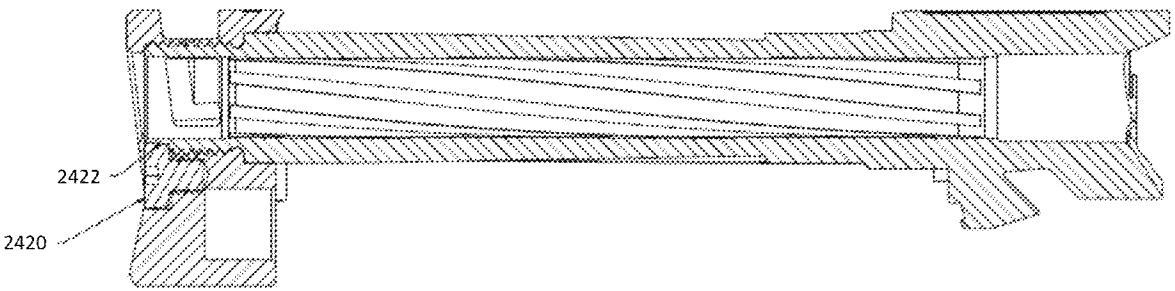
Figure 24A:
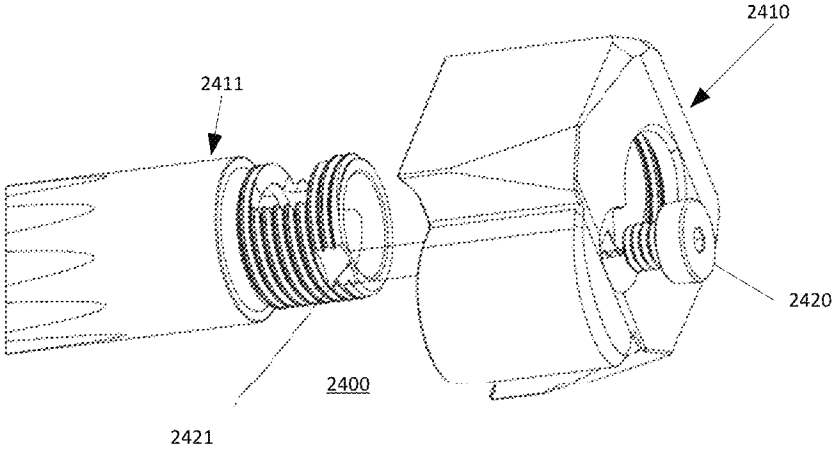
Figure 24C:
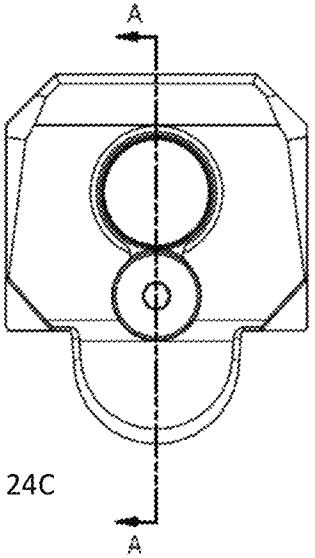

The taper locker interface 2422 of the taper pin 2420 is shown in FIG. 24D. The taper lock interface 2422 contacts the corresponding taper interface 2421 (FIG. 24A) of the bottom of the barrel 2211 (FIG. 24A). FIG. 24D shows that, in this embodiment, the taper lock interface 2422 is behind the threading of the taper pin 2420 (as compared to in front of the threading of the taper pin 2220 of FIG. 22A). The taper pin 2420 is also differently shaped than the taper pin 2220 of FIG. 22A, as illustrated in FIG. 24D.

In any compensator system described herein, the gas port device may include a sight tracker similar to the sight tracker 1699 (FIG. 16A-B). In any compensator system described herein, any barrel interior features described herein may be utilized in the barrel (including the barrel interior features described in reference to FIGS. 7A-9C).

Some embodiments include a retrofit assembly for a firearm, the retrofit assembly to provide the firearm with gas compensation to reduce recoil, the retrofit assembly comprising: a barrel having a muzzle end, a breech end, and a length having a first segment that includes the muzzle end of the barrel and a second segment that includes the breech end of the barrel, wherein an upper region of the first segment of the length of the barrel includes an egress for gas propelled from a chamber of a bore of the barrel; a slide around the second segment of the length of the barrel, wherein the slide has a front wall defining a bore, and wherein the first segment of the length of the barrel protrudes from the bore of the front wall of the slide; and a gas port device mounted to the first segment of the length of the barrel, wherein the gas port device defines an opening to expose the egress of the first segment of the length of the barrel. The firearm may be a Glock compatible firearm, or some other firearm. The bore in the front wall of the slide may be an eccentric bore (in the case of a Glock compatible firearm), or some other circular shape depending on the firearm.

Barrel-Mounted Accessory Taper Lock Interface

Various features of the taper lock interface described with respect to FIG. 17F can be applied to any compensator (or other barrel-mounted accessory), including compensators that receive gas only from a muzzle of a barrel. Known compensators may require a threaded barrel. One problem with a threaded barrel is that a compensator may become loose due to vibrations of repeated firing cycles. One embodiment of a compensator with a taper locker interface includes a compensator mountable to a part of a barrel that protrudes from the front wall of the slide. This barrel may not include the egress 1739 (FIG. 17A) and/or may not be ported. The compensator may be arranged to redirect gas exiting from a muzzle of a barrel.

In this embodiment, the compensator may include a taper lock interface similar to taper interface 1721 of FIG. 17F. The compensator may include a taper pin similar to any taper pin described herein.

In some embodiments, the compensator may also include an opening similar to opening 1929 (FIG. 19), which may define indexing flats (similar to indexing flats 1930) to mate with indexing flats on the protruding part of the barrel; however, this is not required. In other embodiments, the compensator may be arranged to mount onto, say, a round barrel (wherein the barrel does not include indexing flats).

In any embodiment of a compensator with any of the taper lock interface features described with respect to FIG. 17F (e.g., the taper pin and optionally the indexing flats), the taper lock interface may precisely time the compensator on the barrel when the compensator is mounted on the barrel. This allows the compensator to be identically mounted to the barrel in a repeatable fashion. If the compensator includes a sight tracker, the sight tracker will maintain zero through removal/reattachment of the compensator on the barrel (a user may not need to re-sight the sight tracker after re-mounting the compensator).

Also, in known compensators, such as threaded compensators that receive gas from the muzzle of the barrel, the bore of the compensator has to be relatively large (compared to the bore of the barrel) so that a bullet cannot hit the compensator when that bullet exits the muzzle. However, this relatively large compensator bore limits the amount of recoil reduction the compensator can provide (because a lower volume of gas can be directed because of the relatively large compensator bore). In contrast, since a compensator using a taper lock interface as described herein can be mounted identically in a repeatable fashion, the bore of the compensator can be closer in size to the bore of the barrel. Therefore, the use of the taper lock interface allows further optimization of gas flow for improved recoil reduction compared to compensators that thread onto threaded barrels.

A compensator with a taper lock interface may have a lower region that is shorter than an upper region of the compensator—to mate with a barrel having a sloped muzzle end similar to the sloped muzzle end of the barrel 1711 of FIG. 17A. This is due to the small profile of the taper lock interface on the bottom of the barrel. This may minimize the impact of the compensator increasing the length of the firearm (this wedge profile may allow the firearm to be holstered more easily than firearms with compensators that have a lower region that is the same length as the upper region of the compensator).

In the embodiments described above, the barrel-mounted accessory is a compensator. However, the taper lock interface may be used for any barrel-mounted accessories, including accessories to adapt a barrel to a silencer/suppressor (such as a recoil booster—also known as a Nielsen device) or any other barrel-mounted accessory.

Although the various above-described embodiments of barrel-mounted accessories with taper lock interfaces feature non-threaded barrels, it should be appreciated that any of the features included in those embodiments may be utilized in a firearm assembly or firearm with a threaded barrel. FIGS. 22A-24D illustrate embodiments in which the barrel-mounted accessory is a gas port device, but any of the features described with respect to FIGS. 22A-24D may be used in a threaded barrel without the egress and/or with any barrel-mounted accessories.

In various embodiments described herein, the tapered section of the pin has a conical surface. However, in other embodiments the tapered section of the pin may have non-conical surfaces such as multiple faces (e.g., flat faces or curved faces with vertexes between the faces). The taper interface on the barrel may have one or more corresponding flat or curved faces.

Barrel-Mounted Accessory With Timing System

Various features of the timing system described with reference to FIGS. 17F and 19, e.g., the indexing flats 1730 and 1930, may be used in a compensator (or some other barrel-mounted accessory) with any attachment interface that is now known or later developed (e.g. not limited to the taper lock interface). For instance, the bottom of the compensator (e.g., an apex of the bottom of the compensator) may have a threaded hole to receive a threaded screw. When the screw is tightened, the indexing flats are pressed together. Other mechanisms for pressing the indexing flats together may be used in other examples.

The indexing flats may precisely time the compensator on the barrel when the compensator is mounted on the barrel. This allows the compensator to be identically mounted to the barrel in a repeatable fashion. If the compensator includes a sight tracker, the sight tracker will maintain zero through removal/reattachment of the compensator on the barrel (a user may not need to re-sight the sight tracker after re-mounting the compensator).

Also, in known compensators, such as threaded compensators that receive gas from the muzzle of the barrel, the bore of the compensator has to be relatively large (compared to the bore of the barrel) so that a bullet cannot hit the compensator when that bullet exits the muzzle. However, this relatively large compensator bore limits the amount of recoil reduction the compensator can provide (because a lower volume of gas can be directed because of the relatively large compensator bore). In contrast, since a compensator using indexing flats as described herein can be mounted identically in a repeatable fashion, the bore of the compensator can be closer in size to the bore of the barrel. Therefore, the use of the indexing flats allows further optimization of gas flow for improved recoil reduction compared to compensators that thread onto threaded barrels.

In the embodiments described above, the barrel-mounted accessory is a compensator with the barrel egress. However, it should be appreciated that the timing system may be used for any barrel-mounted accessories, including compensators without the barrel egress, accessories to adapt a barrel to a silencer/suppressor (such as a recoil booster), or any other barrel-mounted accessory.

In the embodiments described above, the barrel-mounted accessory is a compensator with the barrel egress. However, it should be appreciated that the taper lock interface may be used for any barrel-mounted accessories, including compensators without the barrel egress, accessories to adapt a barrel to a silencer/suppressor (such as a recoil booster), or any other barrel-mounted accessory.

In one embodiment in which the taper lock interface is used with a compensator without a barrel egress, the muzzle end of the barrel may have the same features as barrel 2211 (FIG. 22A)—excluding the egress 2239. This barrel may be compatible with a known threaded compensator that may receive gas from the muzzle end of the barrel, as well as with barrel-mounted accessories having a taper lock interface.

In one embodiment, a barrel-mounted "adapter"—to allow a non-threaded barrel to operate with threaded accessories—is provided. The non-threaded barrel may have the same features as barrel 1711 (FIG. 17A)—excluding the egress 1739. The adapter may have a back and side similar to the back and side of gas port device 1710 (or some other taper lock interface features described herein). The front of the adapter may have a threaded barrel-shaped projection similar to the muzzle end of barrel 2211 (FIG. 22A)—excluding the taper lock interface 1721. Therefore, the adapter with the taper lock interface on its back side may adapt the non-threaded barrel to receive a known threaded barrel-mountable accessory (such as a known threaded suppressor) on the adapter's front side.

In the embodiments illustrated herein, the taper lock interface is used for a barrel-mounted accessory on a pistol. However, the taper lock interface may be used for barrel-mounting an accessory (such as a suppressor) to any firearm, including rifles or other long guns.

Gas Port Geometry

Various embodiments described herein may include a compensation assembly with a gas port geometry that may be arranged to control one or more characteristics of gas flow through the compensation assembly, which may be beneficial to recoil reduction. In some examples, the gas port geometry may:

- Tune the amount of time for the gas to travel through the compensation assembly (e.g., to decrease the amount of time, in some examples), which may be beneficial for recoil reduction;
- Tune the velocity that gas exits the compensation assembly (e.g., to increase the velocity), which may be beneficial to recoil reduction; and/or
- Tune the volume of gas that exits the compensation assembly, which may be beneficial to recoil reduction.

A cavity of the compensation assembly may include one or more gas flow-directing sections to tune these or other characteristics of gas traveling through the compensation assembly. These gas flow-directing sections may be used in any compensation assembly described herein, including:

- Exclusively muzzle-fed compensation assemblies,
- Exclusively egress-fed compensation assemblies, and
- Dual-fed compensation assemblies (which may be muzzle-fed and egress-fed).

In various embodiments, these gas-flow directing sections may be arranged to operate on gas expelled from any portion of a muzzle or an egress of a barrel. However, in some embodiments, one or more gas flow-directing sections may be located to operate on the portion of the gas expelled from a lower section of the egress or muzzle, e.g., the part of the egress/muzzle that is located below a centerline of the barrel, which may be beneficial to recoil reduction.

In the illustrated examples that follow, the compensation assemblies include barrel-mounted gas port devices. However, any gas port geometry features described herein may also be used in with any other compensation assemblies, such as with the gas port of a slide (e.g., the slide 400 of FIGS. 4A-B, and FIG. 10D).

Figure 25A:
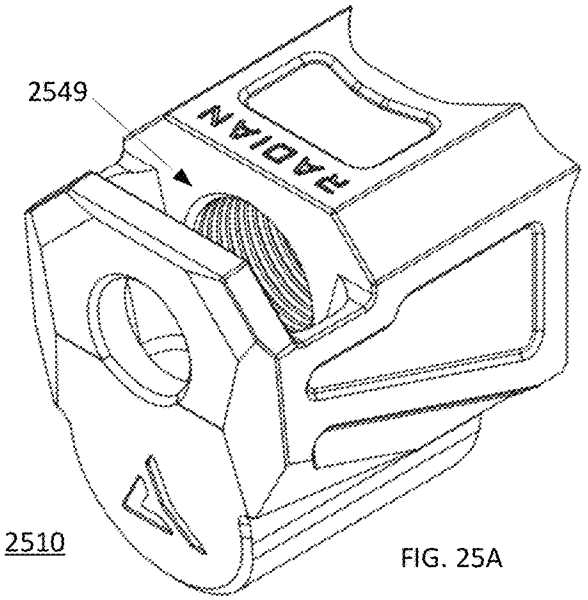
FIGS. 25A-D show, respectively, an isometric view of a gas port device, a side view of the gas port device, a top view of the gas port device, and a section of the gas port device (taken along section line AA-AA).
Figure 25B:
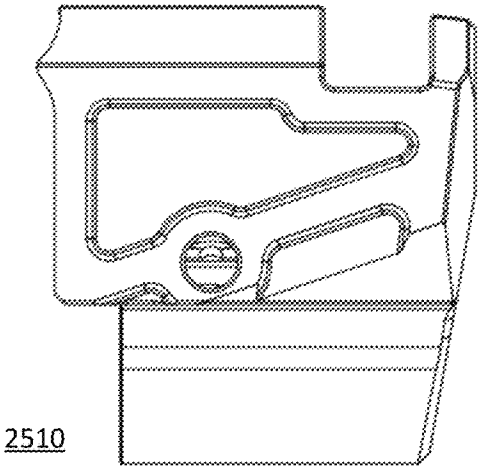
Figure 25C:
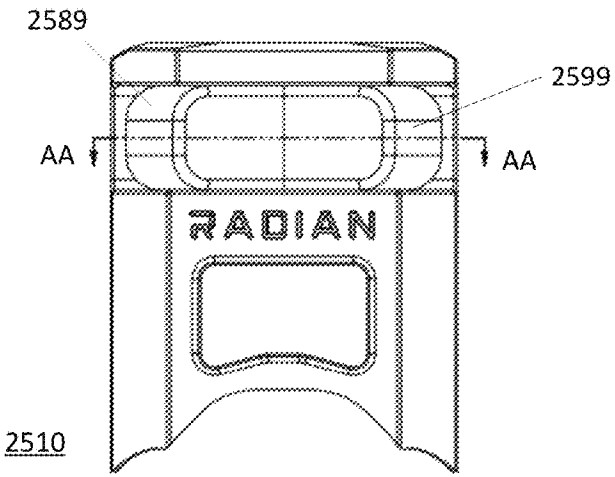
Figure 25D:
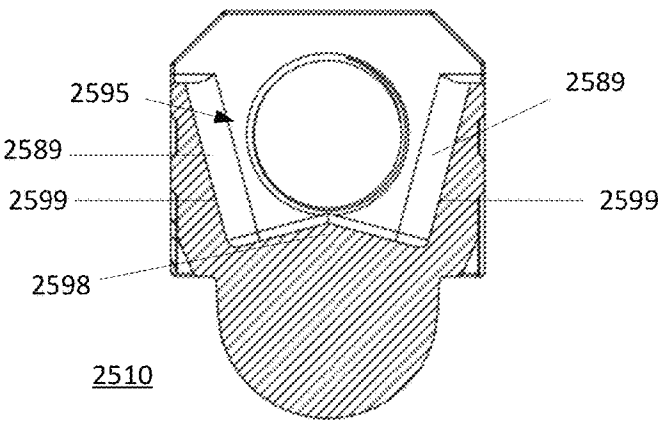

FIG. 25A illustrates an isometric view of a gas port device 2510 including a muzzle-fed gas port having gas flow-directing sections. The gas port device 2510 may be arranged to thread onto a typical threaded barrel using the illustrated threading. FIG. 25B illustrates a side view of the gas port device 2510, and FIG. 25C illustrates a top view of the gas port device 2510. FIG. 25D illustrates a section of the gas port device (taken along section line AA-AA of FIG. 25C).

An optimized geometry of the cavity 2595 is shown in the front section view (taken along section line AA-AA). In particular, an interior of the gas port device 2510 defining a cavity 2595 may include gas flow-directing sections to quickly redirect gas exiting the barrel (e.g., exiting the muzzle in this example) out the cavity 2595.

The gas flow-directing sections may include one or more projections 2598 extending toward the gas source (e.g., the muzzle in this embodiment). Projection 2598 may reduce an amount of time it takes for a portion of the gas to travel through the gas port device 2510. In this example, the illustrated projection 2598 defines a bottom surface of the cavity 2595, but in other examples projection(s) may be define other surfaces of the cavity 2595.

Sides 2599 of the cavity 2595 may also define gas flow-directing sections. A bottom part of the sides 2599 may receive and redirect gas exiting below a threshold part of the muzzle (e.g., below a centerline of the barrel, i.e. from a bottom half of the bore) before a top part of the sides 2599 may receive and redirect gas exiting above the threshold part of the muzzle. This may reduce the amount of time for gas to travel through the gas port device 2510, which may be beneficial for recoil reduction.

In this example, the sides 2599 have a linear slope, but in other examples the slope may be non-linear (e.g., curved). In this example, the gas flow-directing sections of the sides 2599 extend from a top of the cavity 2595 to a bottom of the cavity 2595, but in other examples a gas flow-directing section may extend to/from some other part of the sides of the cavity 2595. For instance, in some other example the sloped section could extend from an elevation corresponding to a centerline of the muzzle to a bottom of the cavity 2595. Also, in other examples a bottom of the cavity 2595 may be a bottom of the sides, such as in a V-shaped cavity.

In this embodiment, with reference to front, back, and sides of the cavity 2595, the gas flow-directing sections may be located exclusively on the sides (e.g., on sides 2599). This may provide a compact design that minimizes the added total length of a firearm using the gas port device 2510. In various embodiments, the front and back have a different slope than the sides 2599, e.g., may be vertical, may have some other slope that is different than the illustrated slope), may be undercut, or the like.

Also, in this embodiment, the front and back are parallel. Parallel faces may be vertical, as illustrated, or may have sloped sections by using an undercut feature on one of the front and back (a slope of any sloped sections of the front and back may be greater than a slope of the sidewalls 2599). In other embodiments, the front and back may not be parallel, and may be vertical and/or have gas flow-directing sections with the same or different slope than the sides 2599.

In the illustrated embodiments the gas flow-directing sections are integrally formed with the sides 2599. In other embodiments, in may be possible or practical to have gas flow-directing sections non-integrally formed with sides (e.g., affixed to sides).

Referring again to FIG. 25C, the cavity 2599 may include radii 2589 between the front/rear and the sides 2599, on either side of the gas flow-directing sections (the radii 2589 can also be seen in FIG. 25D). In other embodiments, these radii 2589 may be omitted (e.g., the gas flow-directing sections may extend the entire length of the cavity 2599).

FIGS. 26A-D show, respectively, an isometric view of a gas port device 2610, a side view of the gas port device 2610, a top view of the gas port device 2610, and a section of the gas port device 2610 (taken along section line BB-BB). This example gas port device 2610 is muzzle-fed because it receives gas exiting the muzzle.

In this example, the gas flow-directing section is a side segment 2699 of sides of the cavity 2695, e.g., it does not extend all the way from the top of the cavity 2695 to the bottom of the cavity 2695. Also, in this example, the cavity 2695 does not include the earlier-described projections (e.g., has a flat bottom).

Figure 27B:
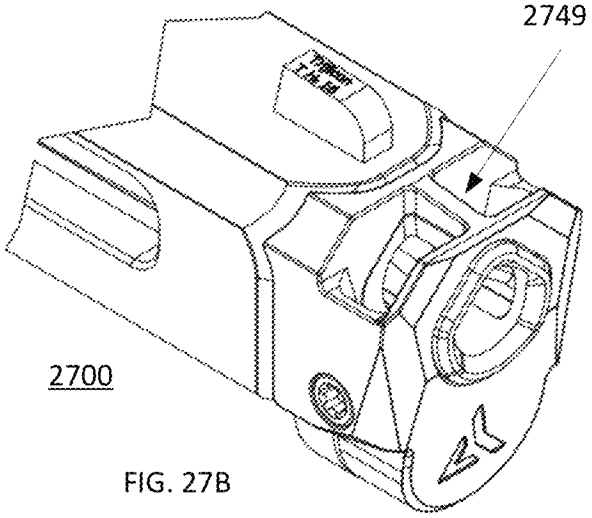
FIGS. 27A-C show, respectively, an exploded view, an isometric view, and a top view of a compensation assembly.
Figure 27A:
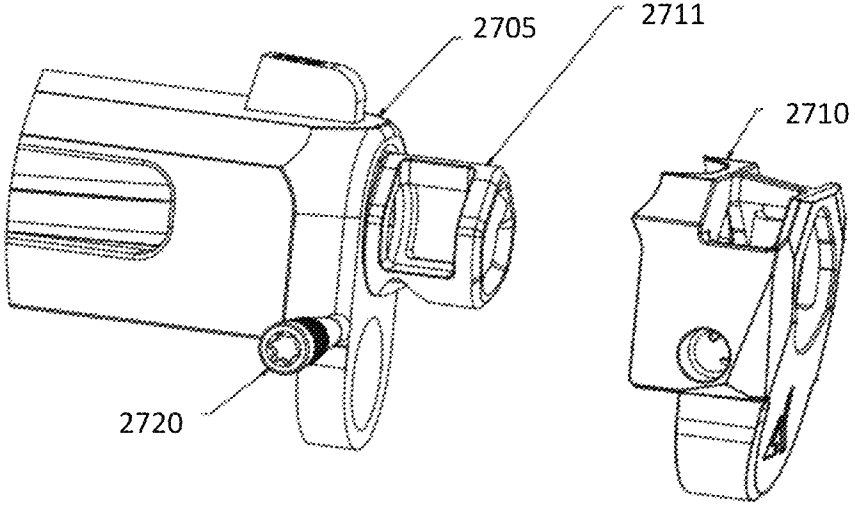
Figure 27C:
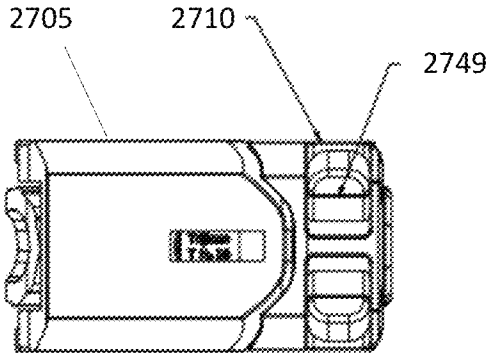

FIGS. 27A-C show, respectively, an exploded view, an isometric view, and a top view of a compensation assembly 2700. The compensation assembly 2700 includes a barrel 2711 operable with the slide 2705, and a gas port device 2710. The taper pin 2720 may be similar in any respect to the taper pin 1720 (FIGS. 17F). This example gas port device 2710 is barrel egress-fed because it receives gas exiting an egress in a length of the barrel 2711.

Figure 27E:
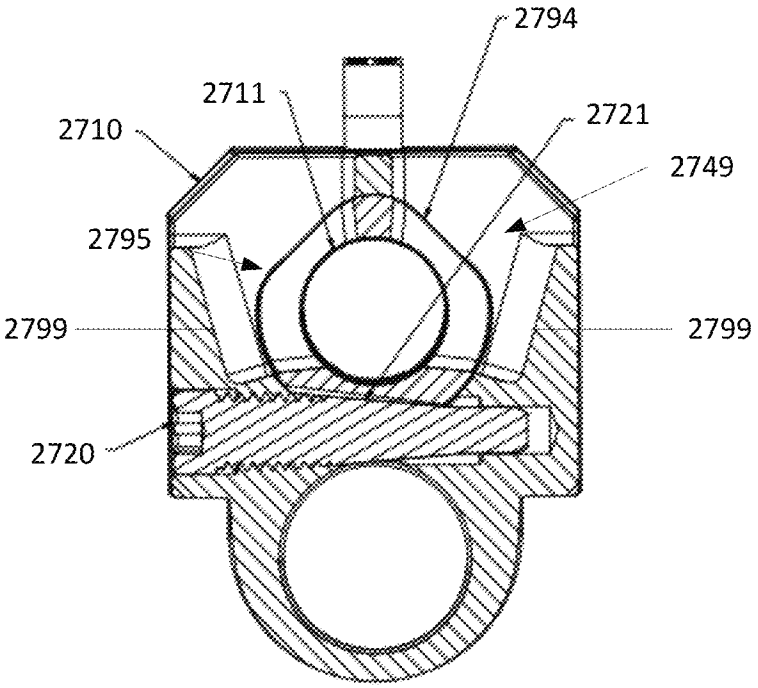
FIGS. 27D-E show, respectively, a side view and a section of the compensation assembly (taken along section line CC-CC) of the compensation assembly of FIGS. 27A-C.
Figure 27D:
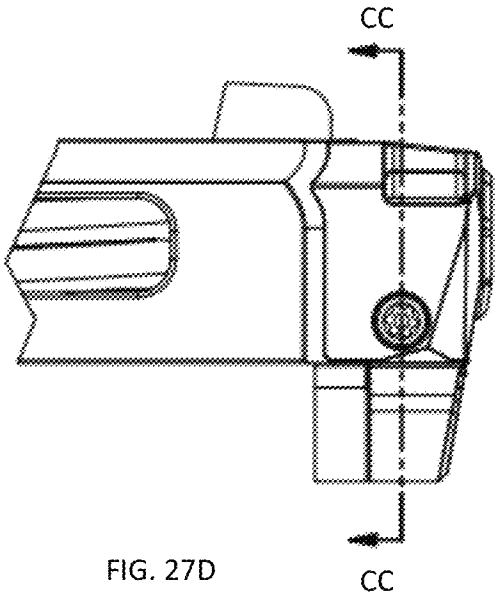

FIGS. 27D-E show, respectively, a side view and a section of the compensation assembly 2700 (taken along section line CC-CC) of the compensation assembly 2700 of FIGS. 27A-C. This gas port 2749 is formed by the egress 2794 of the barrel 2711 and the cavity defined by the gas port device 2710, similar to the gas port 1749 (FIG. 17B). A cavity 2795 to redirect gas exiting the barrel egress 2794 includes gas flow-directing sections on sides 2799, similar in any respect to the gas flow-directing sections of the sides 2599 of the cavity 2595 (FIG. 25D).

The egress 2794 in the length of the barrel 2711 extends below the centerline of the barrel 2711 in this embodiment. The gas flow-directing sections of the sides 2799 in this embodiment are arranged to operate on the portion of the gas that is released from the lower portion of the egress 2794 (the part that extends below the centerline of the barrel 2711).

It is noted that the taper pin 1720 and the taper interface 1721 are one example of an attachment mechanism for this gas port 2710. Other embodiments may include any other attachment mechanisms, now known or later developed.

Figure 28B:
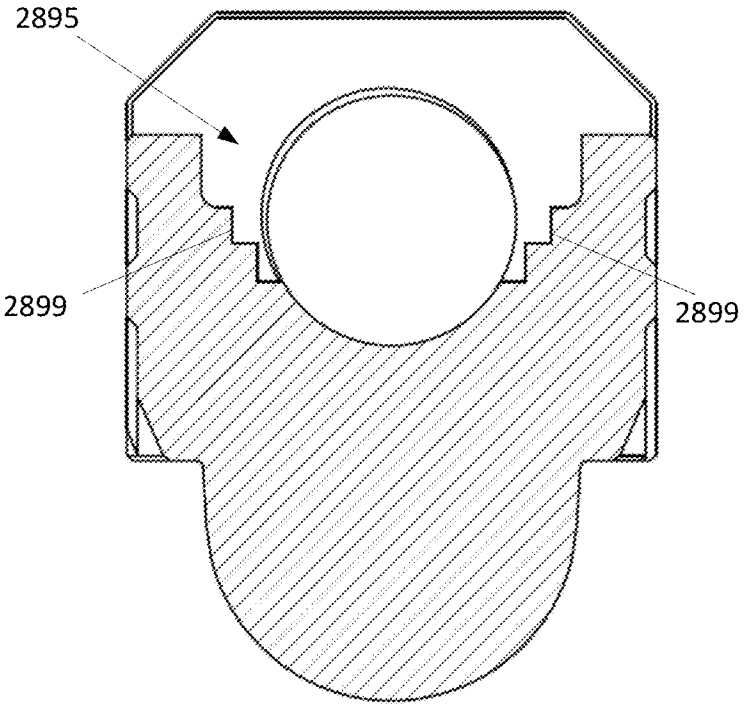
FIGS. 28A and 28B show, respectively, a top view and a section view of another gas port device, in which the section view is taken along section line DD-DD of FIG. 28A, according to various embodiments.
Figure 28A:
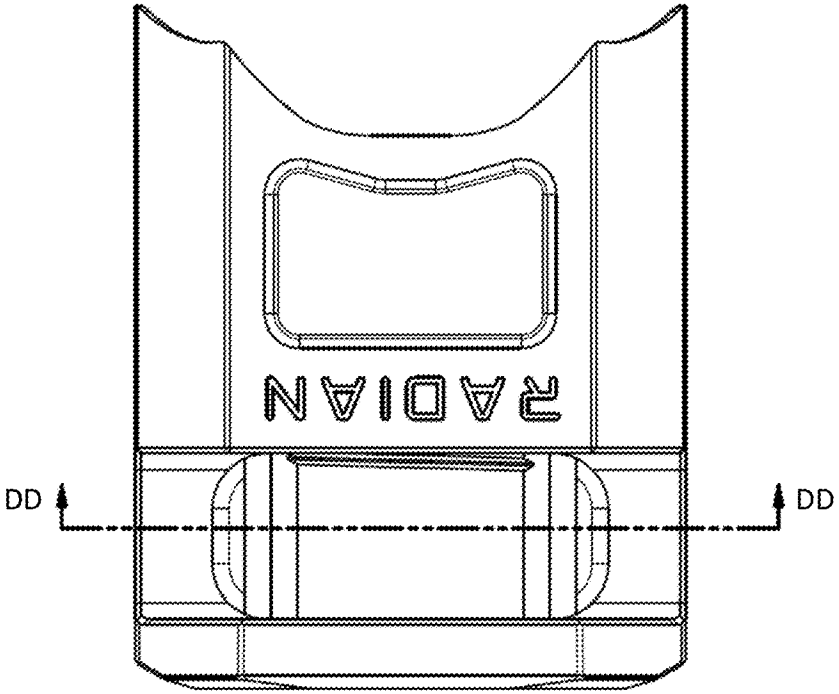

FIGS. 28A and 28B show, respectively, a top view and a section view of another gas port device 2810, in which the section view is taken along section line DD-DD of FIG. 28A, according to various embodiments. This gas port device 2810, like gas port device 2610 of FIGS. 26A-D, is muzzle-fed.

Referring to FIG. 28B, an interior of the gas port device 2810 defining a cavity 2895 may quickly redirect gas exiting the barrel (e.g., exiting the muzzle in this example). Sides 2899 of the cavity 2895 have differently-sloped segments (e.g., stepped sides), which may define gas flow-directing sections that may receive and redirect gas exiting below a threshold part of the muzzle (e.g., below a centerline of the barrel, i.e. from a bottom half of the bore). Although differently-sloped segments include vertical sections in this illustrated embodiment, in other embodiments may include stepped sides with sloped side segments.

Figure 26A:
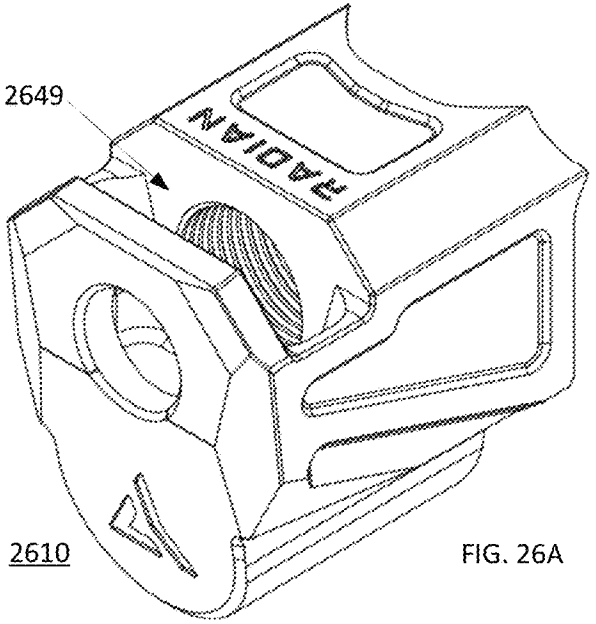
FIGS. 26A-D show, respectively, an isometric view of a gas port device, a side view of the gas port device, a top view of the gas port device, and a section of the gas port device (taken along section line BB-BB).
Figure 26B:
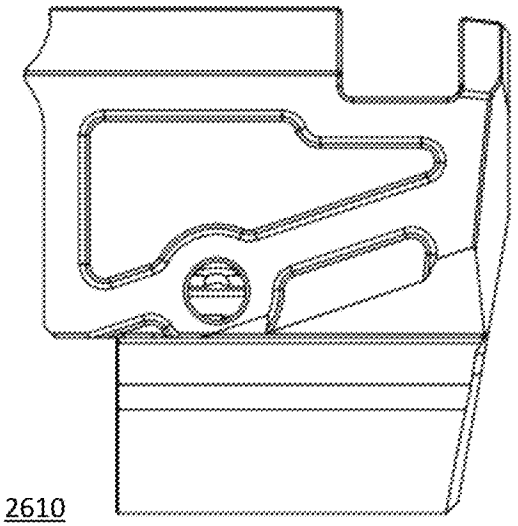
Figure 26C:
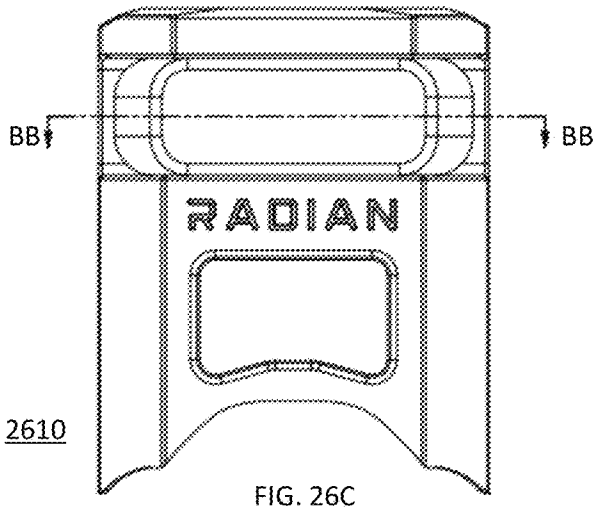
Figure 26D:
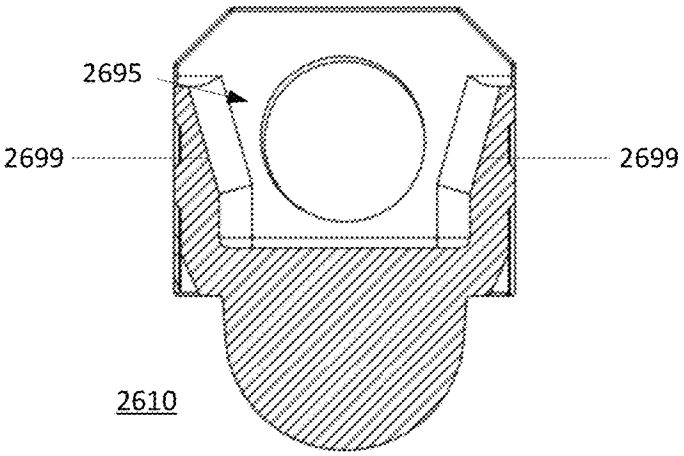
Figure 29B:
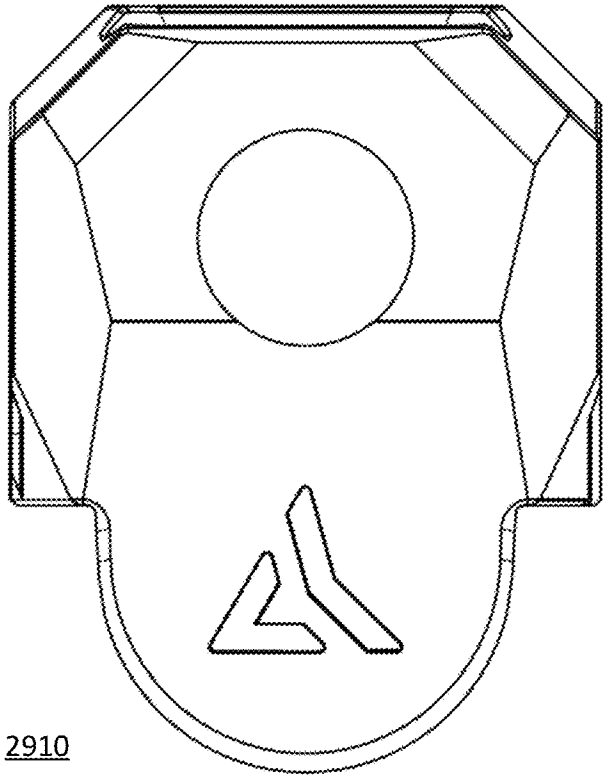
FIGS. 29A and 29B show, respectively, an isometric view and a front view of another gas port device, according to various embodiments.
Figure 29A:
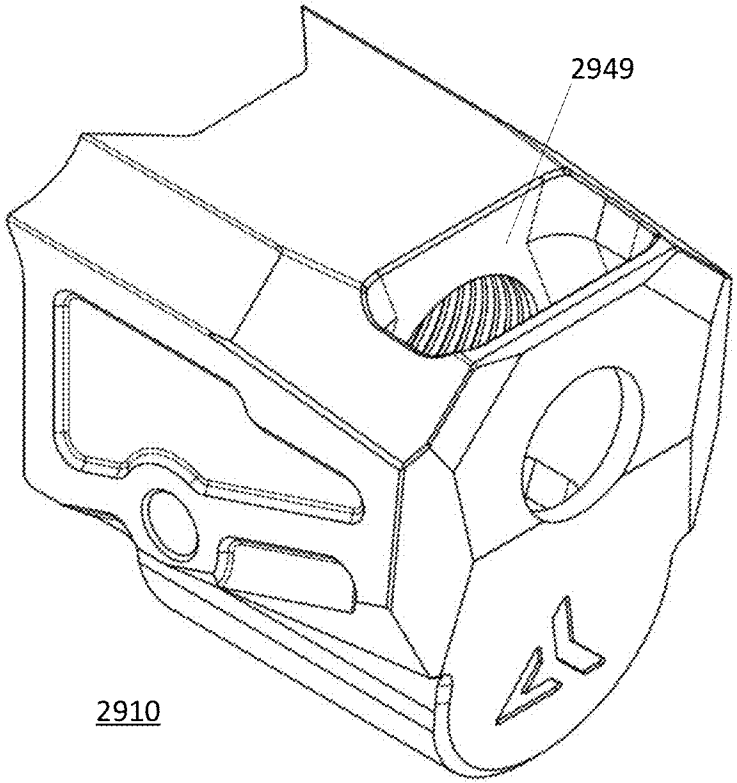
Figure 29D:
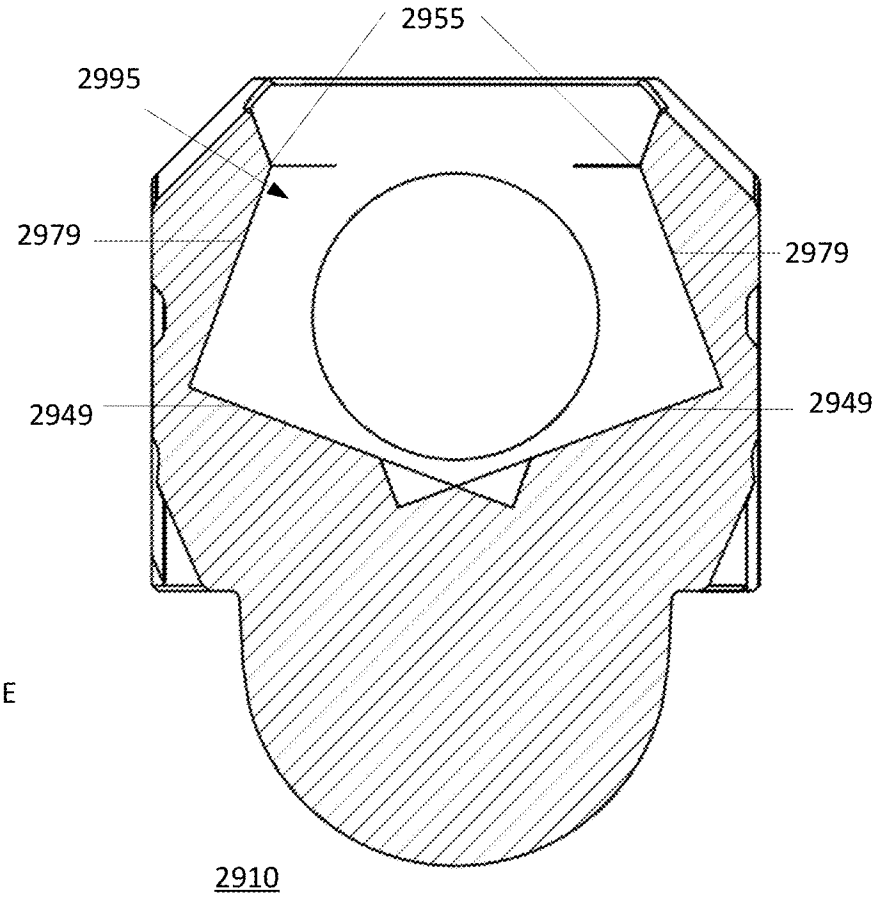
FIGS. 29C and 29D show, respectively, a top view and a section view of the gas port device of FIGS. 28A and 29B, in which the section view is taken along section line EE-EE of FIG. 29D.
Figure 29C:
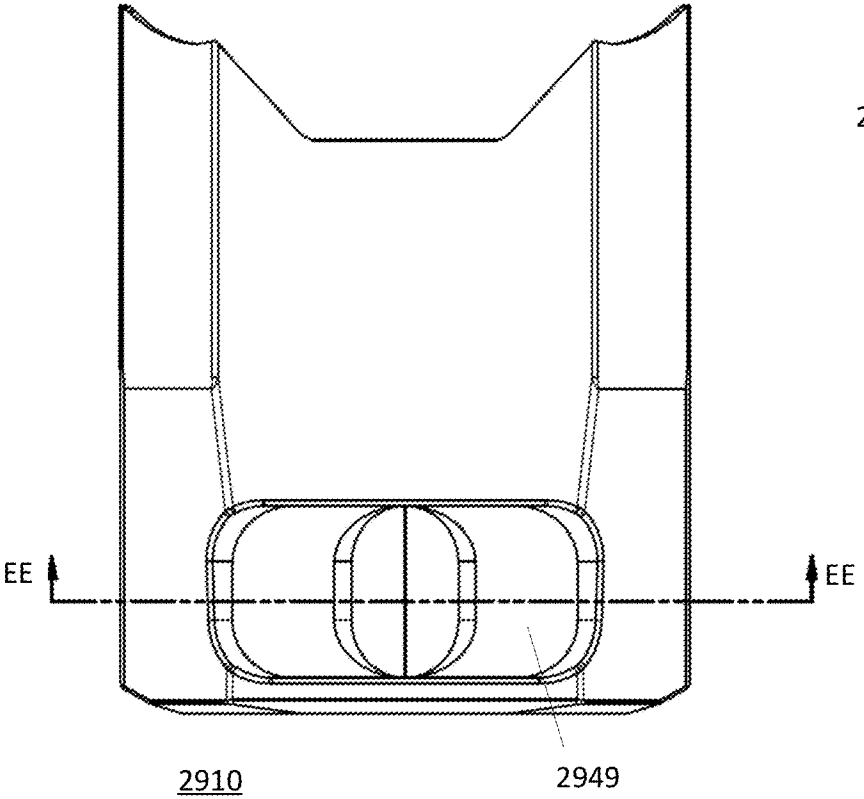
Figure 30:
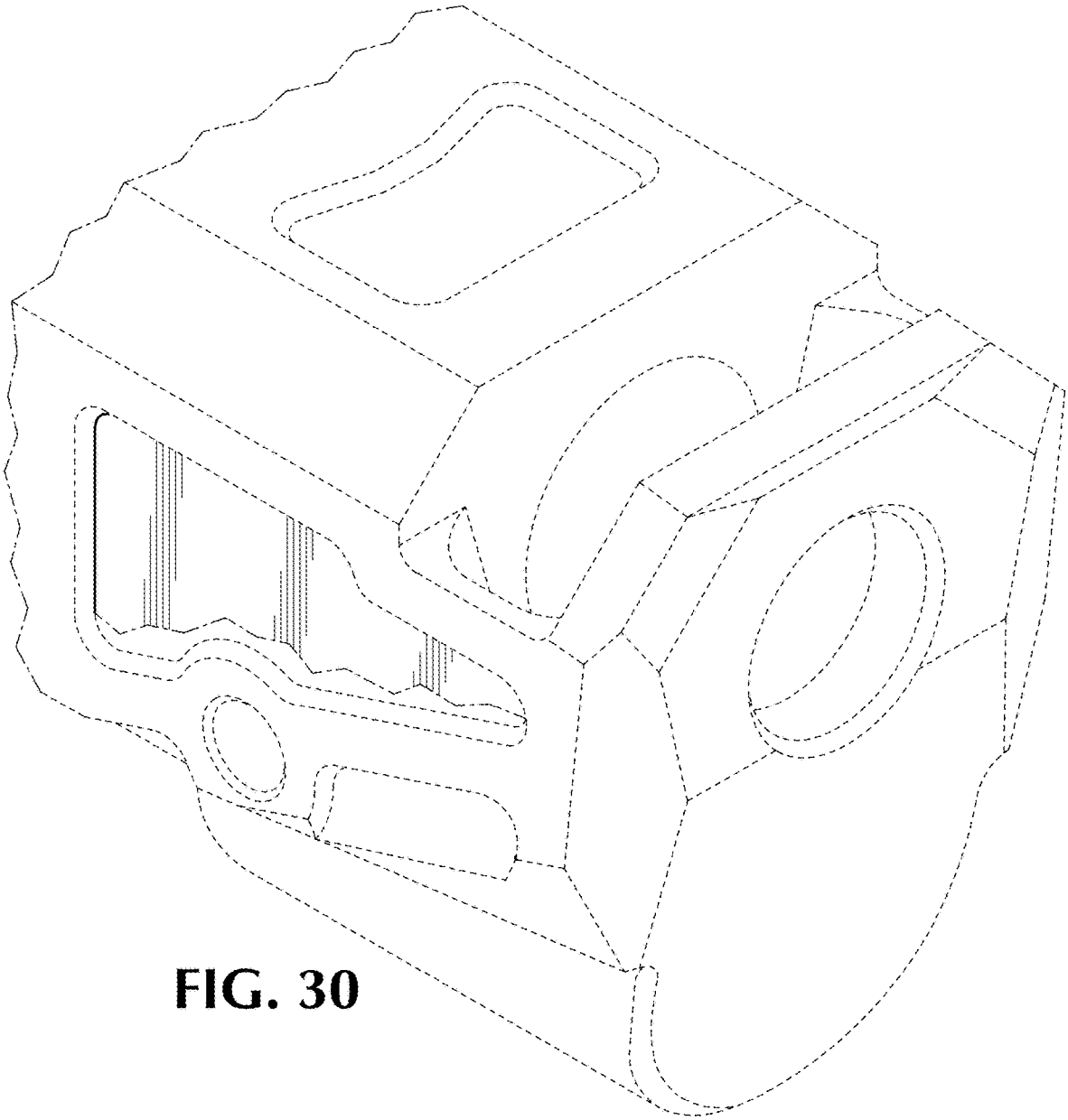
FIGS. 30-37 are a partial right isometric view, a partial left isometric view, a partial right side view, a partial left side view, a partial right isometric view, a partial left isometric view, a partial right side view, and a partial left side view, respectively, of a firearm, showing my design.
Figure 31:
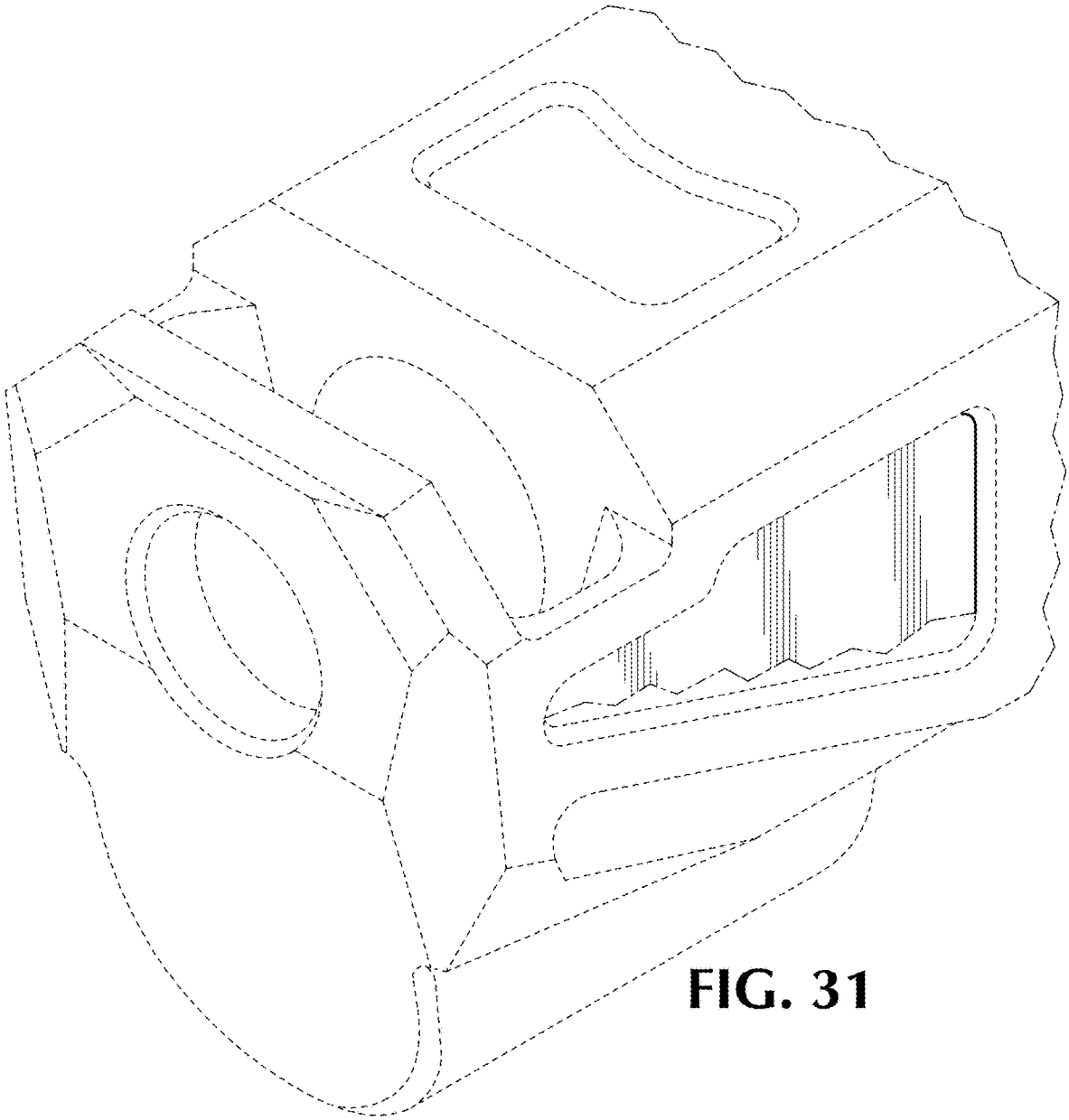
Figure 32:
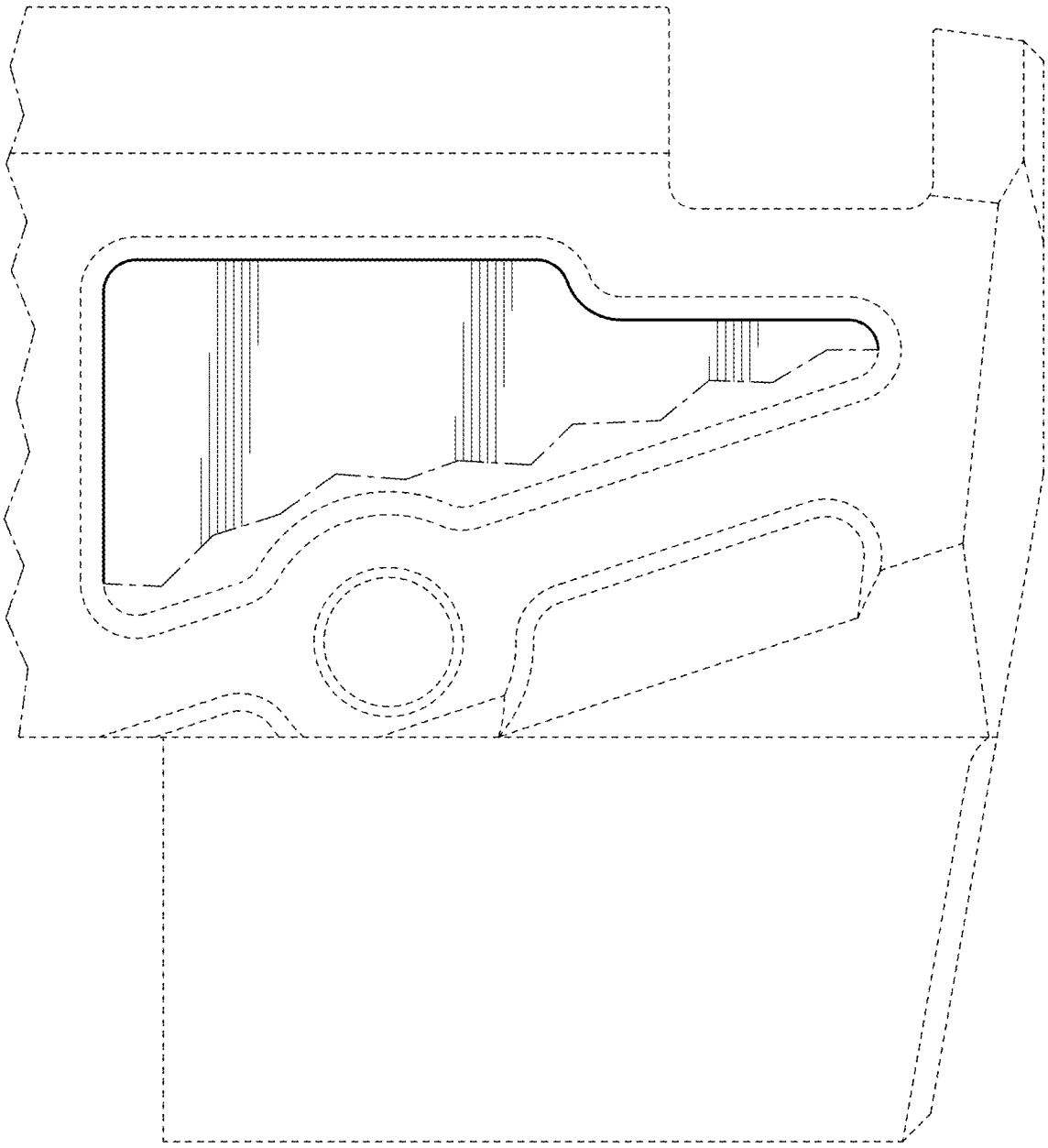
Figure 33:
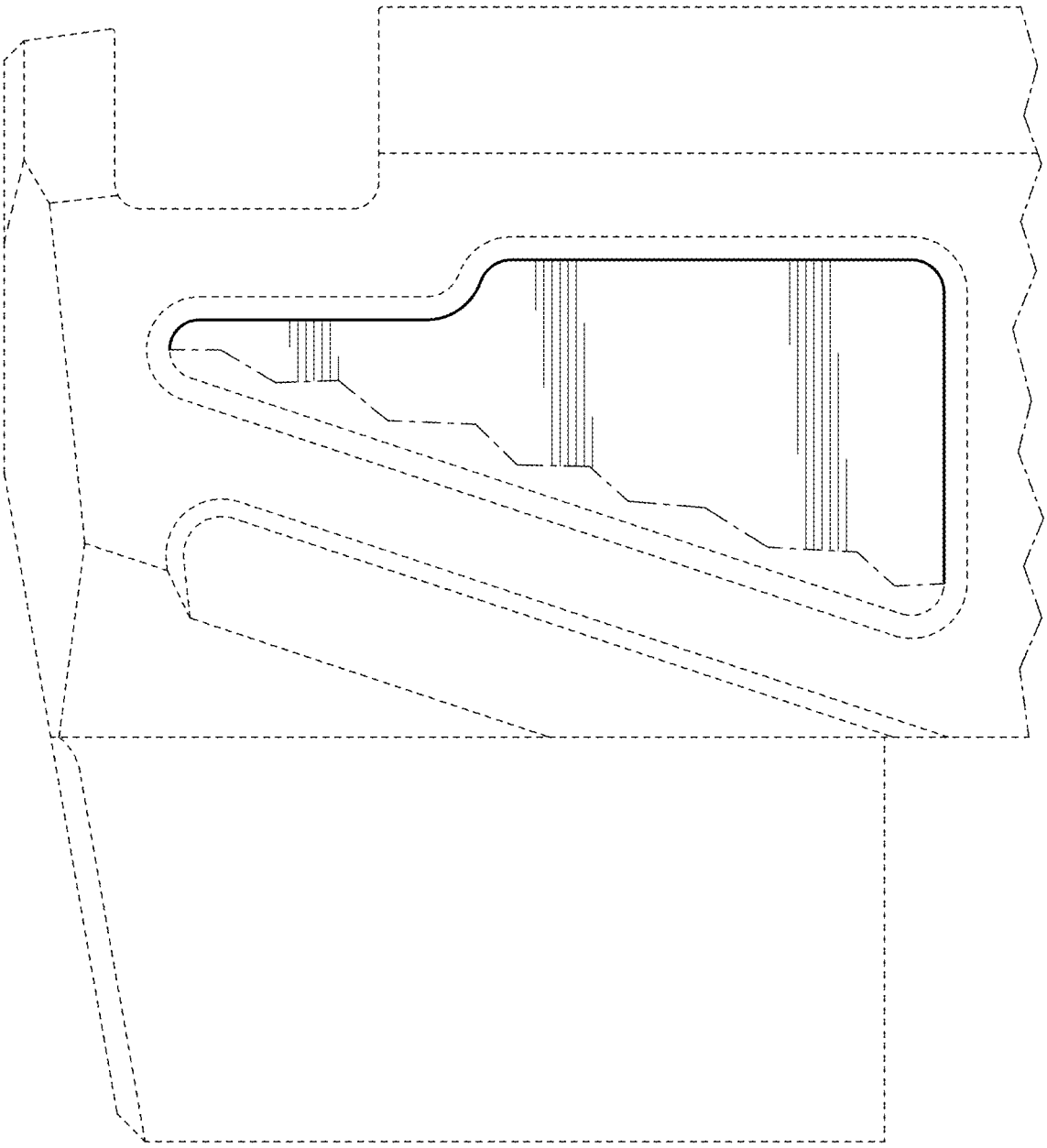
Figure 34:
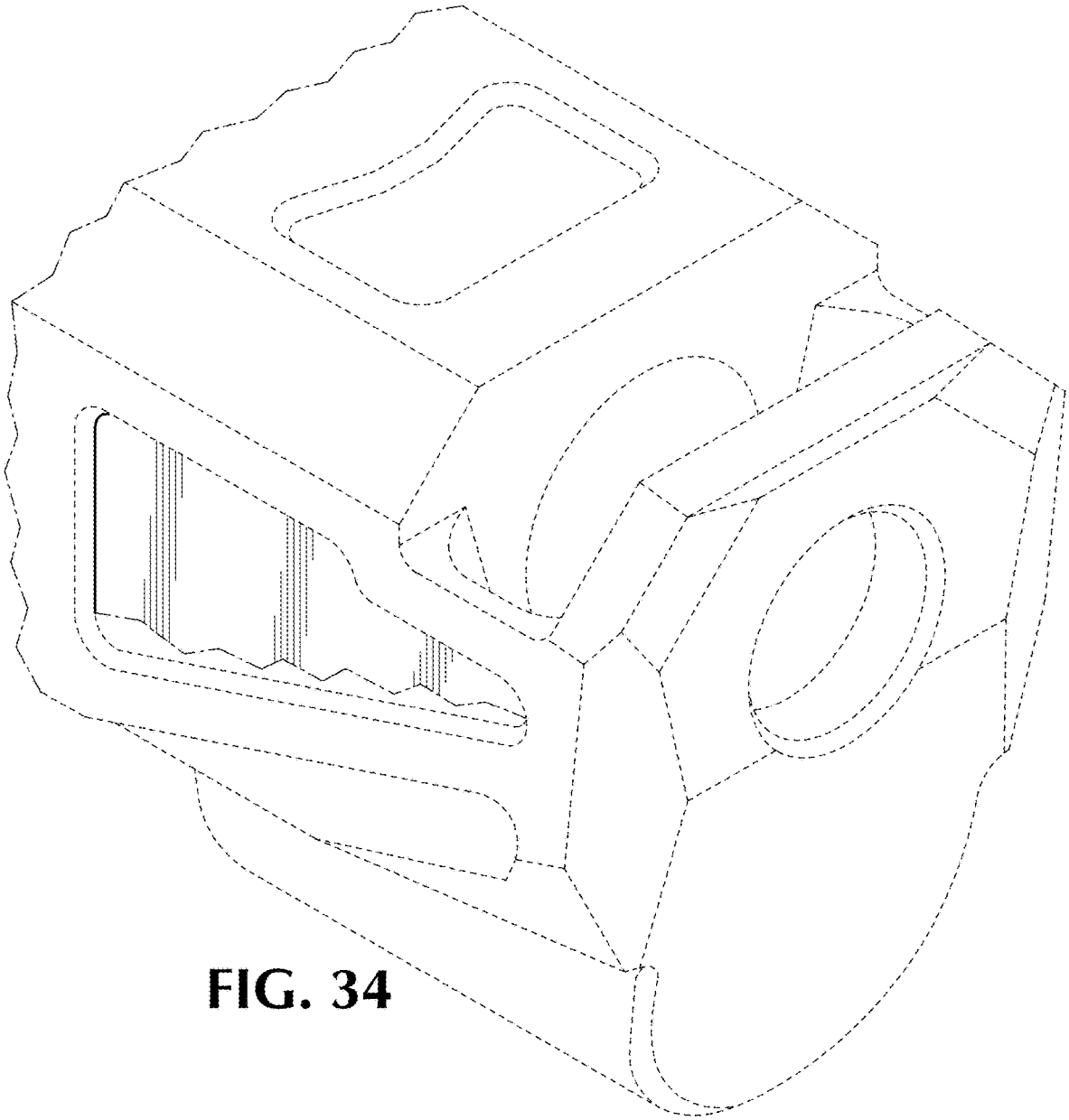
Figure 35:
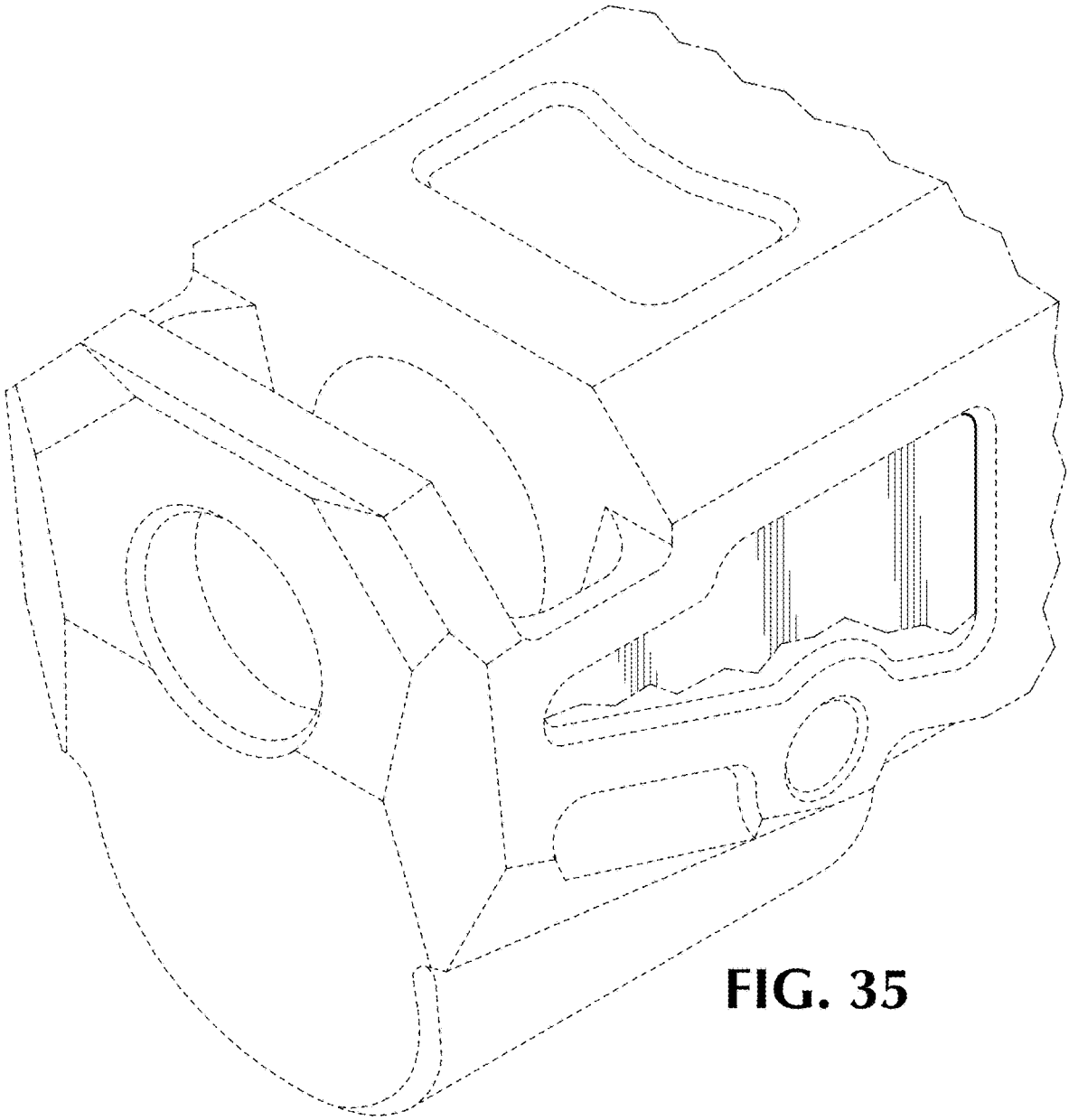
Figure 36:
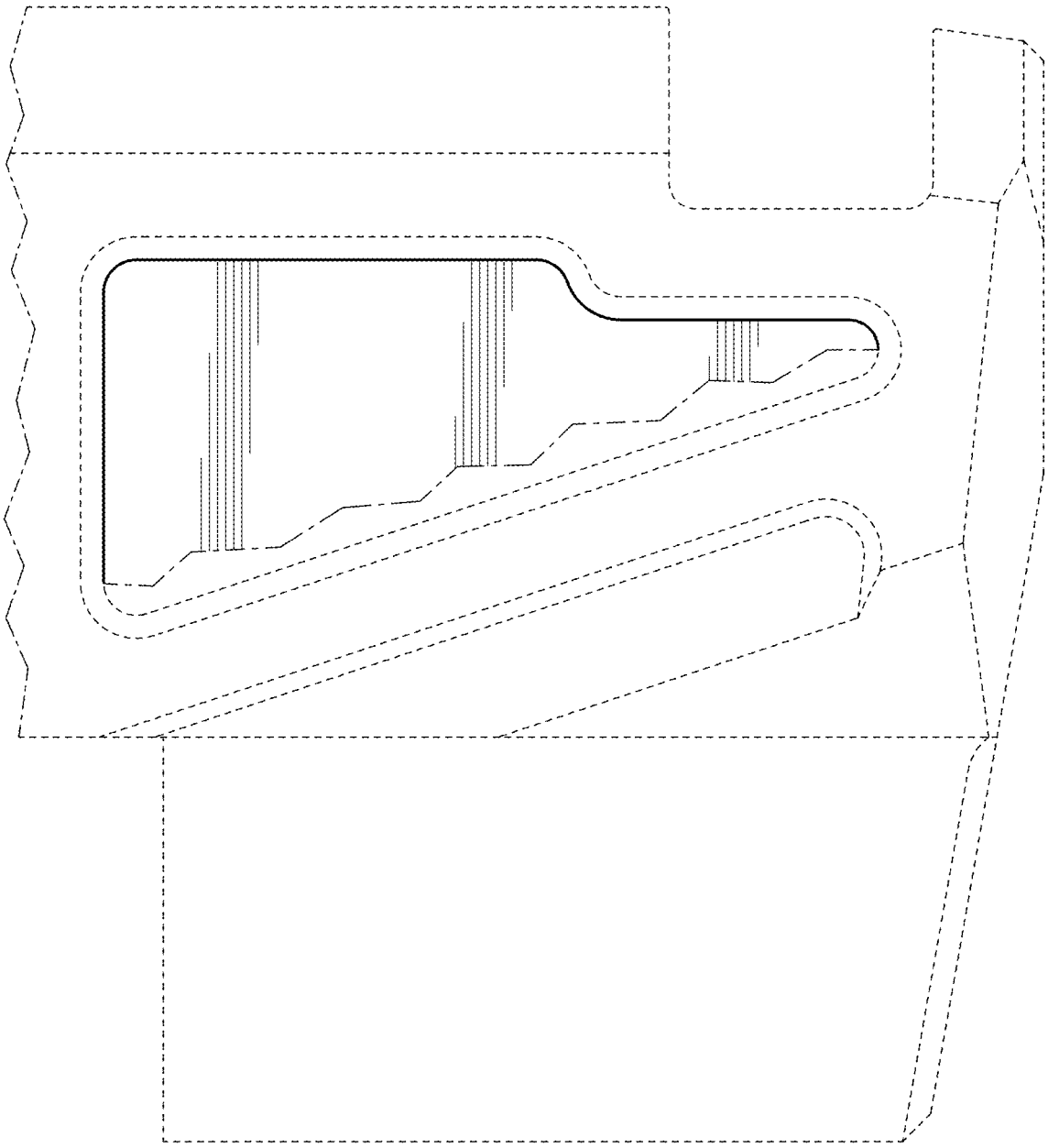
Figure 37:
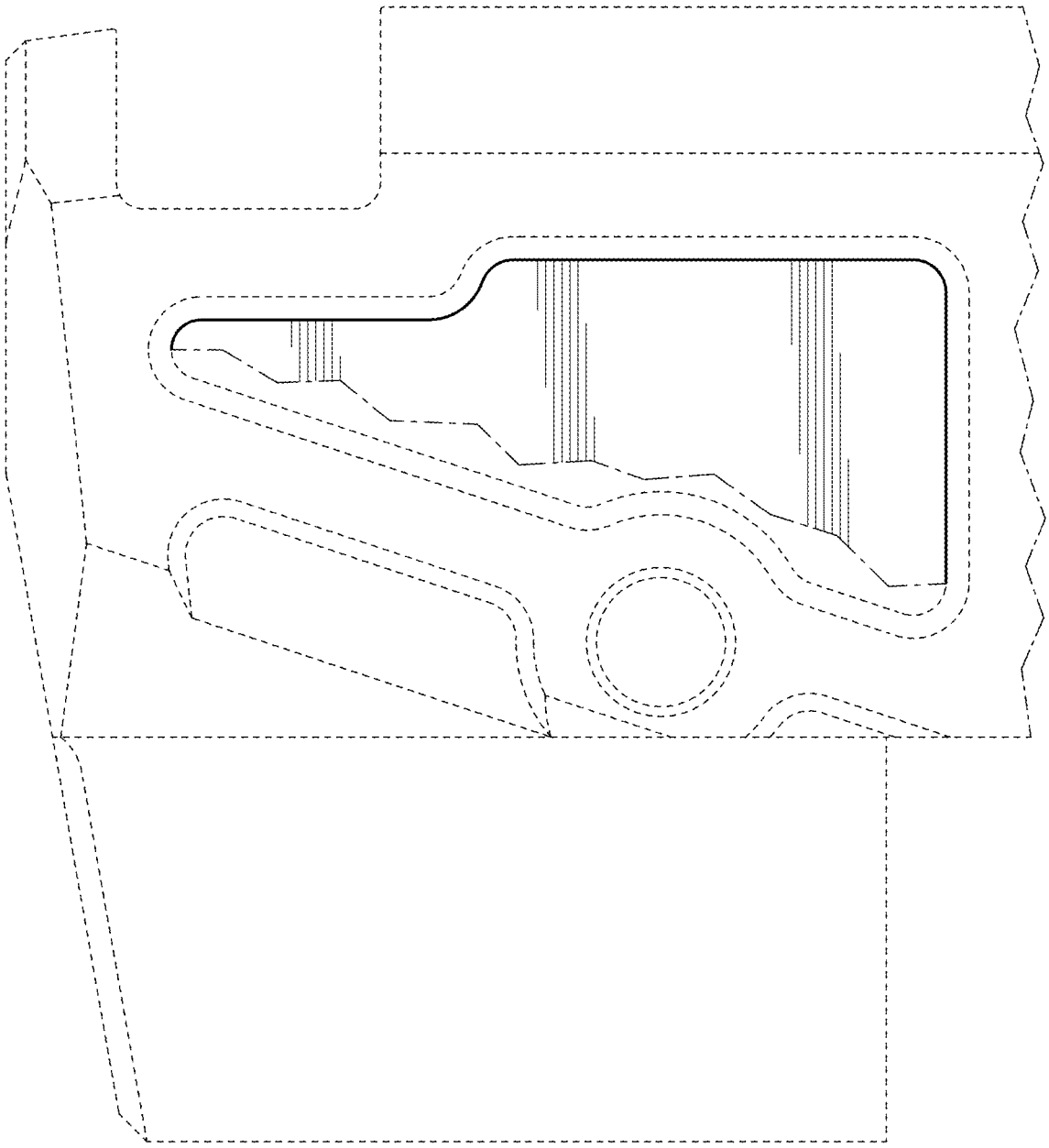
Figure 38:
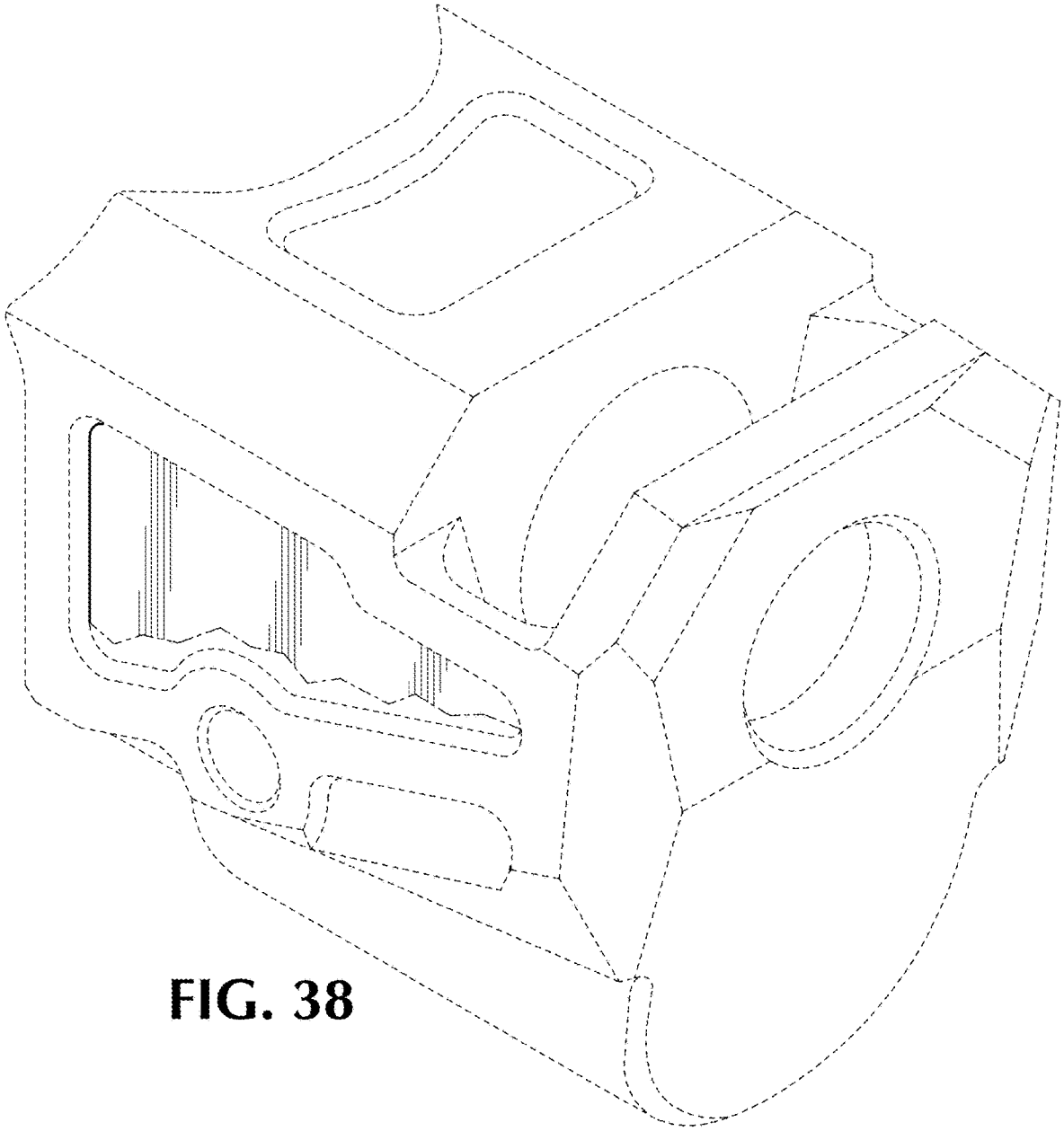
FIGS. 38-41 are a partial right isometric view, a partial left isometric view, a partial right side view, and a partial left side view, respectively, of a firearm, showing my design.
Figure 39:
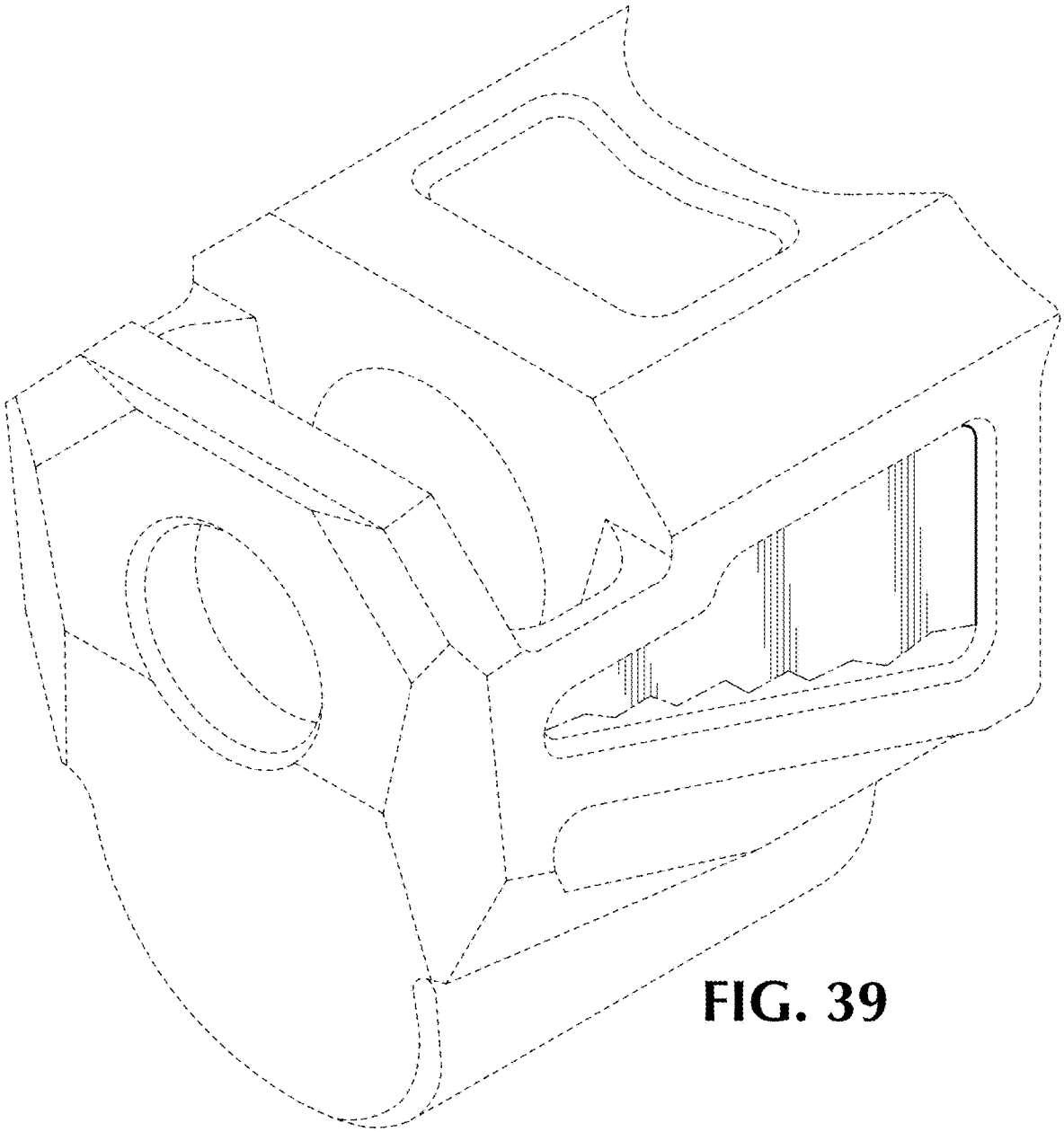
Figure 40:
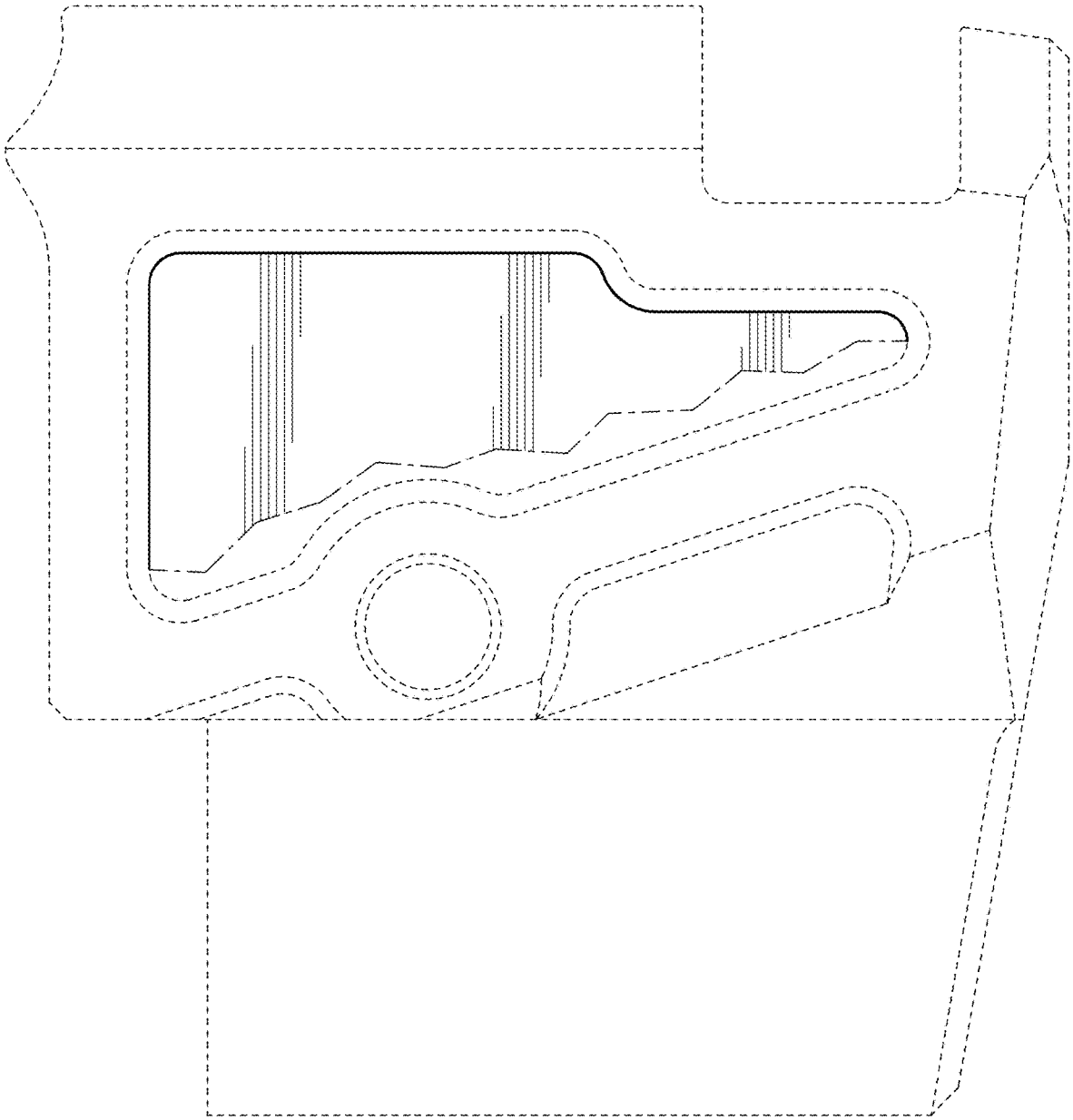
Figure 41:
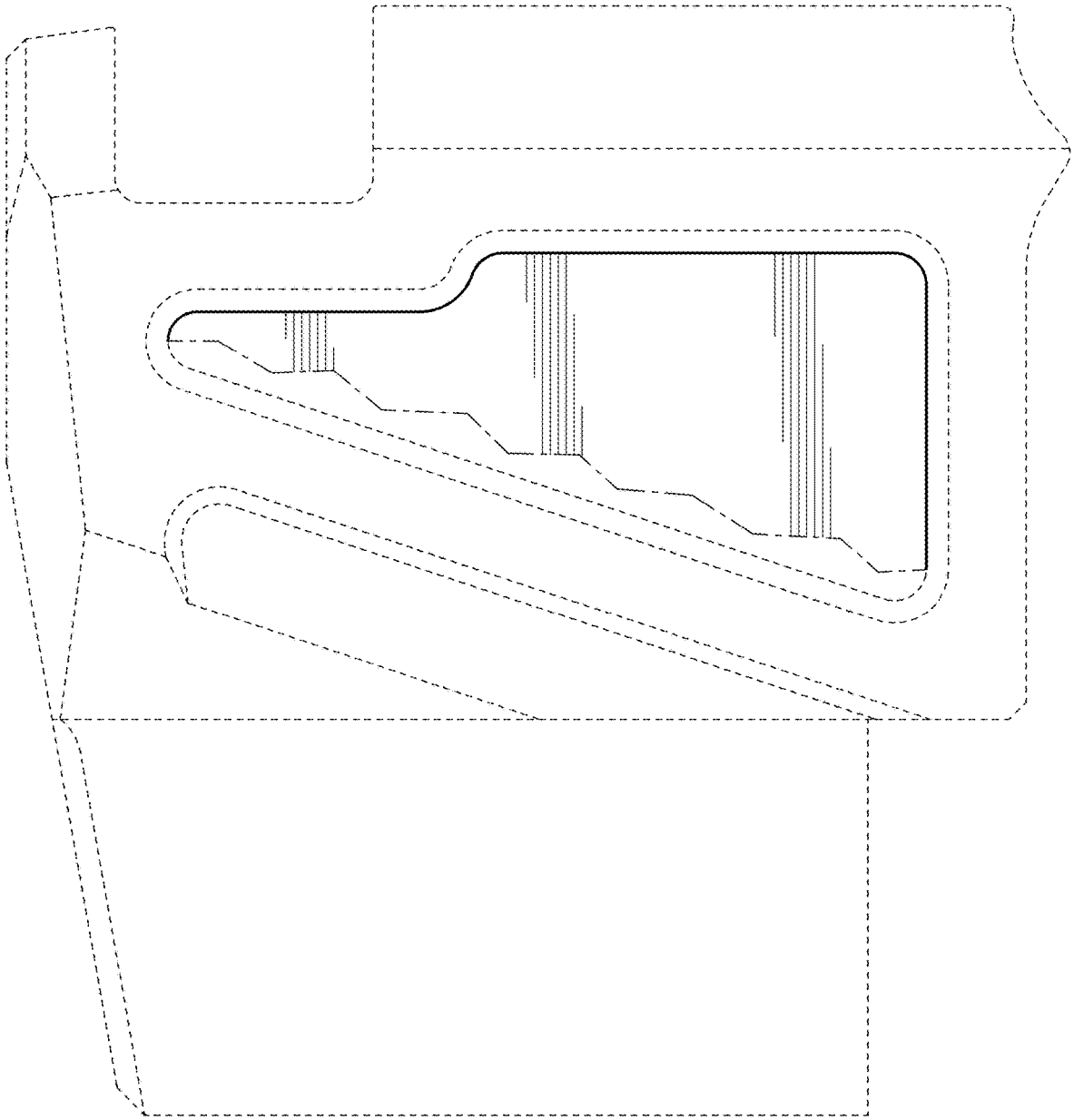
Figure 42:
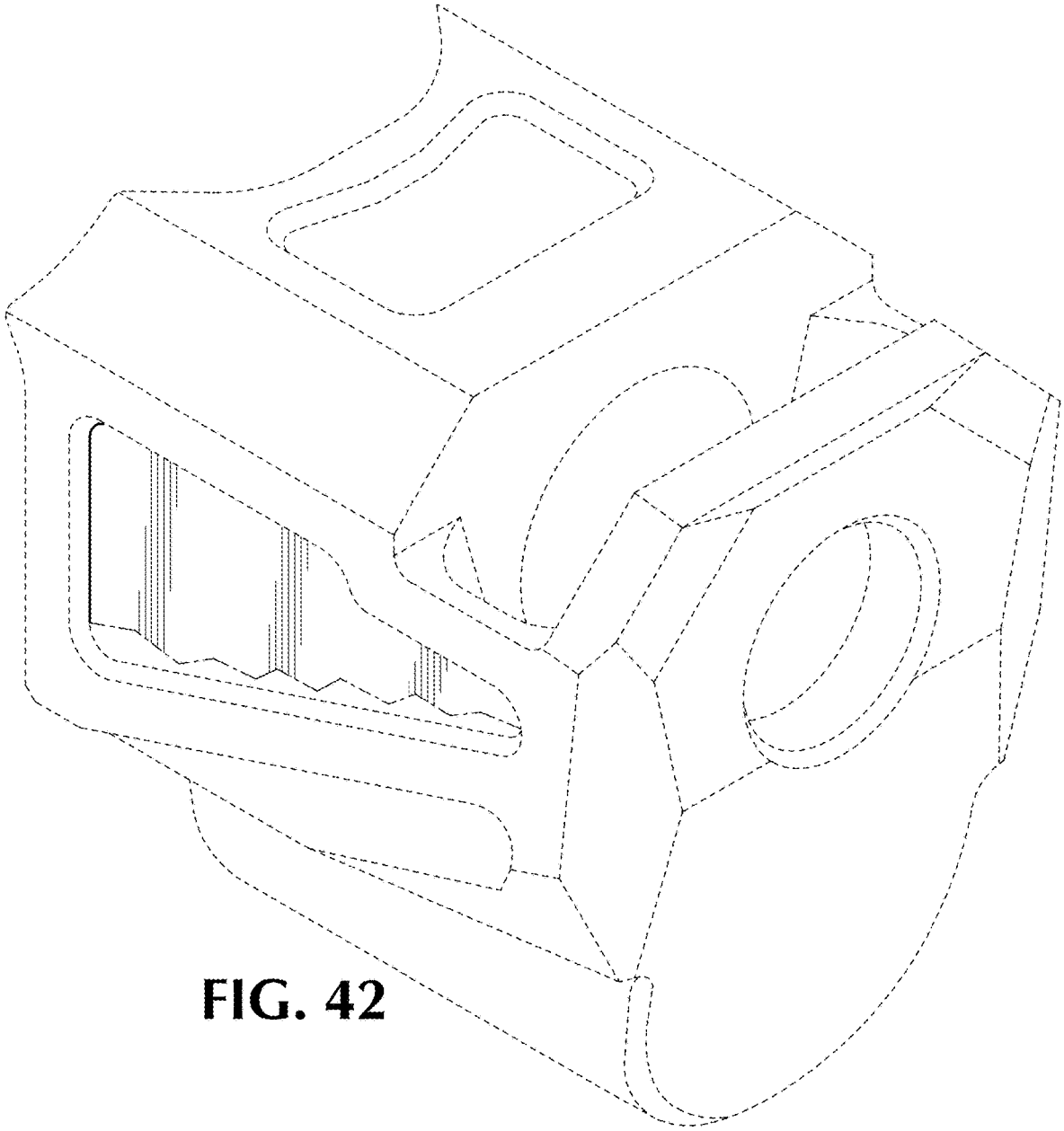
FIGS. 42-45 are a partial right isometric view, a partial left isometric view, a partial right side view, and a partial left side view, respectively, of a firearm, showing my design.
Figure 43:
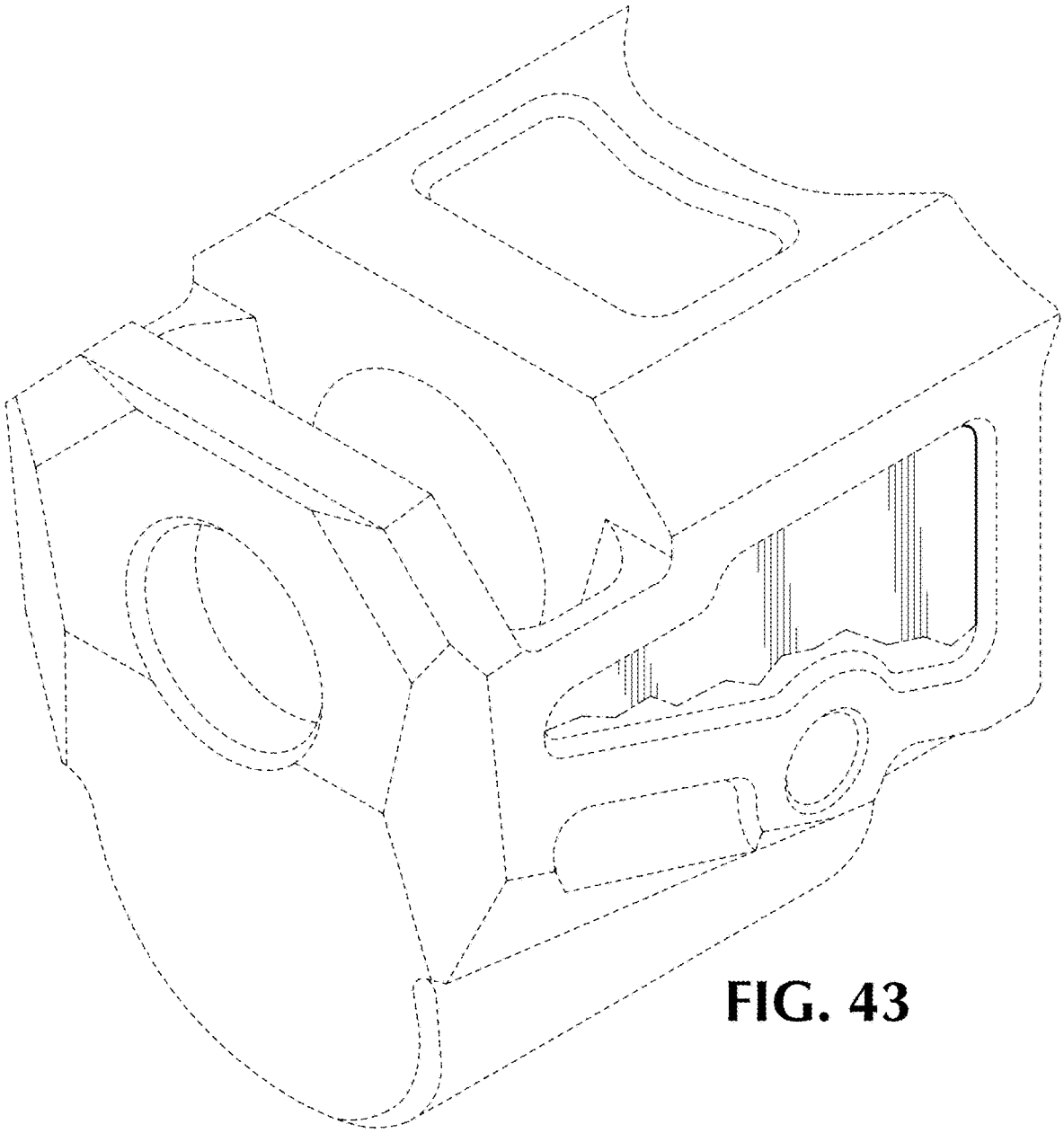
Figure 44:
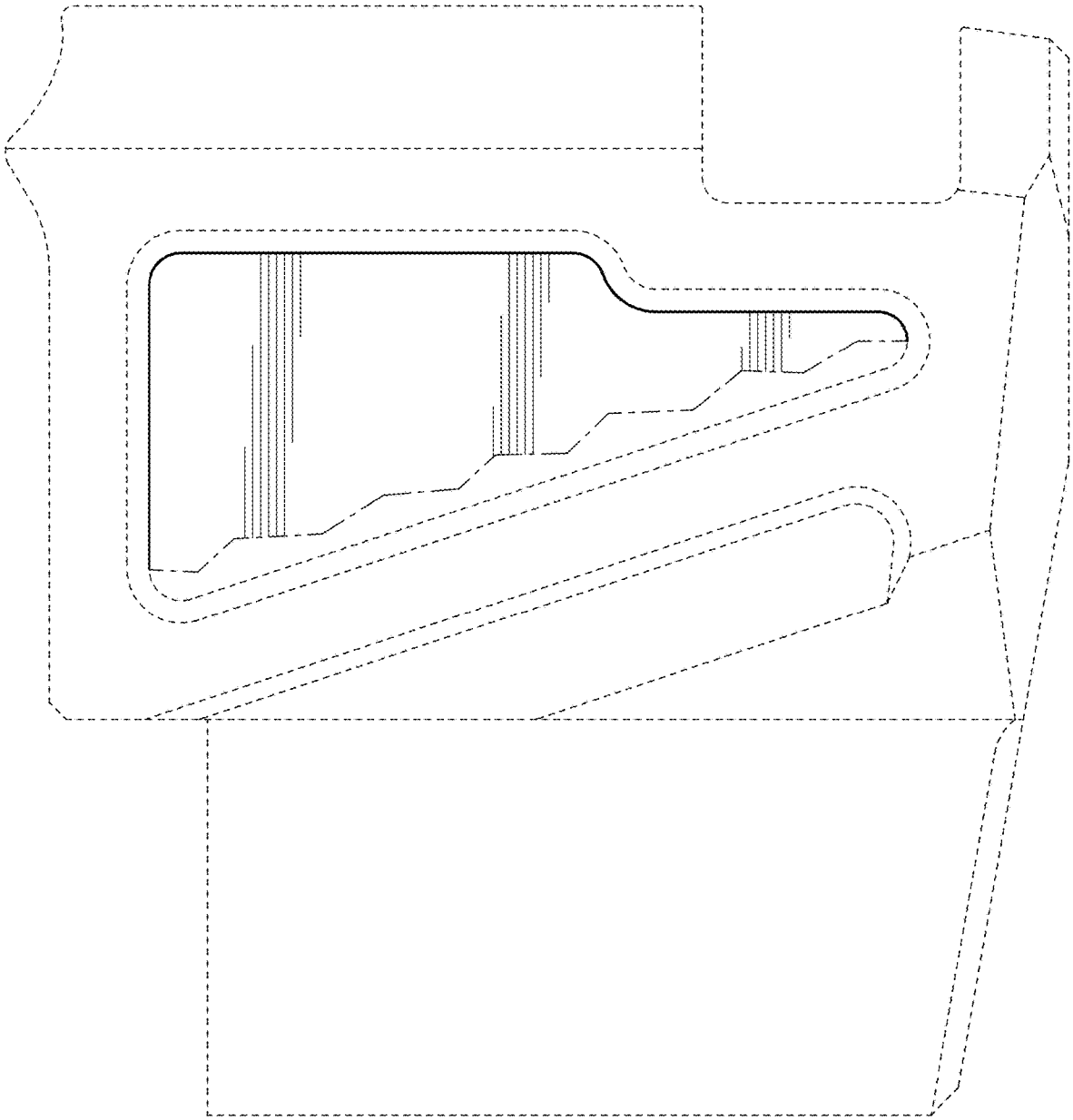
Figure 45:
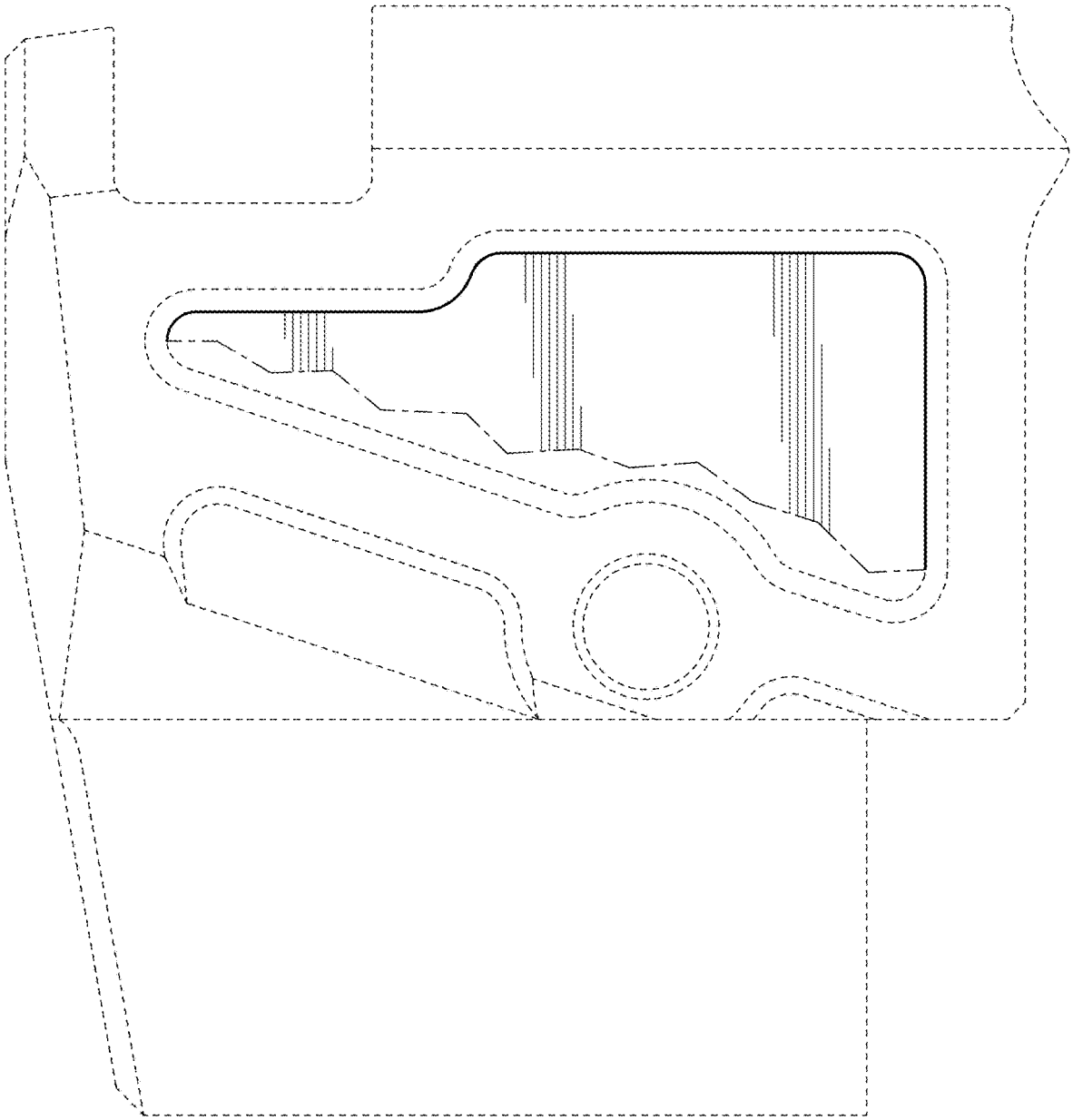
Figure 46:
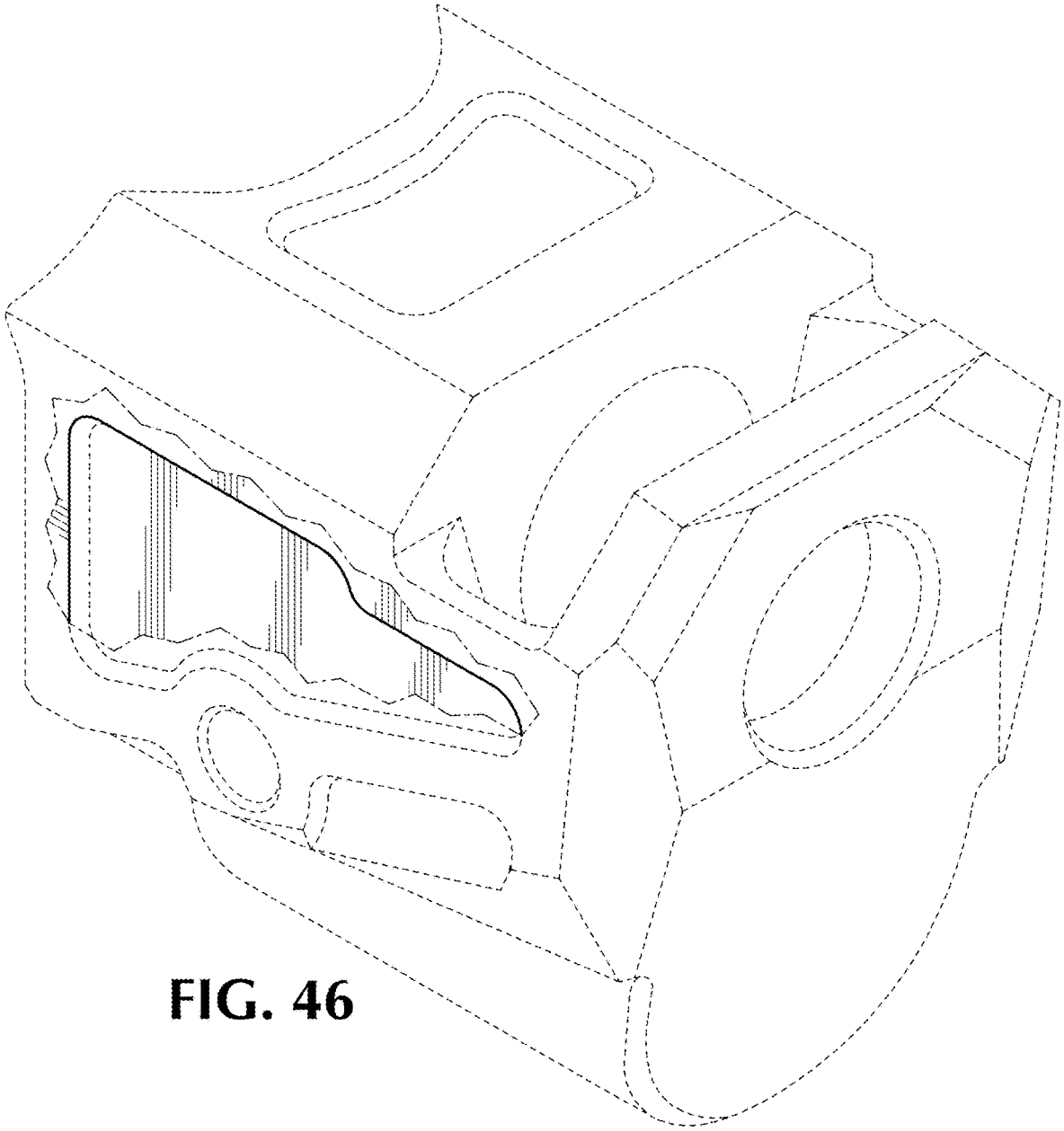
FIGS. 46-49 are a partial right isometric view, a partial left isometric view, a partial right side view, and a partial left side view, respectively, of a firearm, showing my design.
Figure 47:
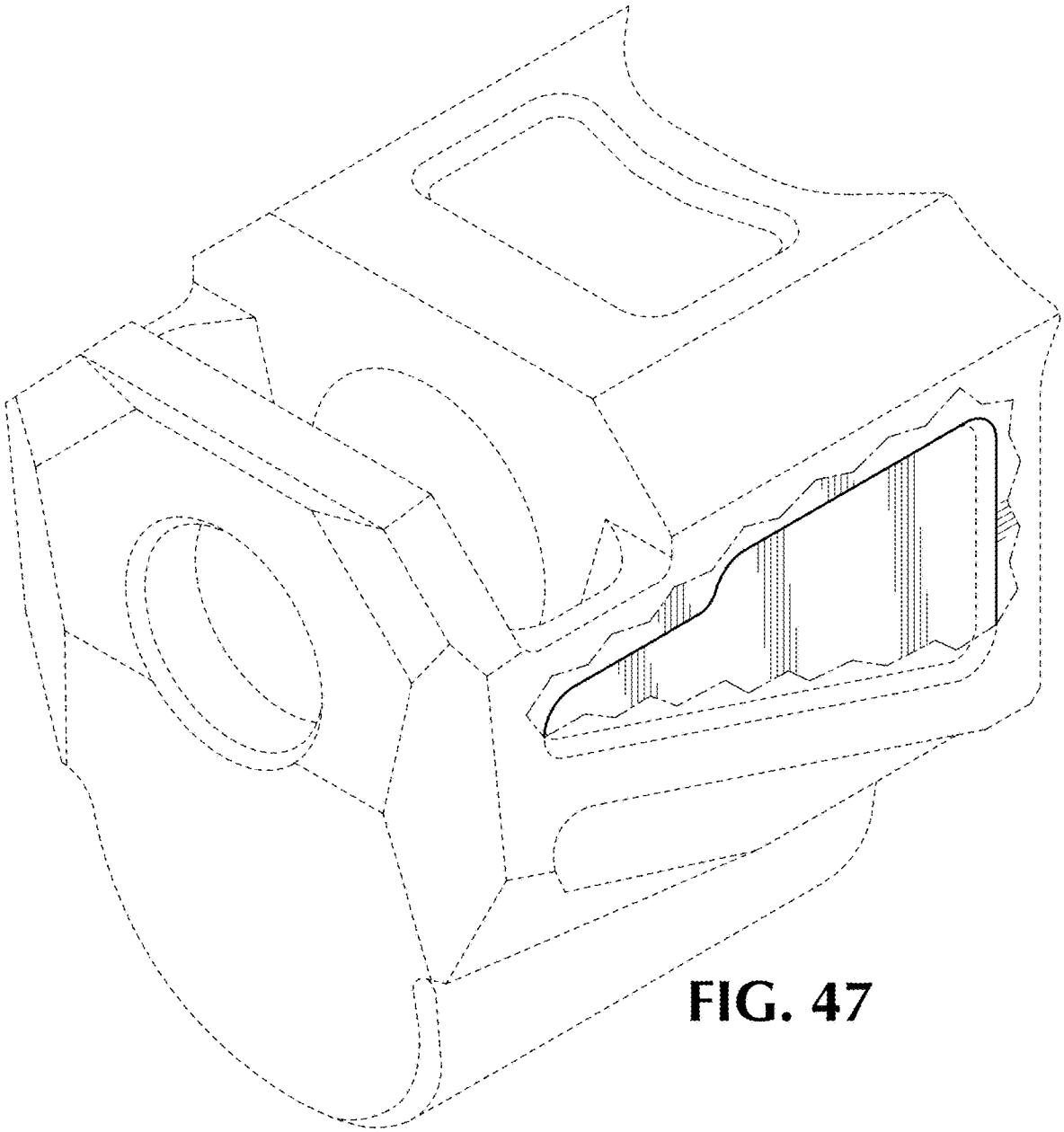
Figure 48:
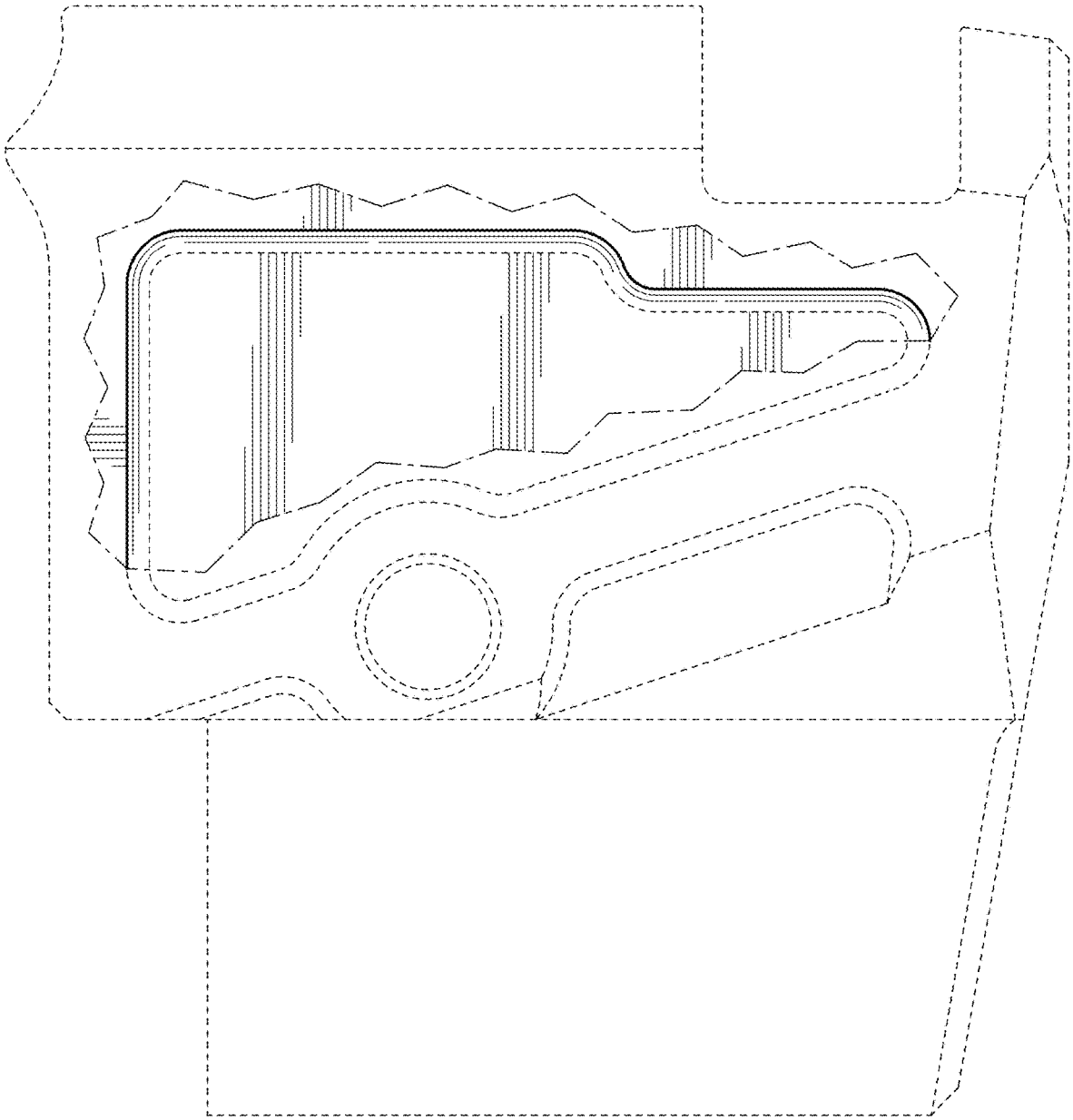
Figure 49:
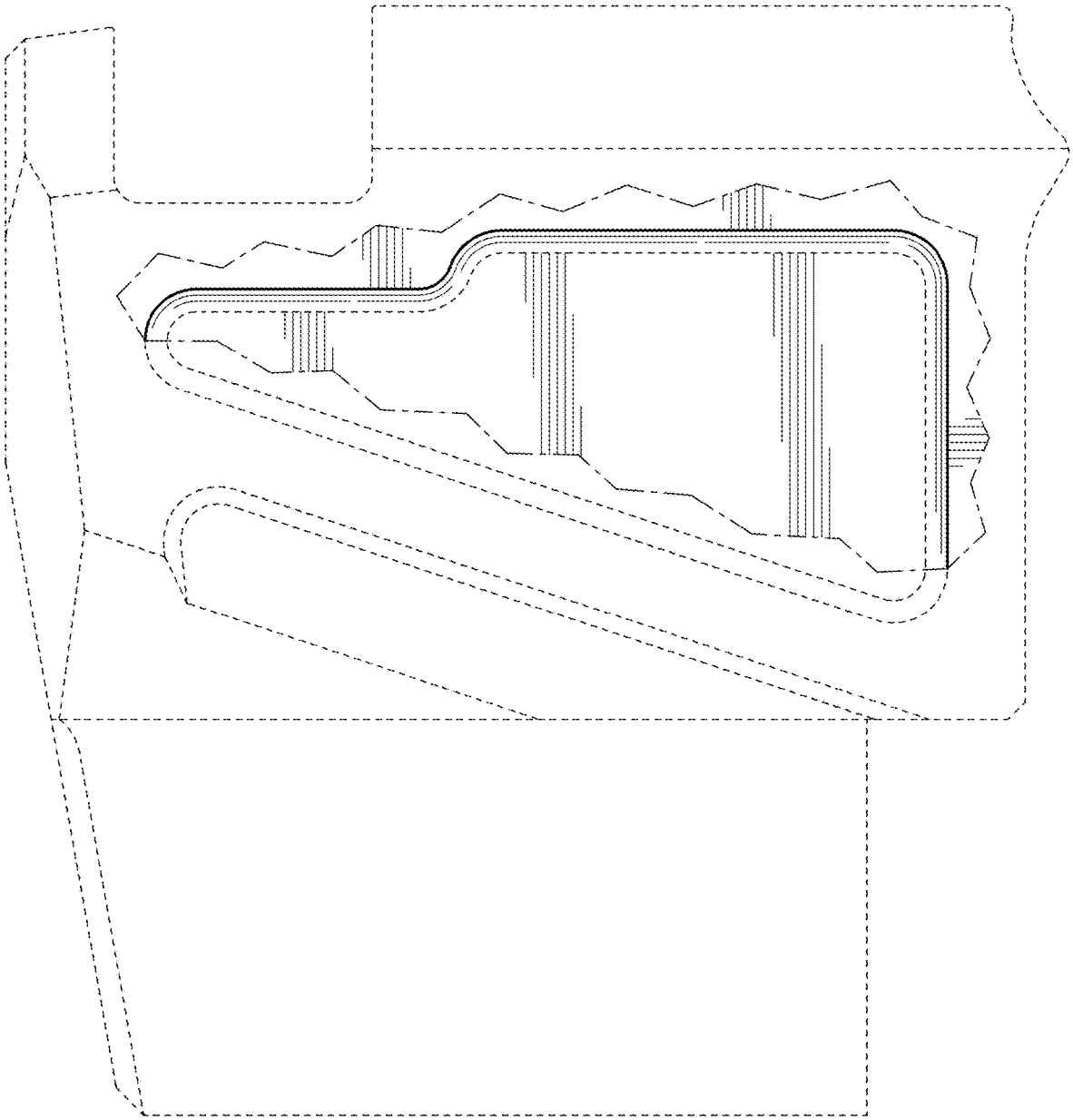
Figure 50:
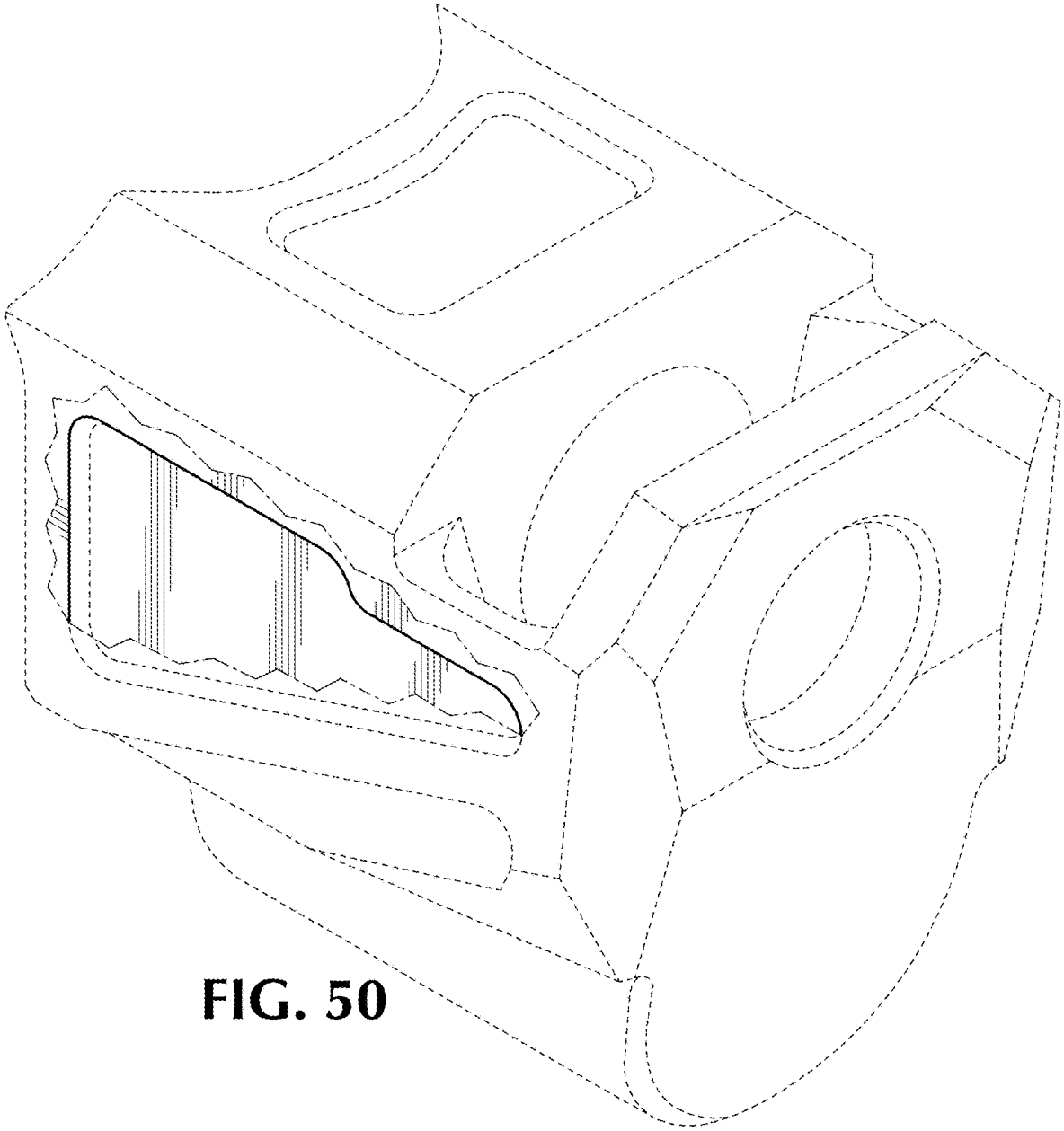
FIGS. 50-53 are a partial right isometric view, a partial left isometric view, a partial right side view, and a partial left side view, respectively, of a firearm, showing my design.
Figure 51:
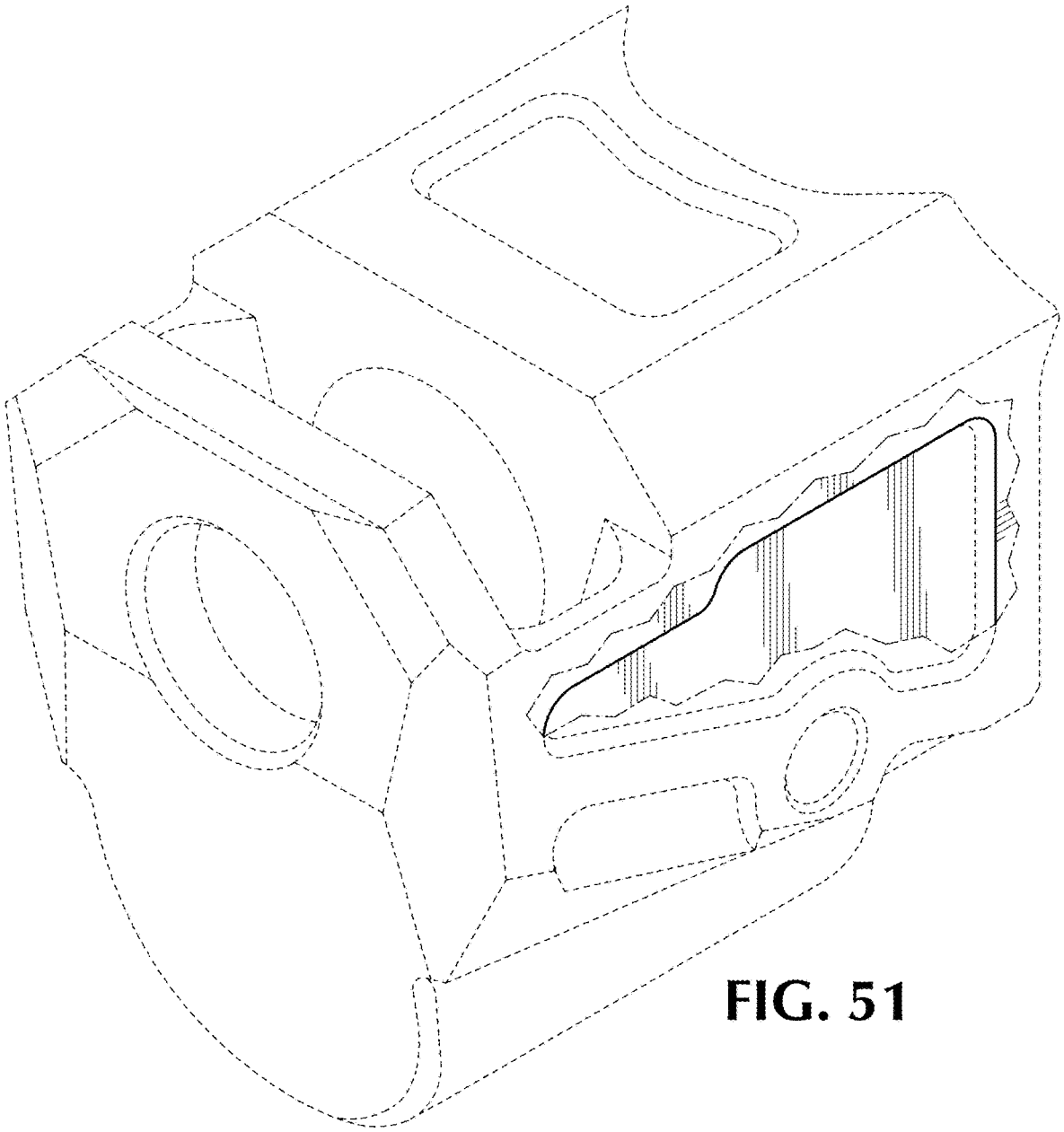
Figure 52:
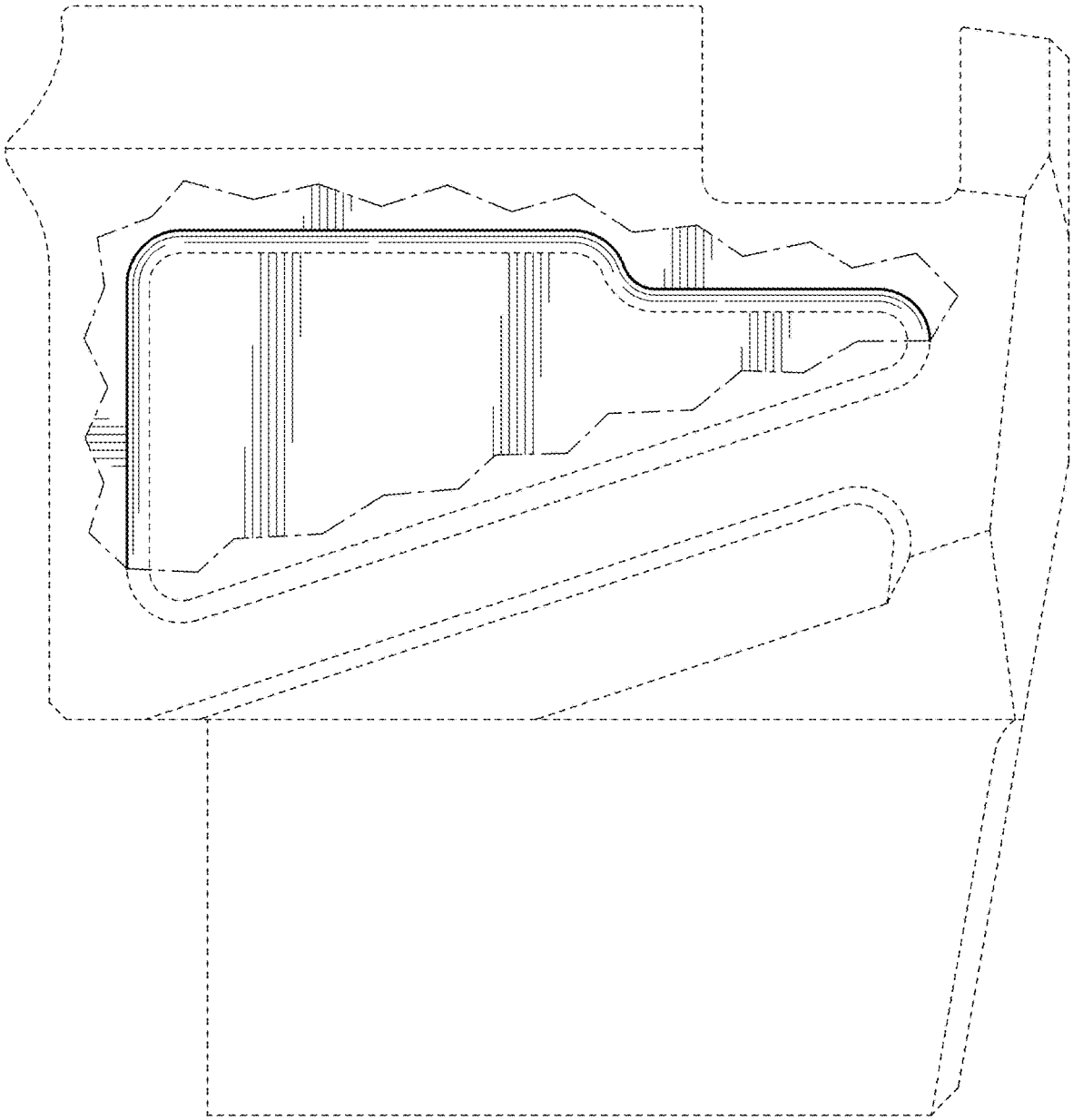
Figure 53:
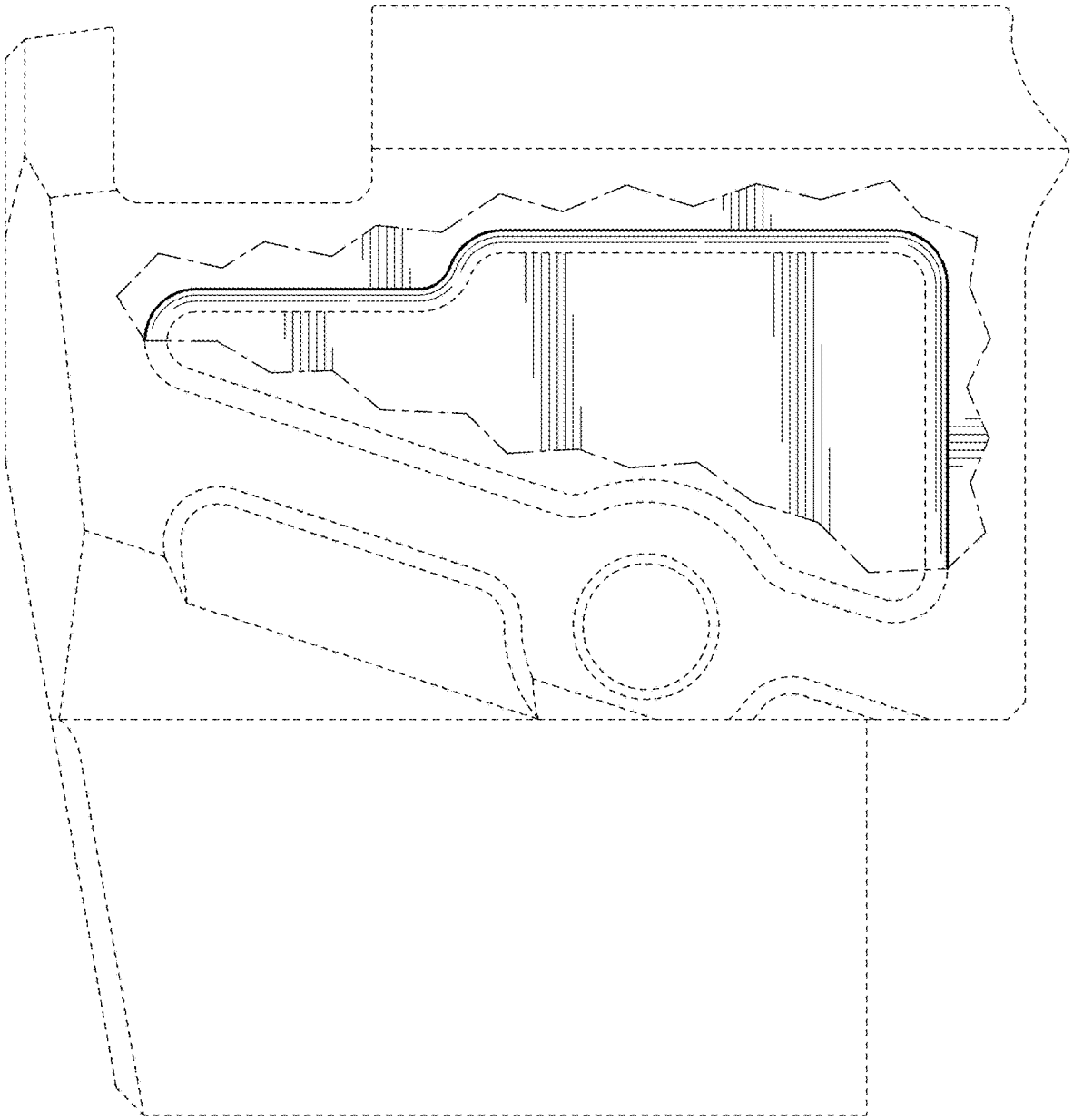

FIGS. 29A and 29B show, respectively, an isometric view and a front view of another gas port device 2910, according to various embodiments. FIGS. 29C and 29D show, respectively, a top view and a section view of the gas port device 2910 of FIGS. 29A and 29B, in which the section view is taken along section line EE-EE of FIG. 29C. This gas port device 2910, like gas port device 2610 of FIG. 26A, is muzzle-fed.

Referring to FIG. 29D, an interior of the gas port device 2910 also defines gas flow-directing sections defining a neck 2955 that may be narrower than a lower part of a cavity 2995. These gas flow-directing sections may tune the velocity of gas exiting the gas port device 2910, e.g., increase the velocity. This may provide different recoil reduction characteristics than other gas port geometries described herein.

The interior of the gas port device 2610 also includes gas flow-directing sections located below the neck 2955. These gas flow-directing sections include the illustrated undercut 2979 and the sloped side segment 2999.

The various above described compensation assemblies including muzzle-fed and barrel egress-fed gas port devices. Some other dual-port embodiments may be arranged to receive gas from both an egress in a length of the barrel and from a muzzle. Such a compensation assembly may be similar in any respect to dual-port compensation assembly 2100 (FIGS. 21A-21E). In such an example, the gas port device may have a cavity similar in any respect to cavity 2795 (FIG. 27E) or any other similar cavity described herein, and a cavity similar in any respect to cavity 2595 (FIG. 25D) or any other similar cavity described herein.

In the various examples described herein, gas port devices with cavities having sides, a front, and a back, and optionally a bottom surface, are provided. The gas flow-directing sections in the illustrated embodiments are located on the sides and the optional bottom surface, which provides a compact design that may minimize total length of the firearm. However, in other embodiments utilizing gas port geometry to tune characteristics of gas flow through a compensation assembly, a gas flow-directing section may also be provided in any other location in the cavity, such as on the front and/or back of the cavity (in addition to the sides and/or an optional bottom surface, or instead of the sides and/or an optional bottom surface).

The term "wall" as used anywhere herein describes a barrier having a thickness that is less than its height. For example:

FIG. 2A illustrates a wall at the back of the opening 23 (the back of the opening 23 is a front face of the wall 21); and.

FIGS. 17A-19 illustrate a wall at the back of the opening 1723 (the front face of that wall can be seen in FIG. 17F, and the back face of that wall can be seen in FIG. 19).

In some embodiments, it may be desirable for either of these walls to be 1) only as thick as needed to withstand, over time, the forces of received gas and/or 2) vertical (or steeper than a sloped segment of a gas flow-directing sections on the sides of the opening), which may enable a compact design that may minimize the total length of the firearm. In some embodiments, these walls may be no thicker than a thin front wall 12 of the slide 100 of FIG. 1 (e.g., less than 0.185 inches thick). In another embodiment, the wall at the back of the opening 23 (FIG. 2A) may be in the range of $1/16^{th}$ of an inch to ¼ of an inch (e.g., 0.16 inches thick in one example). In another embodiment, the wall at the back of the opening 1723 may be any value between $1/16^{th}$ of an inch to ¼ of an inch (e.g.,0.0625 inches thick in one example, and 0.2463 inches thick in another example). Any embodiment using gas port geometry may use these dimension ranges, or any other range of dimensions within the meaning of the term "wall" (e.g., having a thickness that is less than its height)

Firearm Design Examples

In FIGS. 30-77, the dot-dash broken line represents a break line or, when adjacent to the claimed design, represents an unclaimed boundary of an example design. The broken lines depicting the remainder of the firearm show features that form no part of the example design (including the broken lines used on the surface markings in FIG. 54).

FIGS. 30-37 are a partial right isometric view, a partial left isometric view, a partial right side view, a partial left side view, a partial right isometric view, a partial left isometric view, a partial right side view, and a partial left side view, respectively, of a firearm, showing my design. FIGS. 38-41 are a partial right isometric view, a partial left isometric view, a partial right side view, and a partial left side view, respectively, of a firearm, showing my design. FIGS. 42-45 are a partial right isometric view, a partial left isometric view, a partial right side view, and a partial left side view, respectively, of a firearm, showing my design. FIGS. 46-49 are a partial right isometric view, a partial left isometric view, a partial right side view, and a partial left side view, respectively, of a firearm, showing my design. FIGS. 50-53 are a partial right isometric view, a partial left isometric view, a partial right side view, and a partial left side view, respectively, of a firearm, showing my design.

Figure 54:
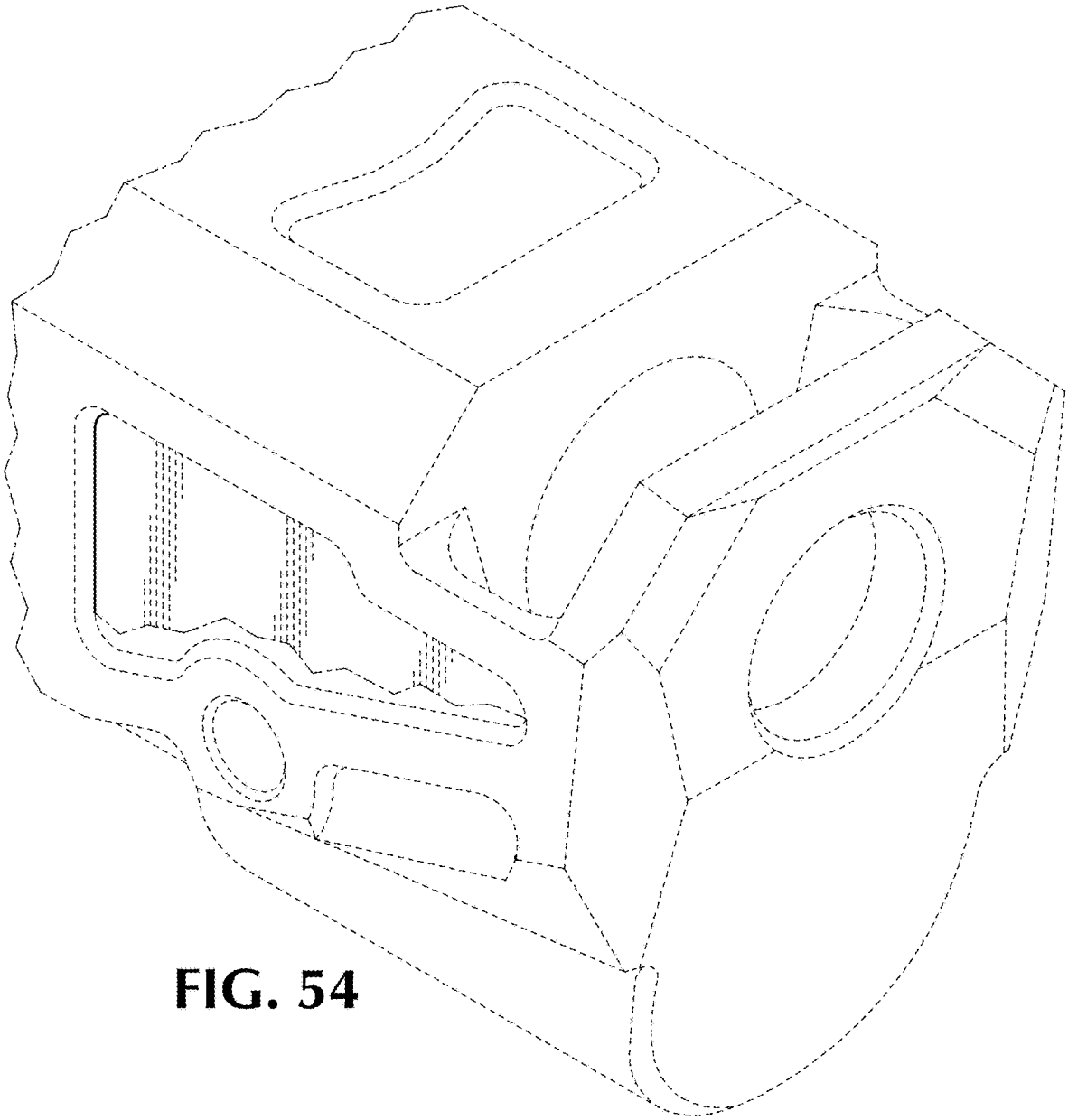
FIG. 54 is a partial right isometric view of another firearm, showing my design.
Figure 56:
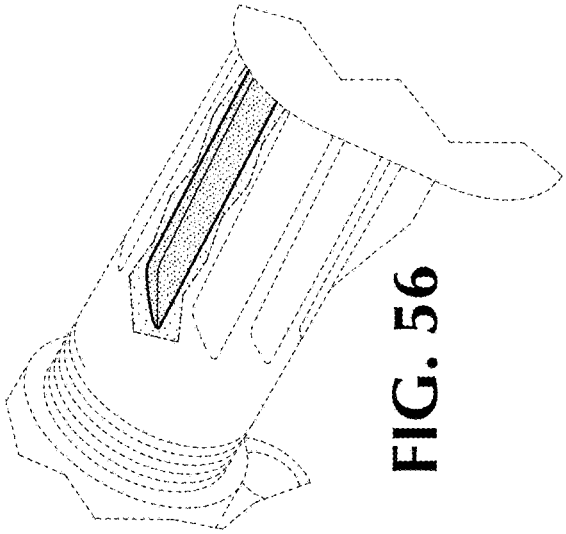
FIGS. 55-59 are a partial isometric view, another partial isometric view, a partial top view, another partial top view with a cutaway, and a sectional view taken along the lines 3-3 shown in FIG. 58, of a firearm, showing my new design.
Figure 55:
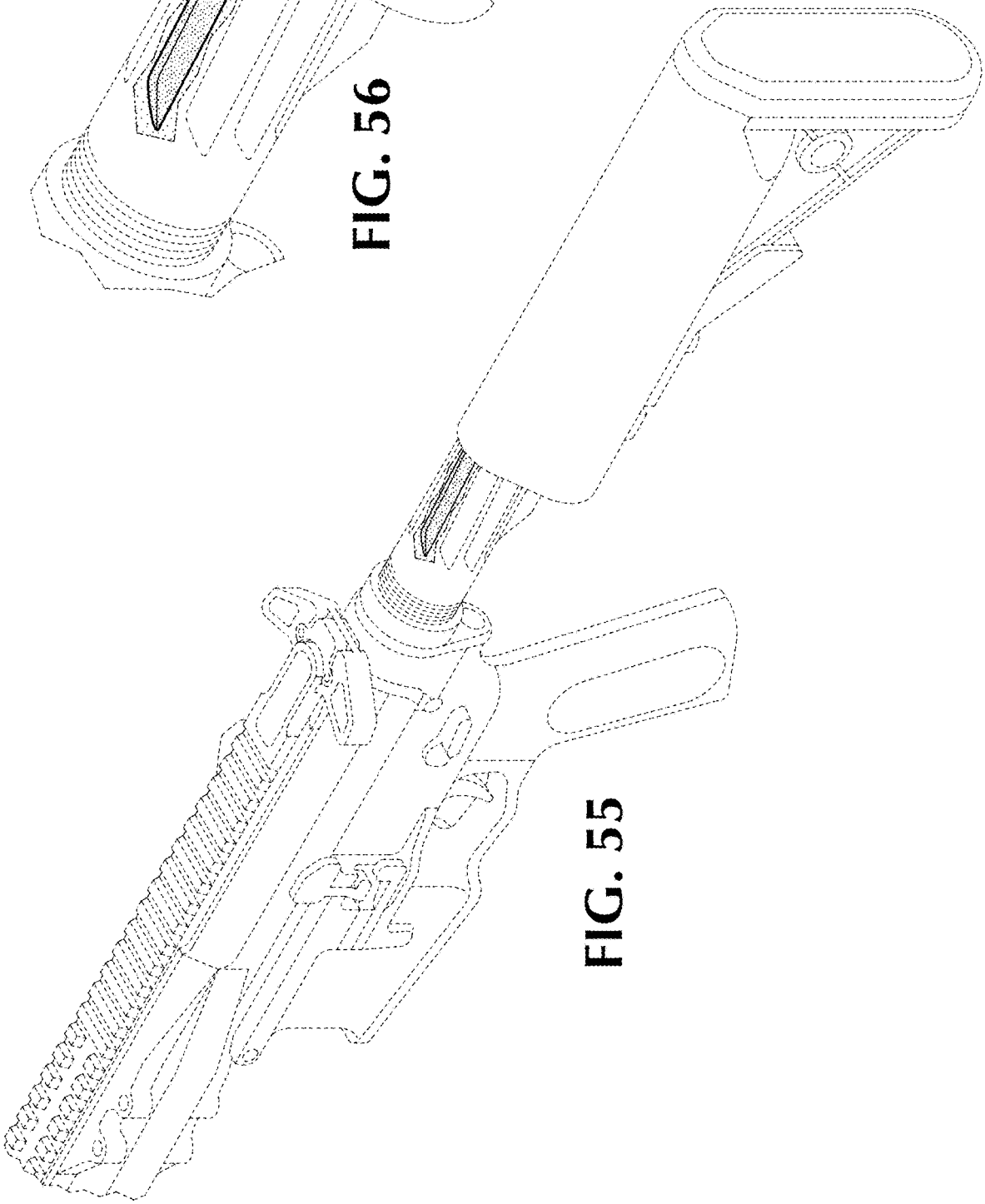
Figure 57:
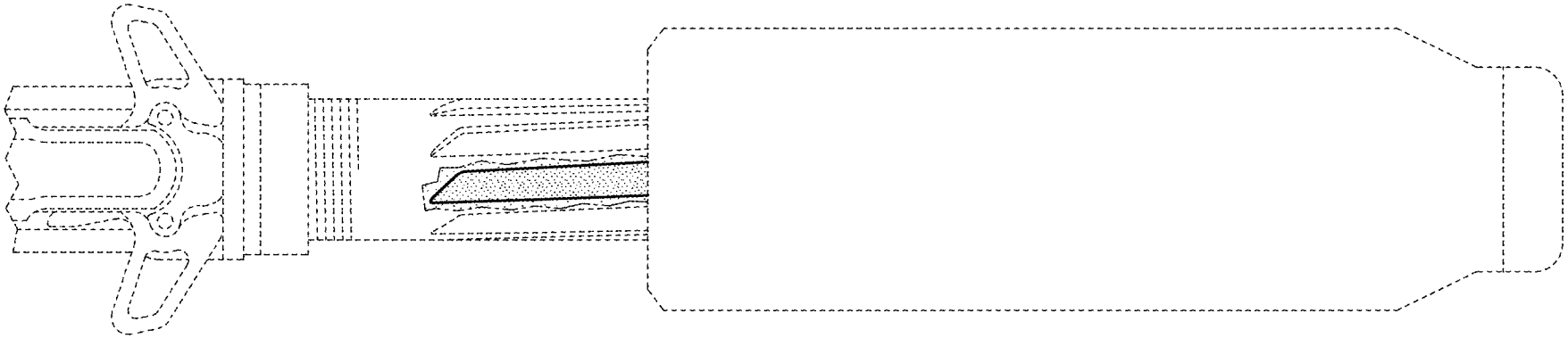

FIG. 54 is a partial right isometric view of another firearm, showing my design. In this figure, the surface shading is dashed to indicate that my design is not limited to the surface shown. In other embodiments, my design includes the design of any of FIGS. 30-53 with any surface, similar to what is shown by FIG. 54.

Figure 58:
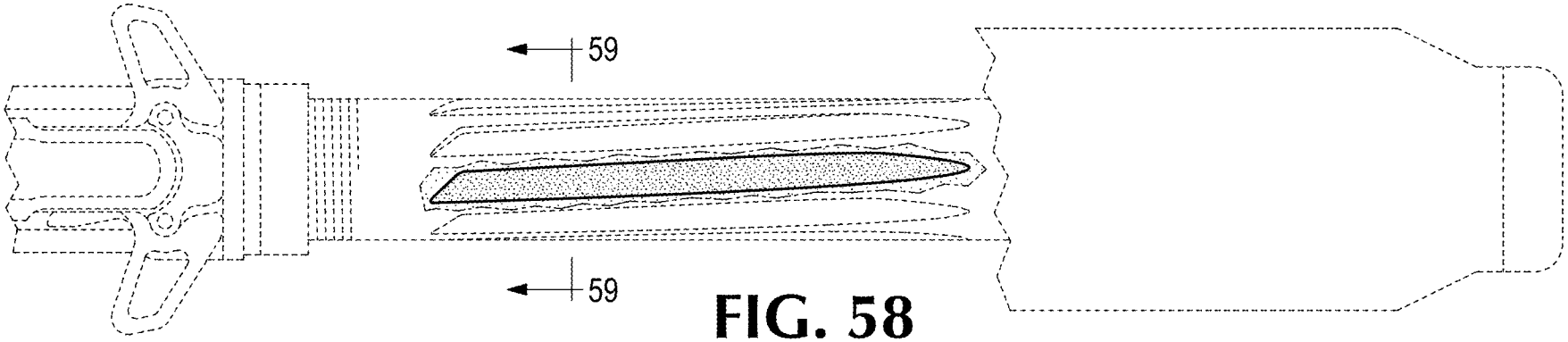
Figure 59:
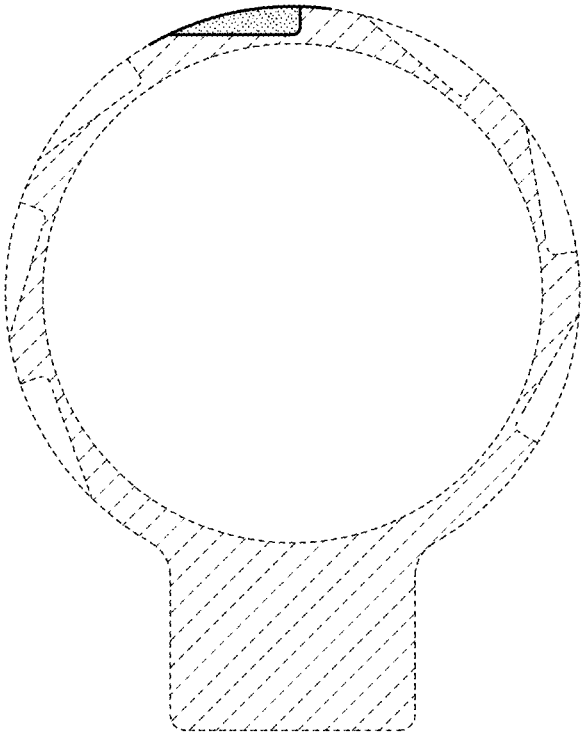
Figure 60:
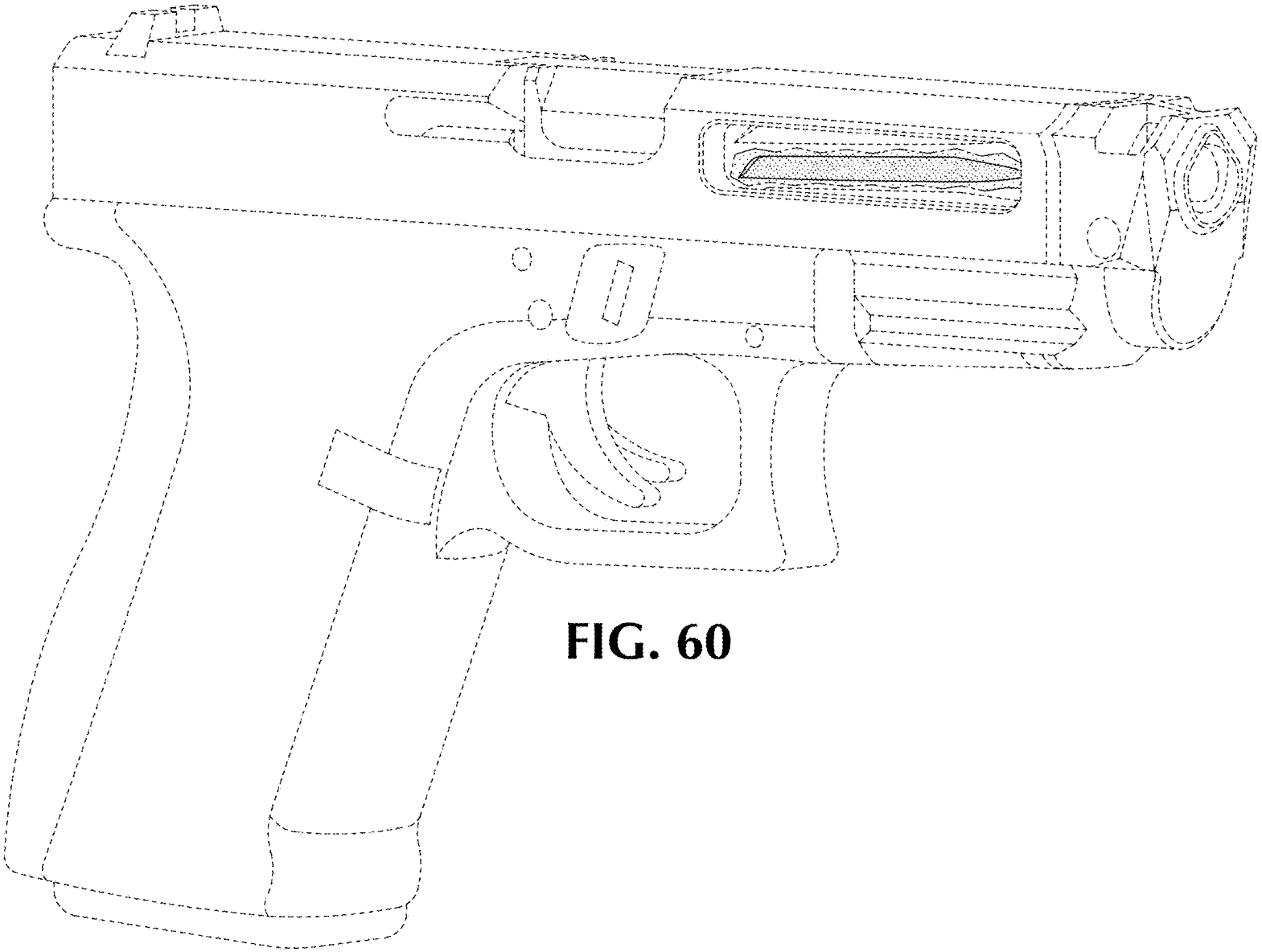
FIGS. 60-62 are an isometric view, a partial side view, a sectional view taken along the lines 62-62 of FIG. 62, respectively, of another firearm, showing my new design.
Figure 61:
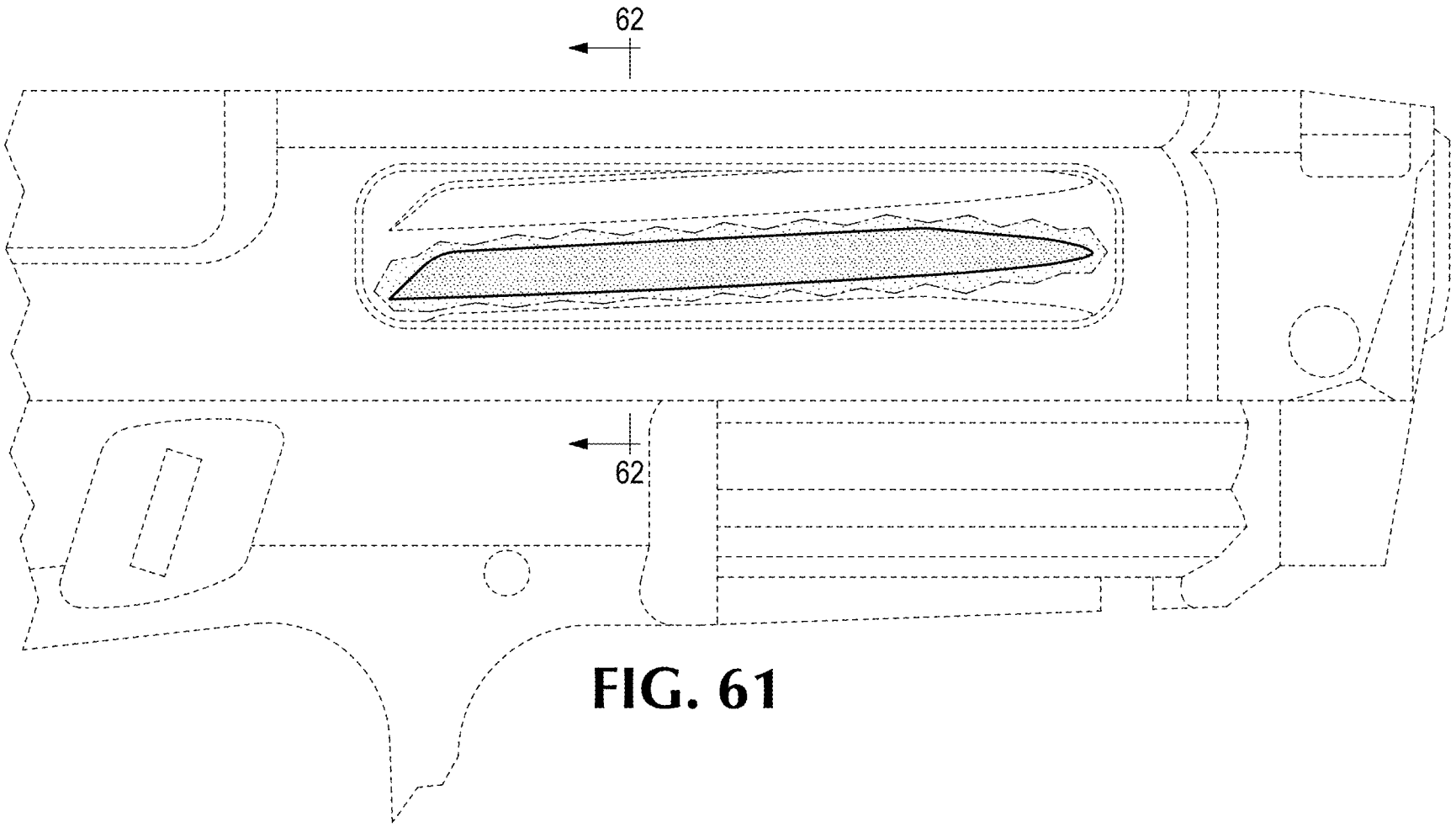
Figure 62:
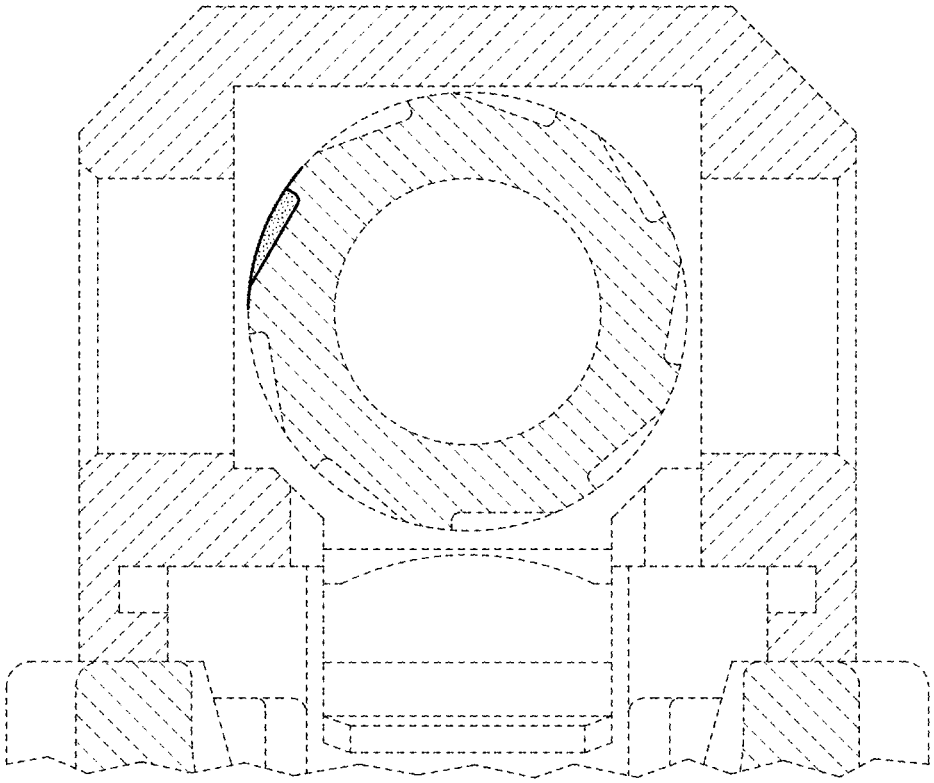
Figure 63:
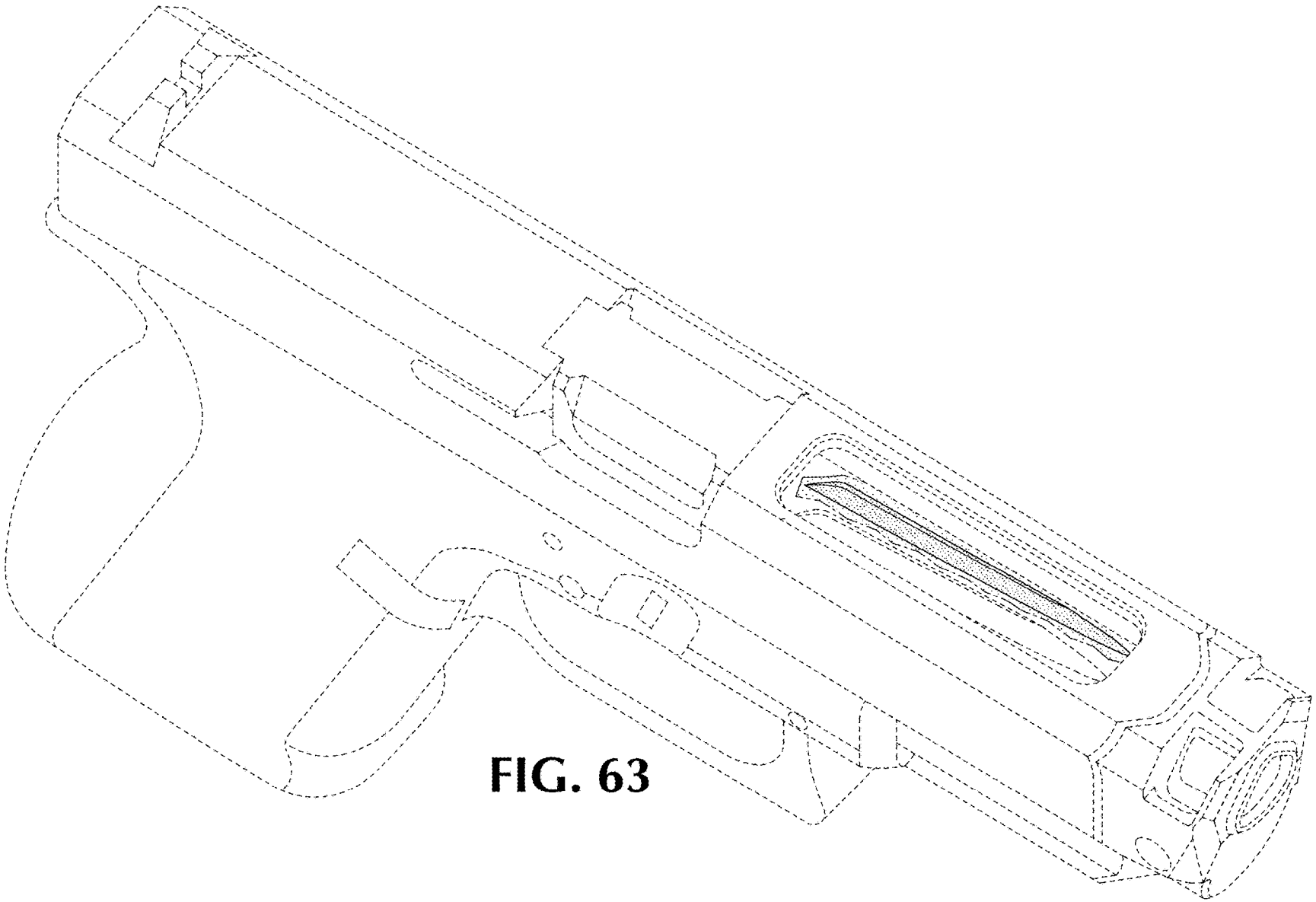
FIGS. 63-65 are an isometric view, a top view, and a sectional view taken along the lines 65-65 of FIG. 64, respectively, of another firearm component, showing my new design.
Figure 64:
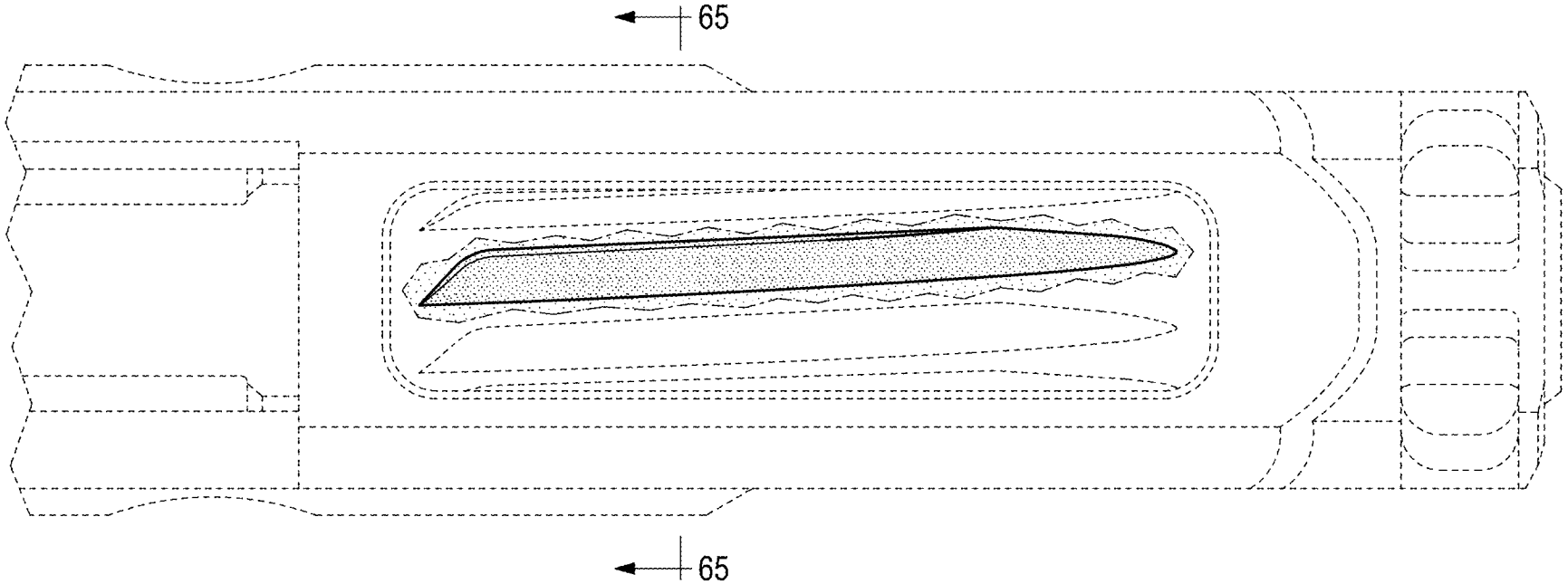
Figure 65:
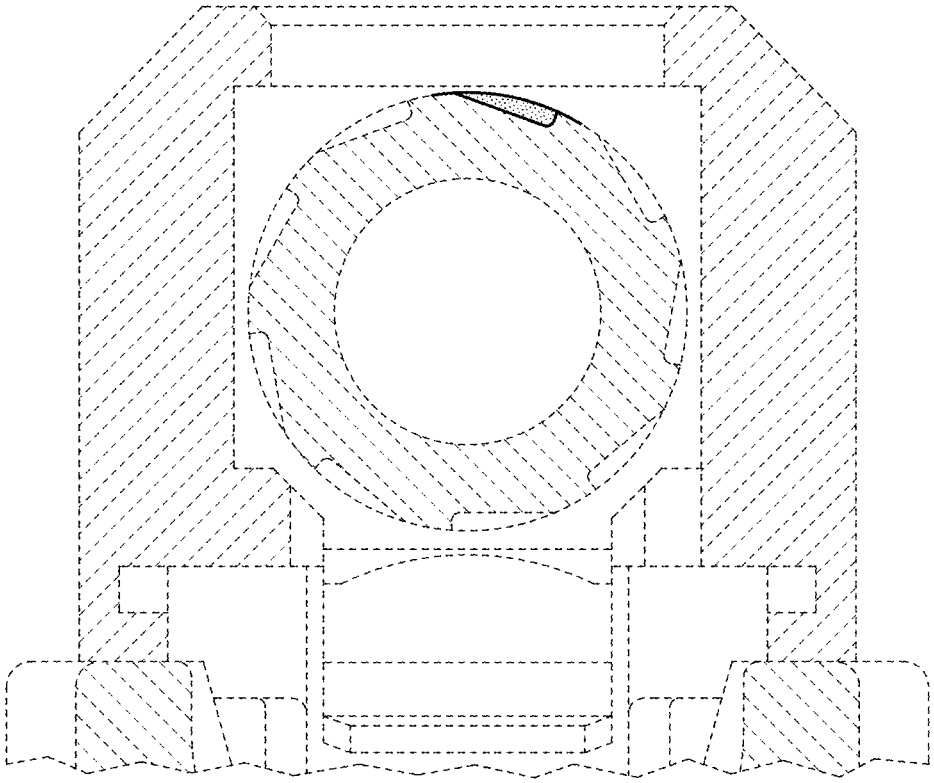
Figure 66:
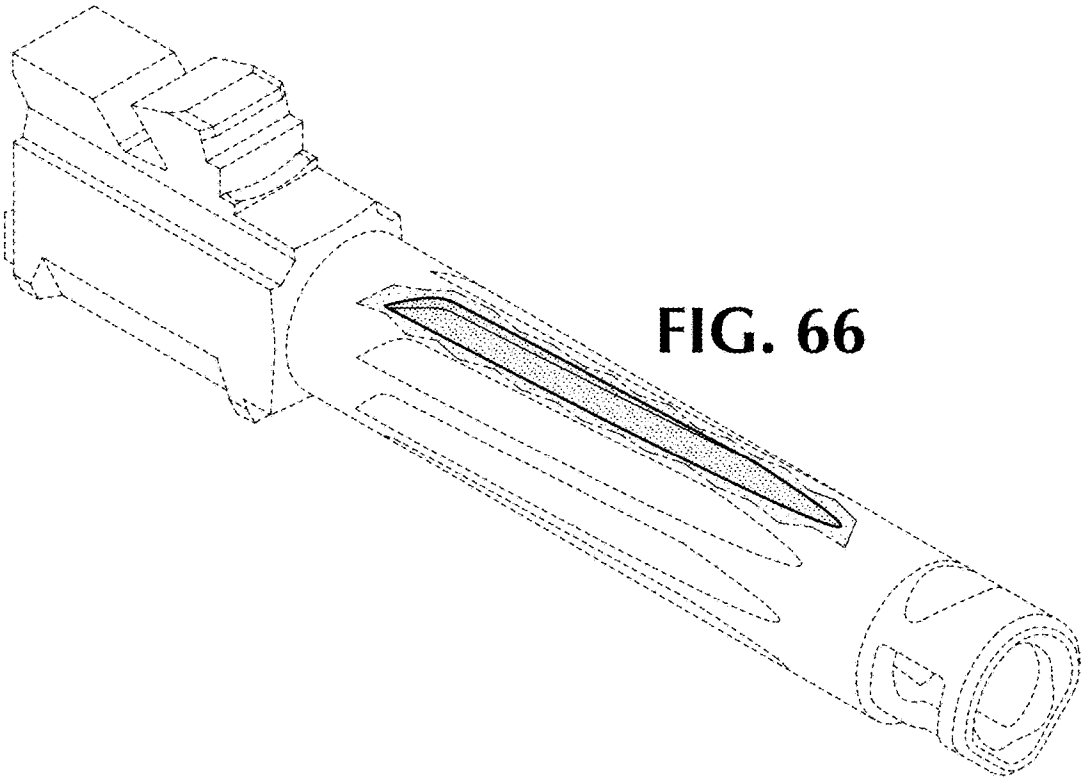
FIGS. 66-68 are an isometric view, a top view, and a sectional view taken along the lines 68-68 of FIG. 67, respectively, of a firearm component, showing my new design.
Figure 67:
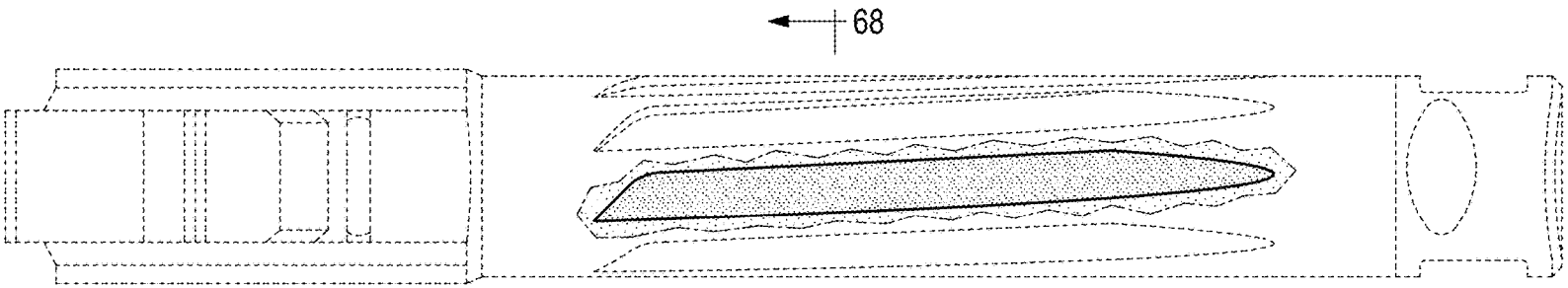
Figure 68:
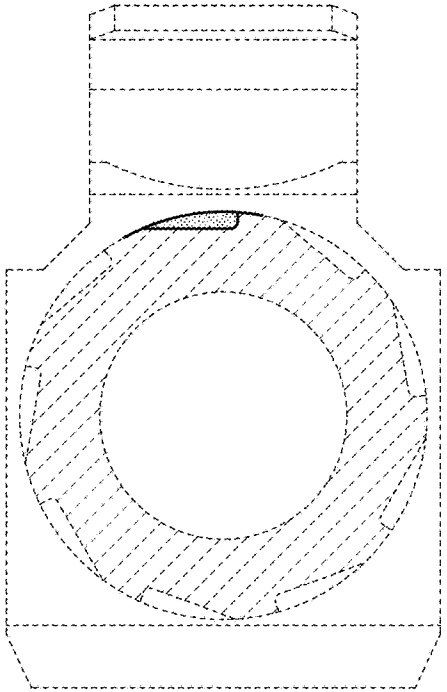
Figure 69:
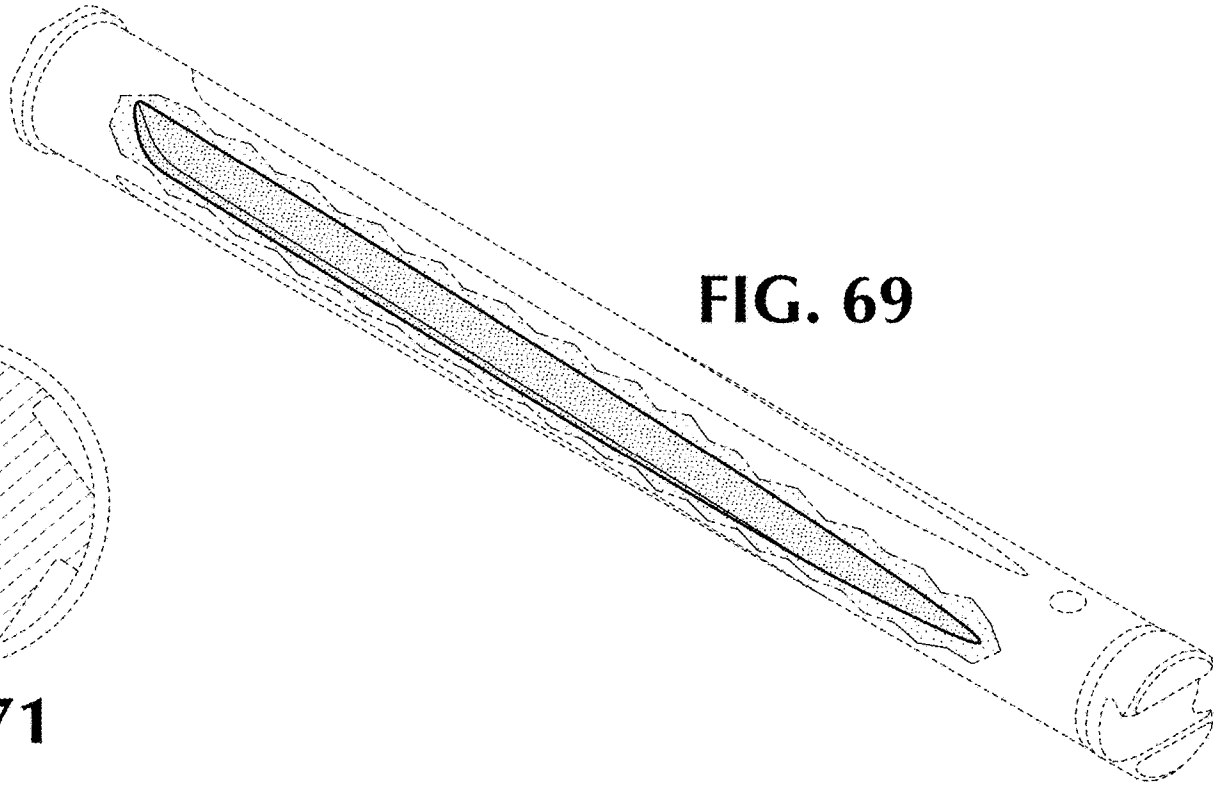
FIGS. 69-71 are an isometric view, a side view, and a sectional view taken along the lines 71-71 of FIG. 70, respectively, of another firearm component, showing my new design.
Figure 71:
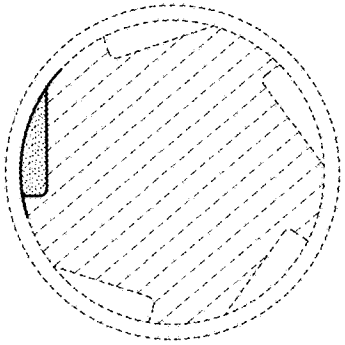
Figure 70:
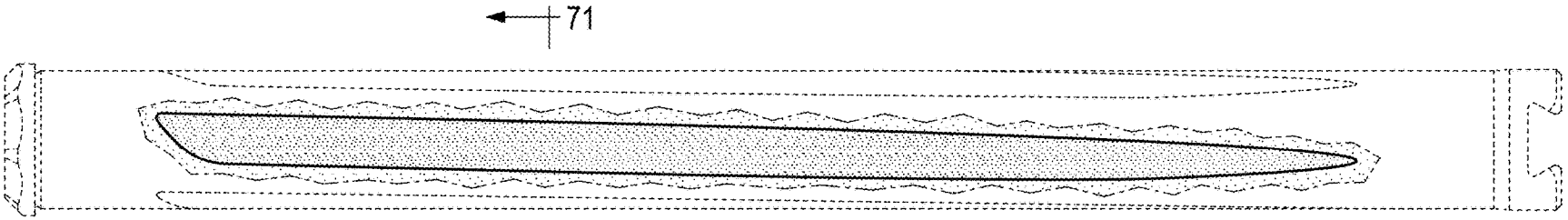

FIGS. 55-59 are a partial isometric view, another partial isometric view, a partial top view, another partial top view with a cutaway, and a sectional view taken along the lines 59-59 shown in FIG. 58, of a firearm, showing my new design. FIGS. 60-62 are an isometric view, a partial side view, a sectional view taken along the lines 62-62 of FIG. 61, respectively, of another firearm, showing my new design. FIGS. 63-65 are an isometric view, a top view, and a sectional view taken along the lines 65-65 of FIG. 64, respectively, of another firearm component, showing my new design. FIGS. 66-68 are an isometric view, a top view, and a sectional view taken along the lines 68-68 of FIG. 67, respectively, of a firearm component, showing my new design. FIGS. 69-71 are an isometric view, a side view, and a sectional view taken along the lines 71-71 of FIG. 70, respectively, of another firearm component, showing my new design. The subject matter shown in FIGS. 55-71 is described in more detail in U.S. Design Applications Nos. 29/829,894 (filed on Mar. 8, 2022) and 29/829,887 (filed on Mar. 8, 2022), which are incorporated by references herein in their entirety.

Figure 72:
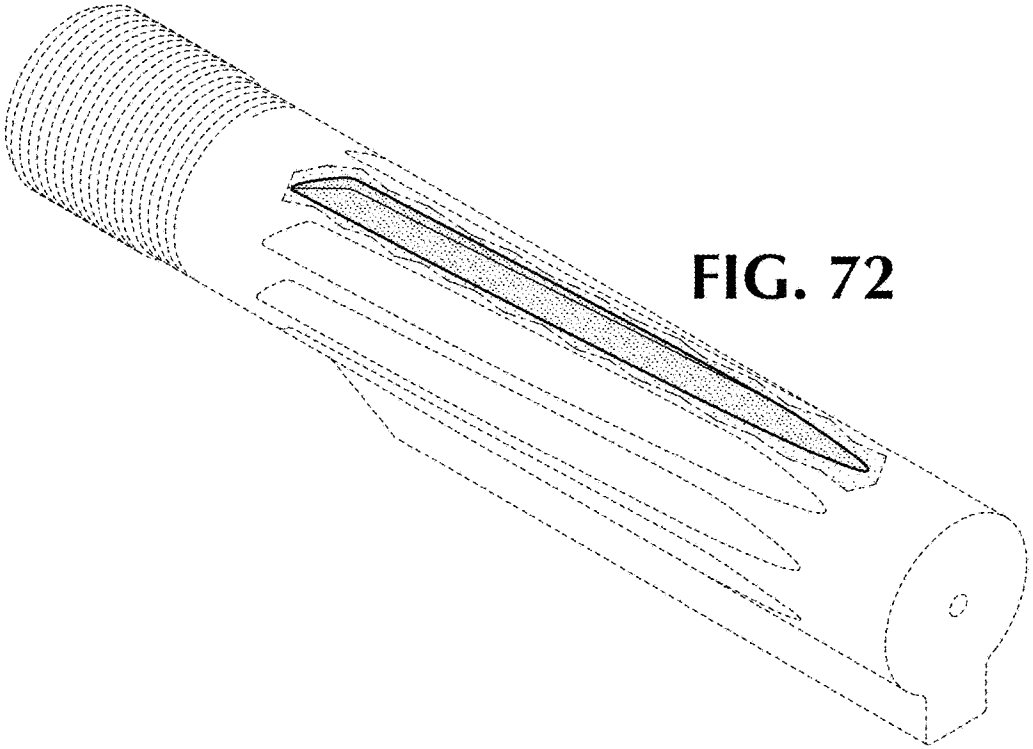
FIGS. 72-74 are an isometric view, a top view, and a sectional view taken along the lines 74-74 of FIG. 73, respectively, of yet another firearm component, showing my new design.
Figure 73:
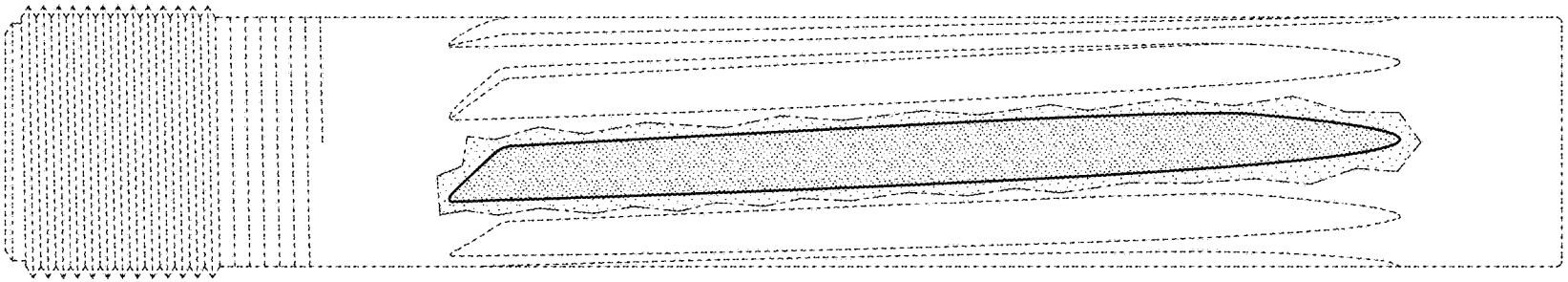
Figure 74:
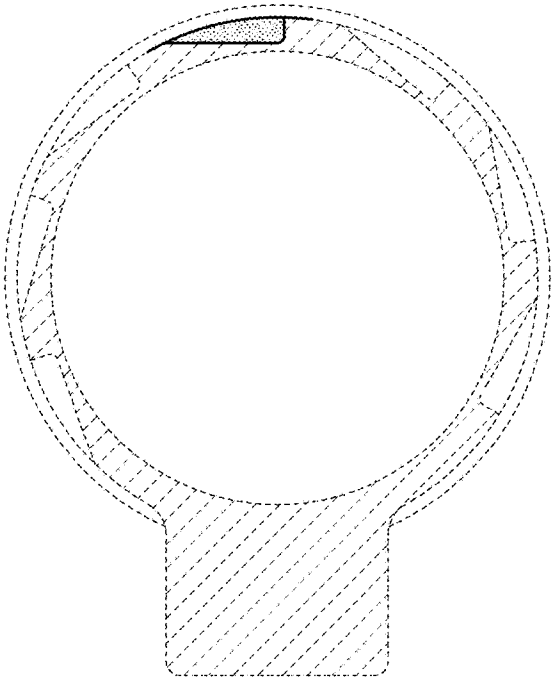
Figure 75:
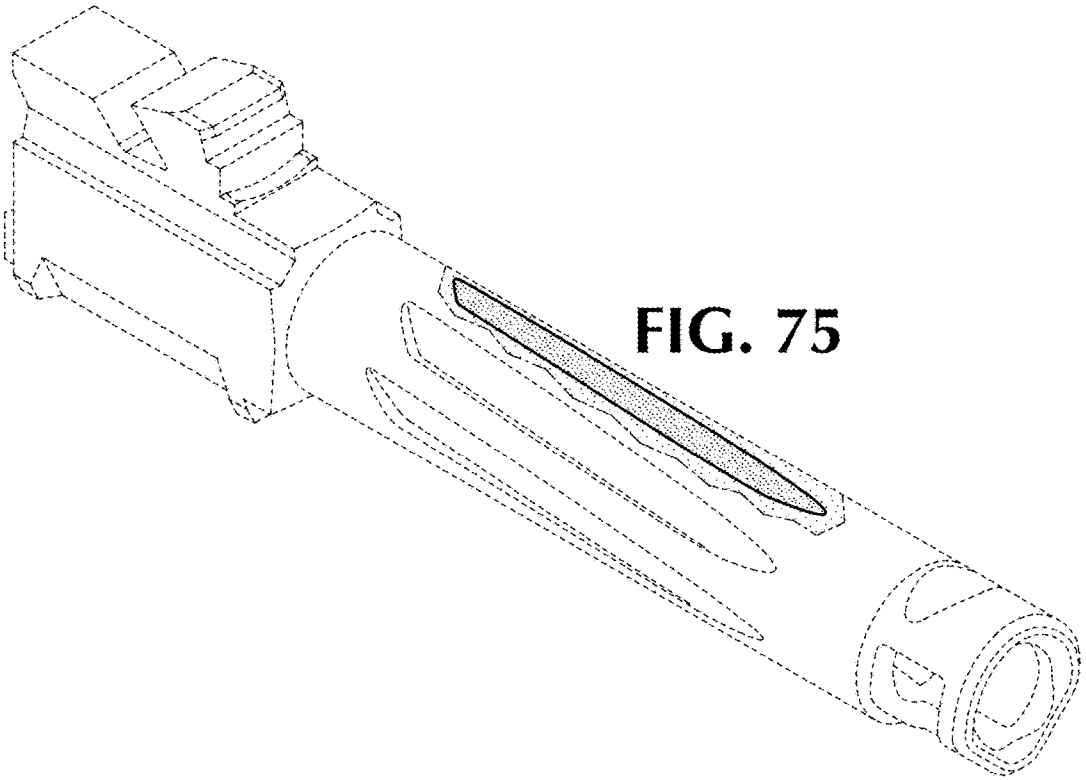
FIGS. 75-77 are an isometric view, a top view, and a sectional view taken along the lines 68-68 of FIG. 67, respectively, of yet another firearm component, showing my new design.
Figure 76:
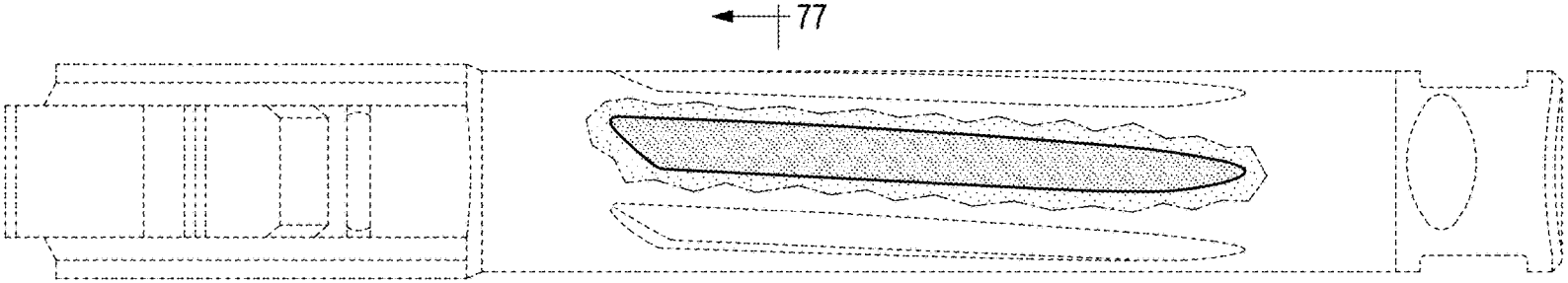
Figure 77:
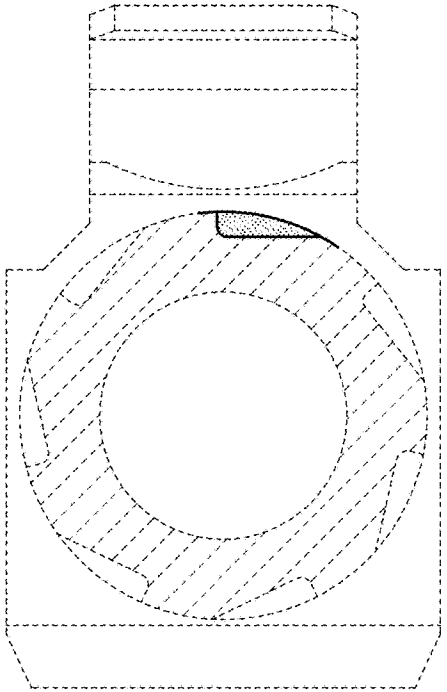

We also claim a mirror design of all of the firearm fluting designs illustrated in FIGS. 55-71. A mirror fluting design may have the size, or some other size. In the case of a different size, this may increase the quantity of fluting marks on a given firearm or firearm component. FIGS. 72-77 show just one example of a larger mirror design in which the quantity of fluting marks on a similar firearm component is different (e.g., fewer). In particular, FIGS. 72-74 are an isometric view, a top view, and a sectional view taken along the lines 74-74 of FIG. 73, respectively, of yet another firearm component, showing my new design, and FIGS. 75-77 are an isometric view, a top view, and a sectional view taken along the lines 77-77 of FIG. 76, respectively, of yet another firearm component, showing my new design.

We claim all modifications and variations coming within the spirit and scope of the following claims.

The invention claimed is:

1. An apparatus comprising:

a barrel having a front half, the front half including a muzzle end of the barrel;

the front half having an exterior, a forward portion of which is non-threaded, the forward portion including the muzzle end of the barrel and extending a distance rearward from the muzzle end, said distance along a line that is parallel with a bore axis of the barrel;

the distance comprising less than a largest outer diameter of the front half, or another width of the front half, the other width of the front half comprising a largest lateral width of the front half that can be taken along a lateral line that is perpendicular to the bore axis;

the forward portion having a non-round profile, wherein a rearmost portion of the non-round profile is in the forward portion;

a body mountable on the barrel, the body having a back end with an opening allowing clearance for the non-round profile;

wherein at least some of the non-round profile of the forward portion of the exterior is observable from a location forward of the muzzle end of the barrel when the body is not mounted on the barrel, the location along an axis that is coaxial with the bore axis of the barrel;

at least some of the forward portion of the exterior is configured to restrict rotational movement of one of the body and the barrel relative to the other of the body and the barrel.

2. The apparatus of claim 1, wherein the body defines at least one indexing surface to provide identical mounting of the body to the barrel, in a repeatable fashion.

3. The apparatus of claim 2, wherein the at least one indexing surface includes one or more indexing faces.

4. The apparatus of claim 1, wherein the barrel comprises a non-threaded barrel.

5. The apparatus of claim 1, wherein the body comprises a compensation body including one or more gas ports.

6. The apparatus of claim 1, wherein the exterior of the front half of the barrel comprises a non-threaded exterior having at least one discontinuity, the at least one discontinuity defining two or more surfaces;

the apparatus further comprising:

one or more gas ports to redirect, or vent, gas output from the barrel; and at least one part to orient the one or more gas ports with the barrel by engaging at least one surface of two or more surfaces, the orientation including 1) restriction of a rotational orientation of the one or more gas ports relative to the barrel or 2) restriction of fore/aft positioning of the one or more gas ports relative to the barrel.

7. The apparatus of claim 6, wherein the two or more surfaces comprise a groove.

8. The apparatus of claim 7, wherein the groove comprises a linear groove, an axis of which is non-parallel with the bore axis of the barrel.

9. The apparatus of claim 7, wherein the two or more surfaces include at least three different surfaces, one of which comprises a bottom surface of the groove.

10. The apparatus of claim 7, wherein the two or more surfaces have a coinciding edge, wherein the coinciding edge comprises a bottommost part of the groove.

11. The apparatus of claim 6, wherein the two or more surfaces have at least one coinciding edge, wherein the at least one coinciding edge is non-parallel with the bore axis of the barrel.

12. The apparatus of claim 6, wherein the at least one part includes a threaded feature.

13. An apparatus comprising:

a barrel having a front half, the front half including a muzzle end of the barrel;

the front half having an exterior, a forward portion of which is non-threaded, the forward portion including the muzzle end and extending a distance rearward from the muzzle end, said distance along a line that is parallel with a bore axis of the barrel;

the distance comprising less than a largest outer diameter of the front half, or another width of the front half, the other width of the front half comprising a largest lateral width of the front half that can be taken along a lateral line that is perpendicular to the bore axis;

the forward portion having at least one non-round face, wherein a rearmost portion of the at least one non-round face is in the forward portion;

a body to fit around a portion of the barrel, the body including a back end with an opening allowing clearance for the at least one non-round face of the forward portion of the exterior of the front half of the barrel;

wherein a portion of the at least one non-round face is recessed and observable from a location forward of the muzzle end of the barrel when the body is not around the barrel, the location along an axis that is coaxial with the bore axis of the barrel;

the at least one non-round face to restrict rotational movement of one of the body and the barrel relative to the other of the body and the barrel when the body is around the barrel.

14. The apparatus of claim 13, wherein a section of a length of the barrel, around which the body fits, includes the at least one non-round face.

15. The apparatus of claim 14, wherein the body defines at least one indexing surface to provide identical mounting of the body to the barrel, in a repeatable fashion.

16. The apparatus of claim 15, wherein the at least one indexing surface includes one or more indexing faces.

17. The apparatus of claim 14, wherein the at least one non-round face comprises a portion of two or more non-round surfaces.

18. The apparatus of claim 14, wherein the body comprises a compensation body including one or more gas ports.

19. The apparatus of claim 13, wherein the body defines at least one indexing surface to provide identical mounting of the body to the barrel, in a repeatable fashion.

20. The apparatus of claim 19, wherein the at least one indexing surface includes one or more indexing faces.

21. The apparatus of claim 13, wherein the barrel comprises a non-threaded barrel.

22. The apparatus of claim 13, wherein the body comprises a compensation body including one or more gas ports.

23. An apparatus, comprising:

a barrel having a front half, the front half including a muzzle end of the barrel;

the front half having an exterior, a forward portion of which is non-threaded, the forward portion including the muzzle end and extending a distance rearward from the muzzle end, said distance along a line that is parallel with a bore axis of the barrel;

the distance comprising less than a largest outer diameter of the front half, or another width of the front half, the other width of the front half comprising a largest lateral width of the front half that can be taken along a lateral line that is perpendicular to the bore axis;

the forward portion having at least one alignment surface with a non-round face, wherein the non-round face is entirely in the forward portion;

a body to fit around a portion of the barrel, the body including a back end with an opening allowing clearance for the at least one alignment surface;

wherein a portion of the at least one alignment surface is recessed and observable from a location forward of the muzzle end of the barrel when the body is not around the barrel, the location along an axis that is coaxial with the bore axis of the barrel;

the at least one alignment surface to restrict rotational movement of one of the body and the barrel relative to the other of the body and the barrel when the body is around the barrel.

24. The apparatus of claim 23, wherein the body defines at least one indexing surface to provide identical mounting of the body to the barrel, in a repeatable fashion.

25. The apparatus of claim 24, wherein the at least one indexing surface includes one or more indexing faces.

26. The apparatus of claim 23, wherein the barrel comprises a non-threaded barrel.

27. The apparatus of claim 23, wherein the body comprises a compensation body including one or more gas ports.

28. An apparatus, comprising:

a barrel having a front half, the front half including an opening from which a fired projectile exits the barrel;

the front half having an exterior, a forward portion of which is non-threaded, the forward portion including the opening and extending a distance rearward from the opening, said distance being along a line that is parallel with a bore axis of the barrel, wherein the distance is:

less than a largest outer diameter of the front half, or less than another width of the front half, the other width of the front half comprising a largest width of the front half that can be taken along a line that is perpendicular to the bore axis;

the forward portion having 1) at least one alignment sub-portion and 2) an additional sub-portion having a cylindrical or another shape, wherein the at least one alignment sub-portion includes one or more non-cylindrical faces or other surface(s) having a non-cylindrical shape;

a body to fit around a portion of the barrel, the body including a back end with an opening allowing clearance for the at least one alignment sub-portion;

wherein a portion of the at least one alignment sub-portion is recessed and observable from a location forward of the opening of the front half of the barrel when the body is not around the barrel, the location along an axis that is coaxial with the bore axis;

the at least one alignment sub-portion to restrict rotational movement of one of the body and the barrel relative to the other of the body and the barrel when the body is around the barrel.

29. The apparatus of claim 28, wherein a section of a length of the barrel, around which the body fits, includes:

a non-cylindrical face of the one or more non-cylindrical faces, or a surface of the other surface(s) having the non-cylindrical shape.

30. The apparatus of claim 29, further comprising at least one indexing surface to provide identical mounting of the body to the barrel, in a repeatable fashion.

31. The apparatus of claim 30, wherein the at least one indexing surface includes one or more indexing faces.

32. The apparatus of claim 28, wherein the one or more non-cylindrical faces comprise a plurality of non-cylindrical faces.

33. The apparatus of claim 29, wherein the body comprises a compensation body including one or more gas ports.

34. The apparatus of claim 28, further comprising at least one indexing surface to provide identical mounting of the body to the barrel, in a repeatable fashion.

35. The apparatus of claim 34, wherein the at least one indexing surface includes one or more indexing faces.

36. The apparatus of claim 28, wherein the barrel comprises a non-threaded barrel.

37. The apparatus of claim 28, wherein the body comprises a compensation body including one or more gas ports.

38. An apparatus, comprising:

a barrel having a front half, the front half including an opening from which a fired projectile exits the barrel;

the front half having an exterior, a forward portion of which is non-threaded, the forward portion including the opening and extending a distance rearward from the opening, said distance being along a line that is parallel with a bore axis of the barrel;

the distance comprising 1) less than a largest diameter of the front half, or 2) less than a largest width of the front half that can be measured along a line that is perpendicular to the bore axis;

the forward portion having at least one alignment sub-portion, the at least one alignment sub-portion including a non-cylindrical segment with a cross-section that differs from another cross-section of the forward portion;

a body to fit around a portion of the barrel, the body including a back end with an opening allowing clearance for the at least one alignment sub-portion;

wherein a portion of the at least one alignment sub-portion is recessed and observable from a location forward of the opening of the front half of the barrel when the body is not around the barrel, said location being along an axis that is coaxial with the bore axis;

the at least one alignment sub-portion arranged to restrict rotational movement of one of the body and the barrel relative to the other of the body and the barrel when the body is around the barrel.

39. The apparatus of claim 38, wherein a section of a length of the barrel, around which the body fits, includes at least one non-cylindrical face, wherein the non-cylindrical segment is coincident with a portion of the at least one non-cylindrical face.

40. The apparatus of claim 39, further comprising at least one indexing surface to provide identical identically mounting of the body to the barrel, in a repeatable fashion.

41. The apparatus of claim 40, wherein the at least one indexing surface includes one or more indexing faces.

42. The apparatus of claim 38, wherein the non-cylindrical segment is coincident with a non-cylindrical face of a plural-faced plural faceted surface.

43. The apparatus of claim 39, wherein the body comprises a compensation body including one or more gas ports.

44. The apparatus of claim 38, further comprising at least one indexing surface to provide identical identically mounting of the body to the barrel, in a repeatable fashion.

45. The apparatus of claim 44, wherein the at least one indexing surface includes one or more indexing faces.

46. The apparatus of claim 38, wherein the barrel comprises a non-threaded barrel.

47. The apparatus of claim 38, wherein the body comprises a compensation body including one or more gas ports.

48. A kit of parts usable with a barrel, the kit of parts comprising:

a body to fit around a portion of front half of a barrel, characterized in that the portion of the front half of the barrel includes:

an opening from which a fired projectile exits the barrel, and an exterior, a forward portion of which is non-threaded, the forward portion including the opening and extending a distance rearward from the opening, said distance being along a line that is parallel with a bore axis of the barrel, wherein the distance is 1) less than a largest outer diameter of the front half, or 2) less than another width of the front half, the other width of the front half comprising a largest width of the front half that can be taken along a line that is perpendicular to the bore axis;

a back end of the body including an opening allowing clearance for at least one sub-portion of the forward portion, characterized in that the forward portion includes:

at least one alignment sub-portion, wherein a portion of the at least one alignment sub-portion is recessed and observable from a location forward of the opening of the front half of the barrel when the body is not around the barrel, the location along an axis that is coaxial with the bore axis, and an additional sub-portion having a cylindrical or another shape, wherein the at least one alignment sub-portion includes one or more non-cylindrical faces or other surface(s) having a non-cylindrical shape; and at least one additional part to mount the body to the barrel, the at least one additional part arranged to engage the at least one sub-portion of the forward portion, wherein the at least one sub-portion comprises the at least one alignment sub-portion;

wherein the engagement is operable to restrict rotational movement of one of the body and the barrel relative to the other of the body and the barrel when the body is around the barrel.

49. The kit of parts of claim 48, further comprising the barrel, wherein a section of a length of the barrel, around which the body fits, includes at least one non-cylindrical face, wherein the non-cylindrical segment is coincident with a portion of the at least one non-cylindrical face.

50. The kit of parts of claim 48, further comprising at least one indexing surface to provide identical identically mounting of the body to the barrel, in a repeatable fashion.

51. The kit of parts of claim 50, wherein the at least one indexing surface includes one or more indexing faces.

52. The kit of parts of claim 48, wherein the one or more non-cylindrical faces comprise a plurality of non-cylindrical faces.

53. The kit of parts of claim 52, wherein the body comprises a compensation body including one or more gas ports.

54. The kit of parts of claim 48, wherein the at least one additional part is rotatably drivable into the body, in which the body is arranged to, when the at least one additional part is rotatably driven therein, guide a surface of the rotatably driven part into engagement with the at least one alignment sub-portion.

55. The kit of parts of claim 48, wherein an interior of the opening of the body is non-threaded.

56. The kit of parts of claim 48, wherein the body comprises a compensation body including one or more gas ports.

* * * * *